US010724508B2

(12) United States Patent
Kim et al.

(10) Patent No.: US 10,724,508 B2
(45) Date of Patent: Jul. 28, 2020

(54) LINEAR COMPRESSOR

(71) Applicant: LG ELECTRONICS INC., Seoul (KR)

(72) Inventors: Junghae Kim, Seoul (KR); Hyunsoo Kim, Seoul (KR); Jeonguk Byun, Seoul (KR); Jongwoo Lee, Seoul (KR); Eonpyo Hong, Seoul (KR)

(73) Assignee: LGE ELECTRONICS INC., Seoul (KR)

( * ) Notice: Subject to any disclaimer, the term of this patent is extended or adjusted under 35 U.S.C. 154(b) by 164 days.

(21) Appl. No.: 15/491,100

(22) Filed: Apr. 19, 2017

(65) Prior Publication Data

US 2017/0298913 A1 Oct. 19, 2017

(30) Foreign Application Priority Data

Apr. 19, 2016 (KR) ..... 10-2016-0047847

(51) Int. Cl.
*F04B 9/06* (2006.01)
*F04B 39/00* (2006.01)
(Continued)

(52) U.S. Cl.
CPC ..... *F04B 9/06* (2013.01); *F04B 17/03* (2013.01); *F04B 35/045* (2013.01); *F04B 39/00* (2013.01); *F04B 39/121* (2013.01); *F04B 53/16* (2013.01)

(58) Field of Classification Search
CPC ..... F04B 9/06; F04B 35/045; F04B 39/00; F04B 39/121; F04B 53/16; F04B 17/00; F04B 17/03; F04B 17/04
See application file for complete search history.

(56) References Cited

U.S. PATENT DOCUMENTS

2006/0091735 A1* 5/2006 Song ..... F04B 17/04 310/12.25
2006/0093495 A1 5/2006 Oh et al.
(Continued)

FOREIGN PATENT DOCUMENTS

CN 1170859 1/1998
CN 1531627 9/2004
(Continued)

OTHER PUBLICATIONS

Russian Office Action dated Feb. 1, 2018. (English Translation).
(Continued)

*Primary Examiner* — Philip E Stimpert
(74) *Attorney, Agent, or Firm* — Ked & Associates LLP

(57) ABSTRACT

A linear compressor is provided. The linear compressor may include a shell having a cylindrical shape, a shell cover that covers both open ends of the shell, a cylinder accommodated into the shell and defining a compression space for a refrigerant, a piston that reciprocates within the cylinder in an axial direction to compress the refrigerant within the compression space, a motor assembly including a motor that provides power to the piston and a stator cover that supports the motor, and resonant springs seated on the stator cover that support the piston to allow the piston to perform a resonant motion. The resonant springs may be circularly arranged at three points having a same interval around a center in an axial direction.

21 Claims, 38 Drawing Sheets

(51) Int. Cl.

| | |
|---|---|
| ***F04B 39/12*** | (2006.01) |
| ***F04B 35/04*** | (2006.01) |
| ***F04B 17/03*** | (2006.01) |
| ***F04B 53/16*** | (2006.01) |

(56) References Cited

U.S. PATENT DOCUMENTS

| | | | | |
|---|---|---|---|---|
| 2006/0210411 | A1 | 9/2006 | Hyeon | |
| 2010/0266429 | A1* | 10/2010 | Kang | F04B 39/0088 417/417 |
| 2015/0004017 | A1 | 1/2015 | Kang et al. | |
| 2016/0017872 | A1* | 1/2016 | Kim | F04B 35/045 417/415 |
| 2016/0017878 | A1 | 1/2016 | Kim et al. | |

FOREIGN PATENT DOCUMENTS

| | | |
|---|---|---|
| CN | 101835976 | 9/2010 |
| CN | 101952590 | 1/2011 |
| CN | 102472263 | 5/2012 |
| CN | 103629075 | 3/2014 |
| CN | 103775305 | 5/2014 |
| CN | 204511819 | 7/2015 |
| CN | 204877852 | 12/2015 |
| CN | 105298795 | 2/2016 |
| EP | 2 977 612 | 1/2016 |
| JP | 10-252648 | 9/1998 |
| KR | 10-2004-0017958 | 3/2004 |
| KR | 10-2005-0069818 | 7/2005 |
| KR | 10-1307688 | 9/2013 |
| KR | 10-2016-0000324 | 1/2016 |
| KR | 10-2016-0001055 | 1/2016 |
| WO | WO 2007/046593 | 4/2007 |

OTHER PUBLICATIONS

European Search Report dated Sep. 5, 2017.
Chinese Office Action dated Jul. 3, 2018 issued in Application No. 201710232558.6 (with English Translation).
Chinese Office Action dated Jul. 11, 2019 with English Translation.

* cited by examiner

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2016-0047847, filed in Korea on Apr. 19, 2016, which is hereby incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this, the cooling system includes a compressor, a condenser, an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases, thereby increasing pressure. Compressors are being widely used in home appliances or industrial fields.

Compressors may be largely classified into reciprocating compressors, in which a compression space into/from which a working gas is suctioned and discharged, is defined between a piston and a cylinder to allow the piston to be linearly reciprocated into the cylinder, thereby compressing a refrigerant, rotary compressors, in which a compression space into/from which a working gas is suctioned or discharged, is defined between a roller that eccentrically rotates and a cylinder to allow the roller to eccentrically rotate along an inner wall of the cylinder, thereby compressing a refrigerant, and scroll compressors, in which a compression space into/from which a refrigerant is suctioned or discharged, is defined between an orbiting scroll and a fixed scroll to compress a refrigerant while the orbiting scroll rotates along the fixed scroll. In recent years, a linear compressor, which is directly connected to a drive motor, in which a piston linearly reciprocates, to improve compression efficiency without mechanical losses due to movement conversion, and having a simple structure, is being widely developed.

In general, the linear compressor may suction and compress a refrigerant in a sealed shell while a piston linearly reciprocates within the cylinder by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

A linear compressor having a shell shape with a height which is somewhat high in a vertical direction is disclosed in Korean Patent Registration No. 10-1307688, which is hereby incorporated by reference. The compressor may increase in size by the shell shape, and thus, a large inner space of a refrigerator or an air conditioner in which the compressor is provided may be required. More particularly, in the refrigerator, a machine room may increase in size because of the compressor, causing a loss in storage space.

Thus, to reduce the size of the linear compressor, it may be necessary to reduce a size of a main part or component of the compressor. However, in this case, the compressor may deteriorate in performance.

To solve the above-described limitation, a linear compressor in which a gas bearing easily operates between a cylinder and a piston to reduce a size of an inner part or component while maintaining a performance of the compressor is disclosed in Korean Patent Publication No. 10-2016-0000324, which is hereby incorporated by reference.

According to the above-described structure, although a spring is provided between a support and a rear cover to absorb an impact of the piston, a side force may be generated because only one spring is provided at a center in an axial direction of the compressor. Thus, when the compressor operates, a balance may not be maintained, generating vibration noise.

BRIEF DESCRIPTION OF THE DRAWINGS

Embodiments will be described in detail with reference to the following drawings in which like reference numerals refer to like elements, and wherein.

DETAILED DESCRIPTION

Hereinafter, exemplary embodiments will be described with reference to the accompanying drawings. The embodiments may, however, be embodied in many different forms and should not be construed as being limited to the embodiments set forth herein; rather, that alternate embodiments included in other retrogressive inventions or falling within the spirit and scope of the present disclosure will fully convey the concept to those skilled in the art.

Figure 1:
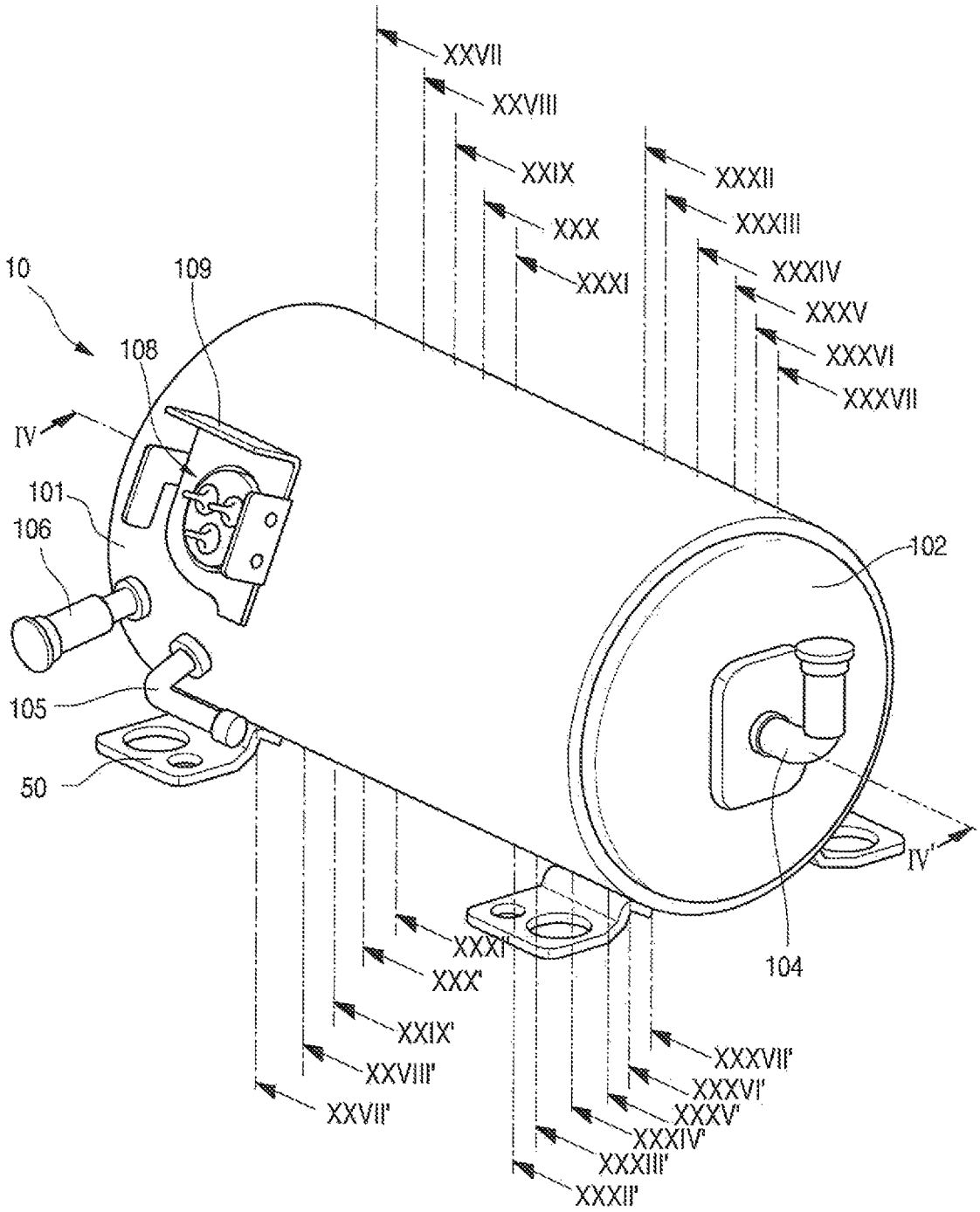
FIG. 1 is a perspective view illustrating an outer appearance of a linear compressor according to an embodiment.
Figure 2:
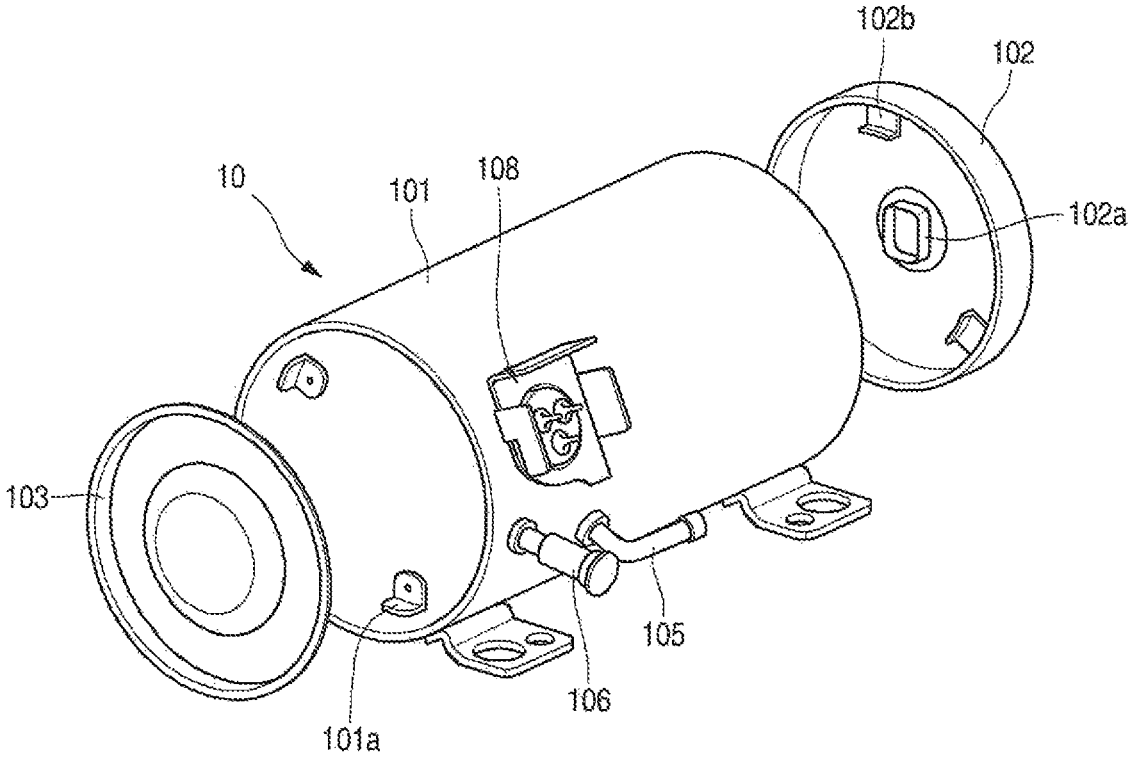
FIG. 2 is an exploded perspective view illustrating a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may be understood as a component for transmitting external power to a motor assembly (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

At least a portion of the second shell cover 103 may be disposed adjacent to an inner circumferential surface of the shell 101, which corresponds to a point to which the process pipe 106 may be coupled. That is, at least a portion of the second shell cover 103 may act as a flow resistance to the refrigerant injected through the process pipe 106.

Thus, in view of the passage of the refrigerant, the passage of the refrigerant introduced through the process pipe 106 may have a size that gradually decreases toward the inner space of the shell 101. In this process, a pressure of the refrigerant may be reduced to allow the refrigerant to be vaporized. Also, in this process, oil contained in the refrigerant may be separated. Thus, the refrigerant from which the oil is separated may be introduced into a piston 130 to improve compression performance of the refrigerant. The oil may be understood as a working oil existing in a cooling system.

A cover support part 102*a* is disposed on an inner surface of the first shell cover 102. A first support device 500 that will be described later may be coupled to the cover support part 102*a*. The cover support part 102*a* and the first support device 500 may be understood as devices for supporting a main body of the linear compressor 10. Here, the main body of the compressor represents a part provided in the shell 101. For example, the main body may include a driving part that reciprocates forward and backward and a support part supporting the driving part. The driving part may include parts such as the piston 130, a magnet frame 138, a permanent magnet 146, a support 400, and a suction muffler 150. Also, the support part may include parts such as resonant springs 176*a* and 176*b*, a rear cover 170, a stator cover 300, and the first support device 500.

A stopper 102*b* may be disposed or provided on an inner surface of the first shell cover 102. The stopper 102*b* may be understood as a component that prevents the main body of the compressor, particularly, the motor assembly 140 from being bumped by the shell 101 and thus damaged due to vibration or an impact occurring during transportation of the linear compressor 10. The stopper 102*b* may be disposed or provided adjacent to the rear cover 170, which will be described hereinafter. Thus, when the linear compressor 10 is shaken, the rear cover 170 may interfere with the stopper 102*b* to prevent the impact from being transmitted to the motor assembly 140.

A spring coupling part or portion 101*a* may be disposed or provided on the inner surface of the shell 101. For example, the spring coupling part 101*a* may be disposed at a position which is adjacent to the second shell cover 103. The spring coupling part 101*a* may be coupled to a second support spring 610 of a second support device or support 600, which will be described hereinafter. As the spring coupling part 101*a* and the second support device 600 are coupled to each other, the main body of the compressor may be stably supported inside of the shell 101.

Figure 3:
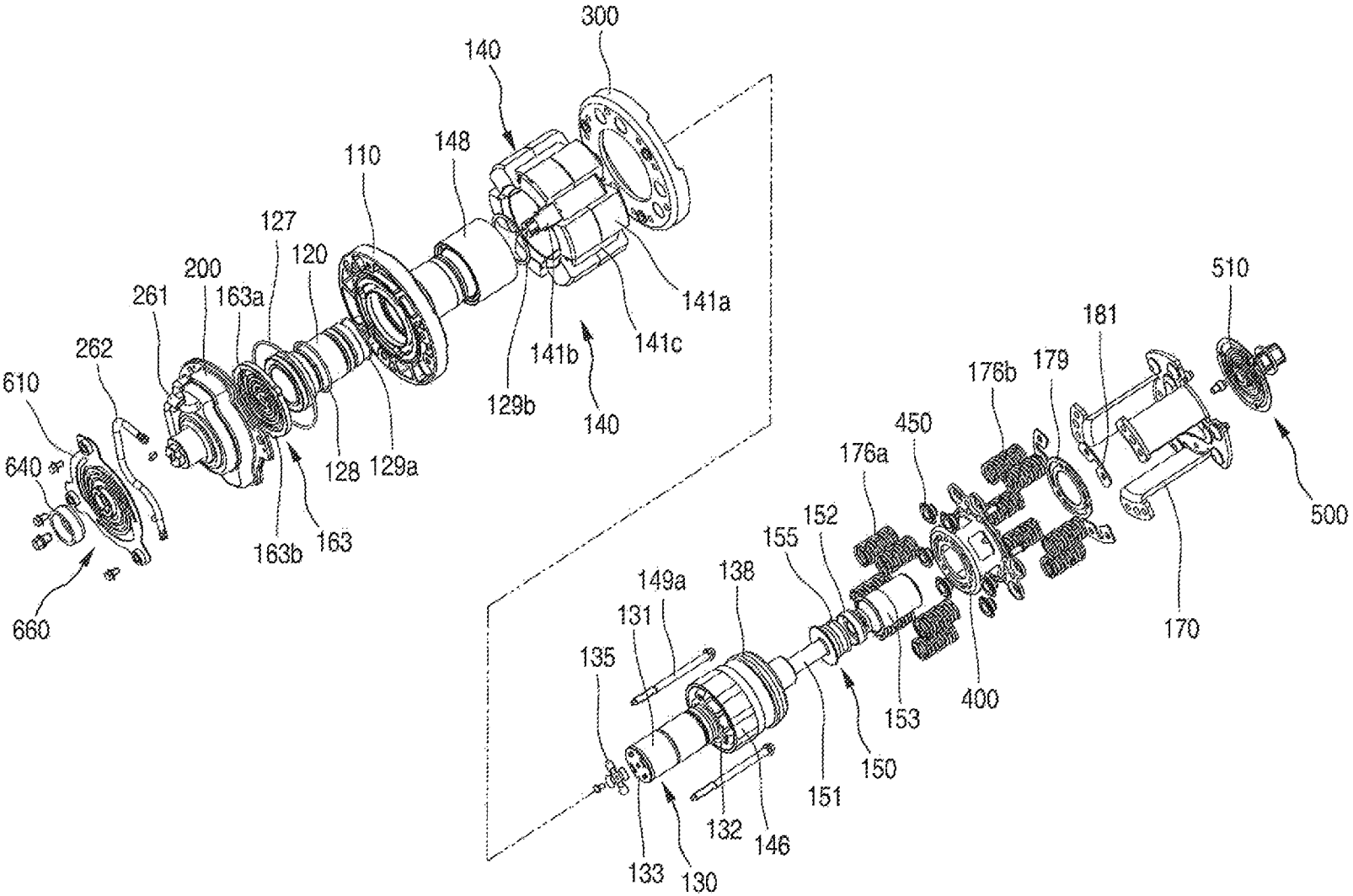
FIG. 3 is an exploded perspective view illustrating internal parts or components of the linear compressor according to an embodiment.
Figure 4:
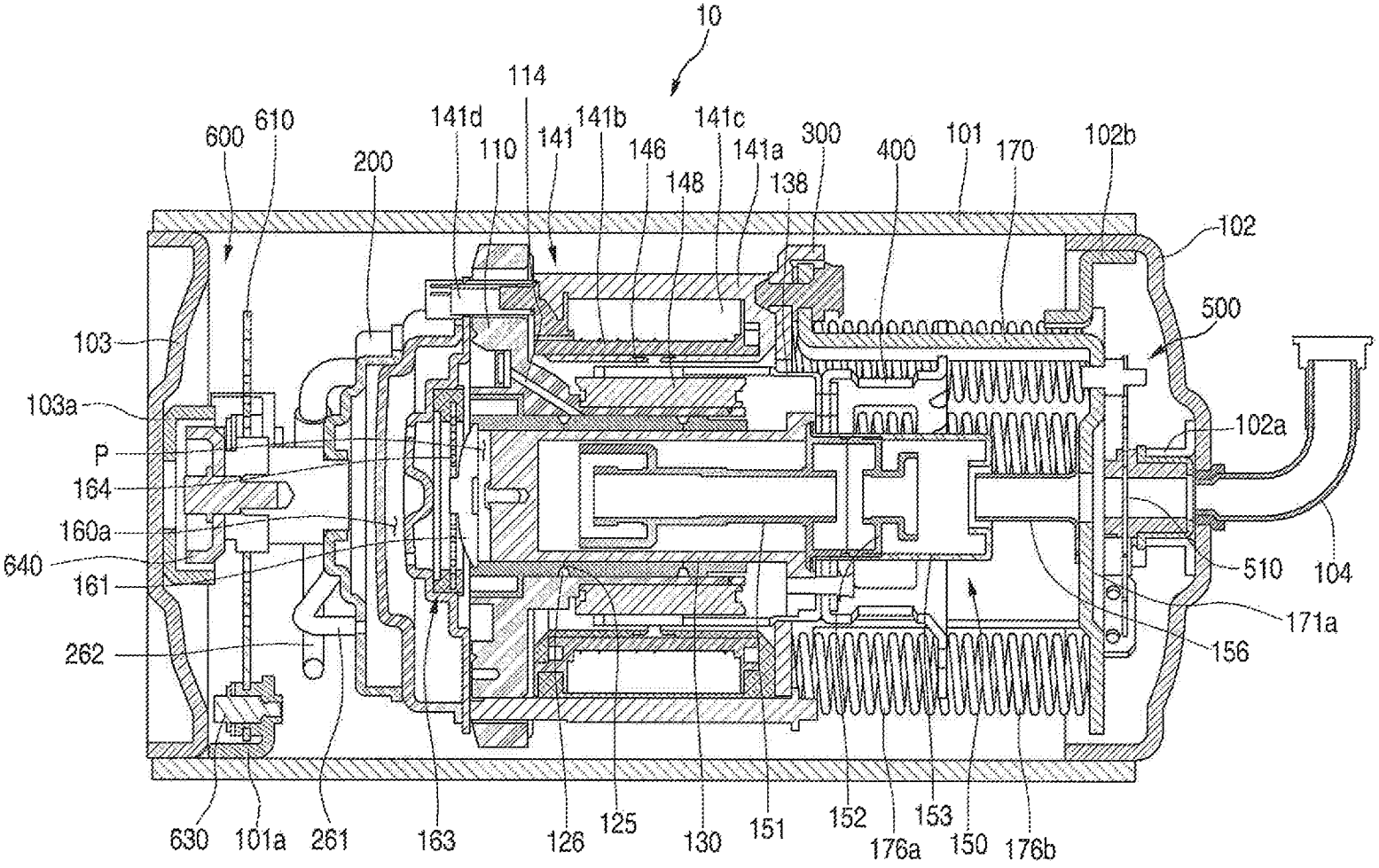
FIG. 4 is a cross-sectional view taken along line IV-IV' of FIG. 1.

FIG. 3 is an exploded perspective view illustrating internal components of the linear compressor according to an embodiment. FIG. 4 is a cross-sectional view illustrating internal components of the linear compressor according to an embodiment.

Referring to FIGS. 3 and 4, the linear compressor 10 according to an embodiment may include a cylinder 120 provided in the shell 101, the piston 130, which linearly reciprocates within the cylinder 120, and the motor assembly 140, which functions as a linear motor to apply drive force to the piston 130. When the motor assembly 140 is driven, the piston 130 may linearly reciprocate in the axial direction.

The linear compressor 10 may further include a suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, the flow noise of the refrigerant may be reduced.

The suction muffler 150 may include a plurality of mufflers 151, 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, a horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". When the piston 130 moves forward, the compression space P may be compressed. On the other hand, the "radial direction" may be understood as a direction which is perpendicular to the direction in which the piston 130 reciprocates, that is, a vertical direction in FIG. 4.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover 200 that defines a discharge space 160*a* for the refrigerant discharged from the compression space P and a discharge valve assembly 161 and 163 coupled to the discharge cover 200 to selectively discharge the refrigerant compressed in the compression space P may be provided at a front side of the compression space P. The discharge space 160*a* may include a plurality of space parts or spaces, which may be partitioned by inner walls of the discharge cover 200. The plurality of space parts may be disposed or provided in the frontward and rearward direction to communicate with each other.

The discharge valve assembly 161 and 163 may include a discharge valve 161 which may be opened when the pressure of the compression space P is above a discharge pressure to introduce the refrigerant into the discharge space and a spring assembly 163 disposed or provided between the discharge valve 161 and the discharge cover 200 to provide elastic force in the axial direction. The spring assembly 163 may include a valve spring 163*a* and a spring support part or support 163*b* that supports the valve spring 163*a* to the discharge cover 200. For example, the valve spring 163*a* may include a plate spring. The spring support part 163*b* may be integrally injection-molded to the valve spring 163*a* through an injection-molding process, for example.

The discharge valve 161 may be coupled to the valve spring 163*a*, and a rear portion or rear surface of the discharge valve 161 may be disposed to be supported on a front surface of the cylinder 120. When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

The compression space P may be understood as a space defined between the suction valve 135 and the discharge valve 161. Also, the suction valve 135 may be disposed on or at one side of the compression space P, and the discharge valve 161 may be disposed on or at the other side of the compression space P, that is, an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. Here, the refrigerant may be discharged from the compression space P into the discharge space of the discharge cover 200. When the discharge of the refrigerant is completed, the valve spring 163*a* may provide restoring force to the discharge valve 161 to close the discharge valve 161.

The linear compressor 10 further includes a connection pipe 261 coupled to the discharge cover 200 to allow the refrigerant flowing through the discharge space 160*a* of the discharge cover 200 to flow to the inside of the discharge cover 200. For example, the connection pipe 261 may be made of a metal material.

The linear compressor 10 may further include a loop pipe 262 coupled to one or a first side of the discharge cover 200 connected to the connection pipe 261 to transfer the refrigerant flowing through the connection pipe 261 to the discharge pipe 105. The loop pipe 262 may have one or a first side coupled to the connection pipe 261 and the other or a second side coupled to the discharge pipe 105.

The loop pipe 262 may be made of a flexible material and have a relatively long length. Also, the loop pipe 262 may roundly extend from the connection pipe 261 along the inner circumferential surface of the shell 101 and be coupled to the discharge pipe 105. For example, the loop pipe 262 may have a wound shape.

The linear compressor 10 further may include a frame 110. The frame 110 is understood as a component that fixes the cylinder 120. For example, the cylinder 120 may be press-fitted into the frame 110. Each of the cylinder 120 and the frame 110 may be made of aluminum or an aluminum alloy material, for example.

The frame 110 may be disposed or provided to surround the cylinder 120. That is, the cylinder 120 may be disposed or provided to be accommodated into the frame 110. Also, the discharge cover 200 may be coupled to a front surface of the frame 110 using a coupling member.

The motor assembly 140 may include an outer stator 141 fixed to the frame 110 and disposed or provided to surround the cylinder 120, an inner stator 148 disposed or provided to be spaced inward from the outer stator 141, and the permanent magnet 146 disposed or provided in a space between the outer stator 141 and the inner stator 148.

The permanent magnet 146 may be linearly reciprocated by mutual electromagnetic force between the outer stator 141 and the inner stator 148. Also, the permanent magnet 146 may be provided as a single magnet having one polarity or by coupling a plurality of magnets having three polarities to each other.

The magnet frame 138 may be installed or provided on the permanent magnet 146. The magnet frame 138 may have an approximately cylindrical shape and be disposed or provided to be inserted into the space between the outer stator 141 and the inner stator 148.

Referring to the cross-sectional view of FIG. 4, the magnet frame 138 may be coupled to the piston flange part 132 to extend in an outer radial direction and then be bent forward. The permanent magnet 146 may be installed or provided on a front portion of the magnet frame 138. When the permanent magnet 146 reciprocates, the piston 130 may reciprocate together with the permanent magnet 146 in the axial direction.

The outer stator 141 may include coil winding bodies 141*b*, 141*c*, and 141*d* and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141. The terminal part 141*d* may be disposed or provided to be inserted into a terminal insertion part or portion (see reference numeral 119*c* of FIG. 9).

The stator core 141*a* may include a plurality of core blocks in which a plurality of laminations are laminated in a circumferential direction. The plurality of core blocks may be disposed or provided to surround at least a portion of the coil winding bodies 141*b* and 141*c*.

A stator cover 300 may be disposed or provided on one or a first side of the outer stator 141. That is, the outer stator 141 may have one or a first side supported by the frame 110 and the other or a second side supported by the stator cover 300.

The linear compressor 10 may further include a cover coupling member 149*a* for coupling the stator cover 300 to the frame 110. The cover coupling member 149*a* may pass through the stator cover 300 to extend forward to the frame 110 and then be coupled to a first coupling hole (see reference numeral 119*a* of FIG. 9) of the frame 110.

The inner stator 148 may be fixed to a circumference of the frame 110. Also, in the inner stator 148, the plurality of laminations may be laminated in the circumferential direction outside of the frame 110.

The linear compressor 10 may further include a support 400 that supports the piston 130. The support 400 may be coupled to a rear portion of the piston 130, and the muffler 150 may be disposed or provided to pass through the inside of the support 400. The piston flange part 132, the magnet frame 138, and the support 400 may be coupled to each other using a coupling member.

A balance weight 179 may be coupled to the support 400. A weight of the balance weight 179 may be determined based on a drive frequency range of the compressor body.

The linear compressor 10 may further include a rear cover 170 coupled to the stator cover 300 to extend backward and supported by the first support device 500. The rear cover 170 may include three support legs, and the three support legs may be coupled to a rear surface of the stator cover 300. A spacer 181 may be disposed or provided between the three support legs and the rear surface of the stator cover 300. A distance from the stator cover 300 to a rear end of the rear cover 170 may be determined by adjusting a thickness of the spacer 181. Also, the rear cover 170 may be spring-supported by the support 400.

The linear compressor 10 may further include an inflow guide part or guide 156 coupled to the rear cover 170 to guide an inflow of the refrigerant into the suction 150. At least a portion of the inflow guide part 156 may be inserted into the suction muffler 150.

The linear compressor 10 may further include a plurality of resonant springs 176*a* and 176*b* which may be adjusted in natural frequency to allow the piston 130 to perform a resonant motion.

The plurality of resonant springs 176*a* and 176*b* may include a first resonant spring 176*a* supported between the support 400 and the stator cover 300 and a second resonant spring 176*b* supported between the first resonant spring 176*a* and the rear cover 170. The drive part that reciprocates within the linear compressor 10 may be stably moved by the action of the plurality of resonant springs 176*a* and 176*b* to reduce vibration or noise due to the movement of the drive part. The support 400 may include a spring support part or support 440 coupled to the first resonant spring 176*a*.

The linear compressor 10 may include the frame 110 and a plurality of sealing members or seals 127, 128, 129*a*, and 129*b* that increases a coupling force between the peripheral parts or components around the frame 110. The plurality of sealing members 127, 128, 129*a*, and 129*b* include a first sealing member or seal 127 disposed or provided at a portion at which the frame 110 and the discharge cover 200 are coupled to each other. The first sealing member 127 may be disposed or provided on a second installation groove (see reference numeral 116*b* of FIG. 9) of the frame 110.

The plurality of sealing members 128, 128, 129*a*, and 129*b* may further include a second sealing member or seal 128 disposed or provided at a portion at which the frame 110 and the cylinder 120 are coupled to each other. The second sealing member 128 may be disposed or provided on a first installation groove (see reference numeral 116*a* of FIG. 9) of the frame 110.

The plurality of sealing members 127, 128, 129*a*, and 129*b* may further include a third sealing member or seal 129*a* disposed or provided between the cylinder 120 and the frame 110. The third sealing member 129*a* may be disposed or provided on a cylinder groove (see reference numeral 121*e* of FIG. 12) defined in the rear portion of the cylinder 120. The third sealing member 129*a* may prevent the refrigerant within a gas pocket (see reference numeral 110*b* of FIG. 13) disposed or provided between the an inner circumferential surface of the frame 110 and an outer circumferential surface of the cylinder 120 from leaking to the outside to increase a coupling force between the frame 110 and the cylinder 120.

The plurality of sealing members 127, 128, 129*a*, and 129*b* may further include a fourth sealing member or seal 129*b* disposed or provided at a portion at which the frame 110 and the inner stator 148 are coupled to each other. The fourth sealing member 129*b* may be disposed or provided on a third installation groove (see reference numeral 111*a* of FIG. 10) of the frame 110. Each of the first to fourth sealing members 127, 128, 129*a*, and 129*b* may have a ring shape.

The linear compressor 10 may further include the second support device 600 coupled to the discharge cover 200 to support one or a first side of the main body of the compressor 10. The second support device 600 may be disposed or provided adjacent to the second shell cover 103 to elastically support the main body of the compressor 10. The second support device 600 may include a second support spring 610. The second support spring 610 may be coupled to the spring coupling part 101*a*.

The linear compressor 10 may further include the first support device 500 coupled to the rear cover 170 to support the other or a second side of the main body of the compressor 10. The first support device 500 may be coupled to the first shell cover 102 to elastically support the main body of the compressor 10. The first support device 500 may include a first plate spring 510. The first plate spring 510 may be coupled to the cover support part 102*a*.

Hereinafter, a coupled state of the main body will be described.

Figure 5:
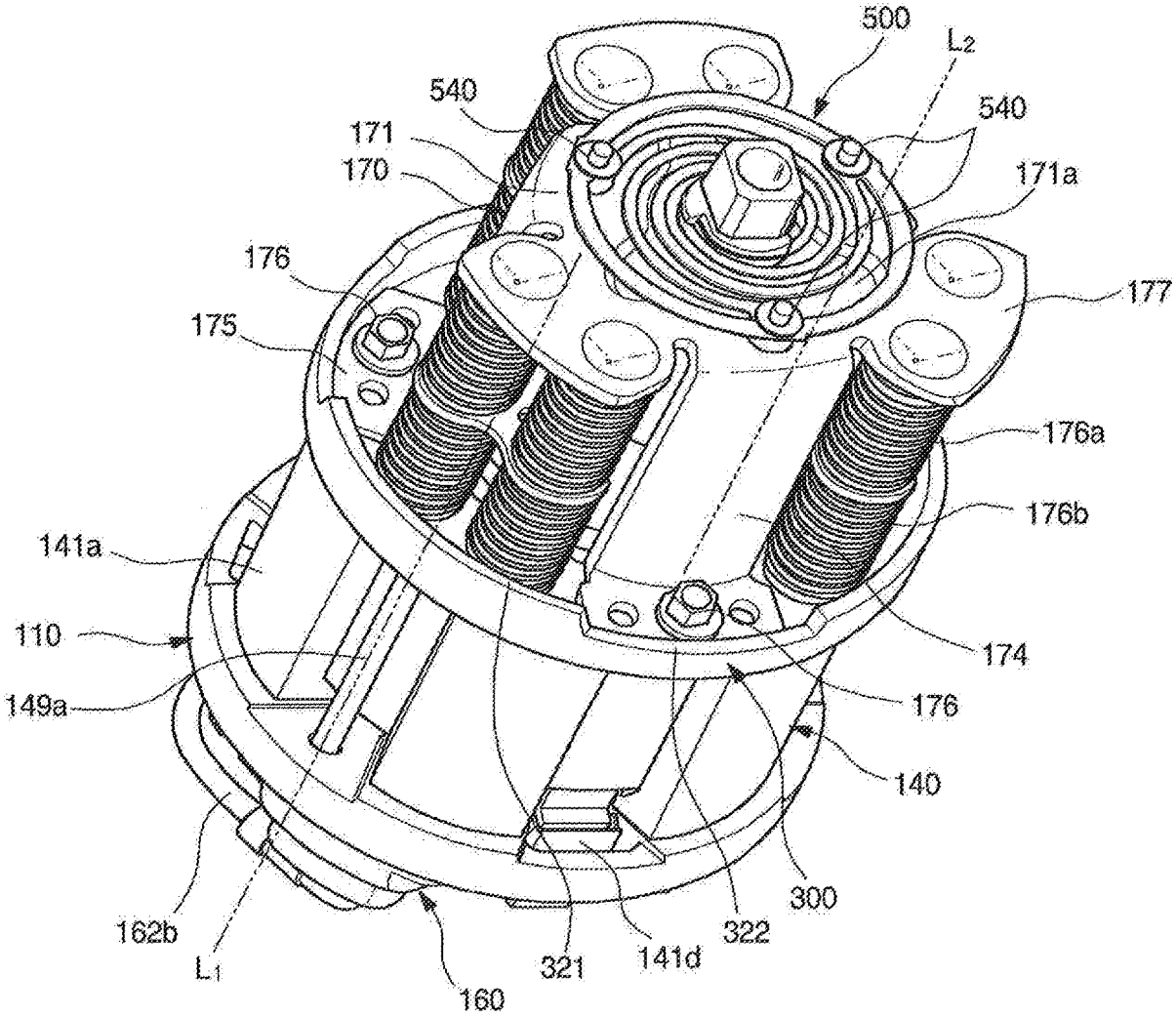
FIG. 5 is a perspective view of a main body when viewed from a rear side.
Figure 6:
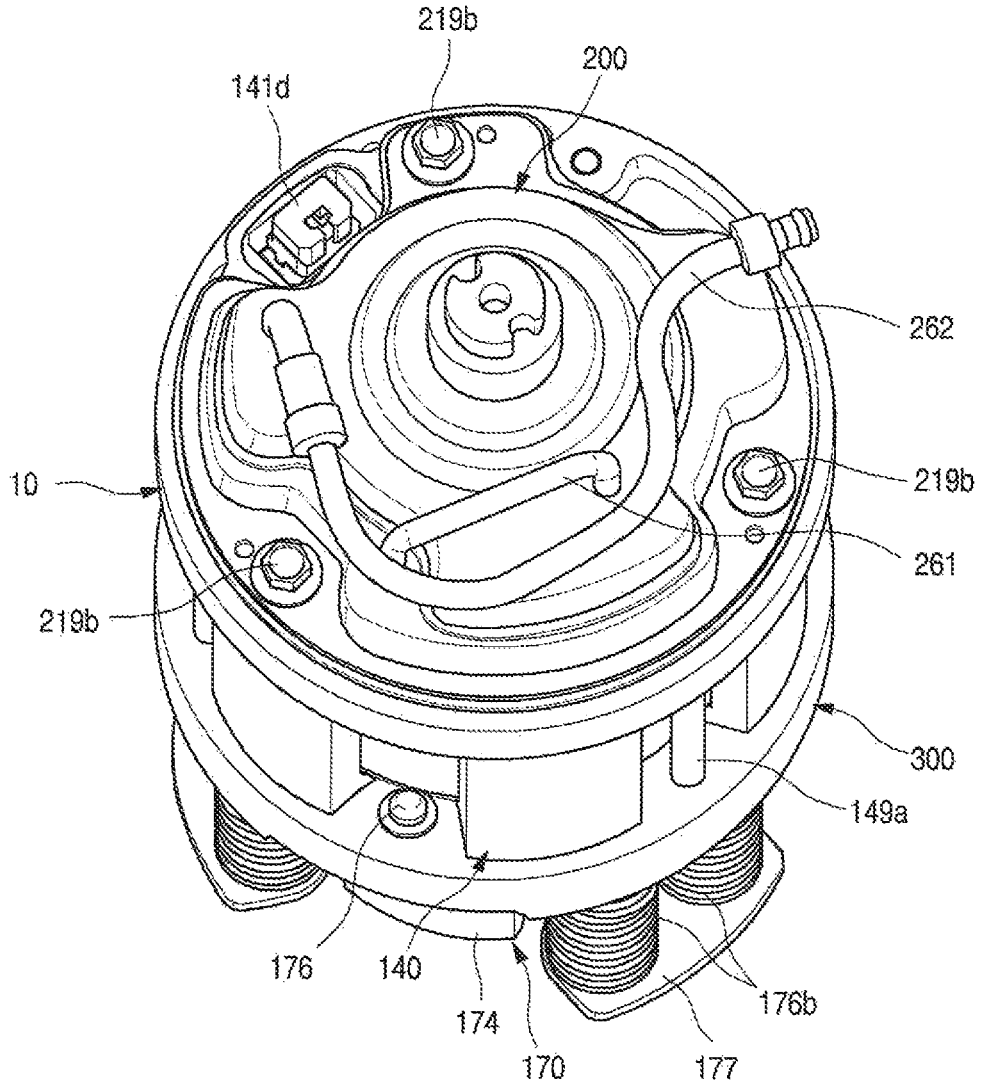
FIG. 6 is a perspective view of the main body when viewed from a front side.

FIG. 5 is a perspective view of the main body when viewed from a rear side. FIG. 6 is a perspective view of the main body when viewed from a front side.

As illustrated in the drawings, the first support device 500 may be fixed to and mounted on the rear cover 170 by a rear cover coupling member 176. The rear cover coupling members 176 may be circularly arranged at an angle of about 120° around the axial direction of the compressor. That is, three rear cover coupling members 176 may be provided, and the three rear cover coupling members 176 may be circularly arranged at a same interval.

The rear cover coupling member 176 may be coupled to a cover body 171 of the rear cover 170 at a position corresponding to an intermediate point between the coupling legs 174. Thus, the rear cover coupling member 176 may provide a stable coupling structure and also uniformly disperse a load transmitted through the rear cover coupling member 176 to the second support device 600 and the rear cover 170.

Three coupling legs 174 that extend from the cover body 171 of the rear cover 170 in a discharge direction may be provided and circularly arranged at an angle of about 120° around a center of the axial direction of the compressor 10. A cover-side seating part or seat 177 that extends outward from the cover body 171 may be disposed or provided between the coupling legs 174 adjacent to each other.

The cover-side seating part 177 may be disposed or provided in a space between the rear cover coupling members 176. The second resonant spring 176*b* seated on the cover-side seating part 177 may be stably supported. As a result, three cover-side seating parts 177 may also be provided and circularly arranged at an angle of about 120° around a center of the axial direction or central longitudinal axis of the compressor 10. Thus, the entire coupling structures may be distributed at a same interval to prevent stress from being concentrated when coupled as well as match a structural balance. In addition, a load transmitted by the second resonant spring 176*b* may be uniformly dispersed.

As described above, the rear cover coupling member 176 and the second resonant spring 176*b* may be successively disposed or provided on a circumference of the cover body 171 in a rotational direction around the center of the axial direction of the compressor 10. Thus, the load applied to the cover body 171 in opposite directions may be uniformly dispersed on an entire surface of the cover body 171 at a uniform position.

The rear cover 170 may be coupled to the stator cover 300 by the rear cover coupling member 176. The rear cover coupling member 176 may be coupled to a leg coupling part 175 disposed or provided on an extension end of the coupling leg 174. Thus, three rear cover coupling members 176 may be provided and circularly arranged at an angle of about 120° around the center of the axial direction of the compressor 10.

The resonant springs 176*a* and 176*b* may be circularly arranged between the plurality of coupling legs 174. Two resonant springs 176*a* and 176*b* may be disposed or provided between two coupling legs 174. Thus, six pairs of resonant springs 176*a* and 176*b* may be provided between the cover body 171 and the stator cover 300 to effectively reduce a side force while maintaining suitable stiffness for a resonance of the piston 130.

The resonant springs 176*a* and 176*b* may be circularly arranged between the rear cover coupling members 176 on one surface of the stator cover 300, to which the rear cover coupling members 176 may be coupled, to maintain a weight and balance in overall shape. Thus, a uniform load may be transmitted to an entire circumference of the stator cover 300 to maintain a balance of the stator cover 300.

The support 400 between the cover body 171 and the stator cover 300 may support the first and second resonant springs 176*a* and 176*b* in both directions. The spring support parts 440 may also be circularly arranged at an angle of about 120° around the axial direction of the compressor. Thus, the load applied to the support 400 may be uniformly dispersed, and thus, the plurality of resonant springs 176*a* and 176*b* may be maintained to be balanced.

Thus, as the plurality of resonant springs 176*a* and 176*b* are circularly arranged along a circumference of the support 400, a side force acting in the radial direction when the compressor 10 is driven may be effectively reduced. Also, a number of resonant springs 176*a* and 176*b* connected to the support 400 may increase to provide a suitable stiffness while reducing a length of each of the resonant springs 176*a* and 176*b*. Further, a pair of resonant springs 176*a* and 176*b* may be circularly arranged at a same angle to stably support the support 400 which may be vibrated at a high speed.

The motor assembly 140 may be disposed or provided between the stator cover 300 and the frame 110, and the outer stators 141 of the motor assembly 140 may be circularly arranged between the stator cover 300 and the frame 110.

The cover coupling member 149*a* may be mounted on the stator cover 300 and the frame 110 to fix the motor assembly 140. Three cover coupling members 149*a* may be provided and circularly arranged at an angle of about 120° around the center of the axial direction of the compressor 10. Both ends of the cover coupling member 149*a* may be respectively fixed to the stator cover 300 and the frame 110 and disposed to pass between the outer stators 141.

The cover coupling member 149*a* may be disposed or provided at an intermediate point between the rear cover coupling members 176. The rear cover coupling member 176 and the cover coupling member 149*a* may be circularly arranged around the center of the axial direction of the compressor 10 and also successively disposed to alternate with each other. Thus, a load applied to the cover coupling member 149*a* may also be uniformly dispersed on an entire surface of the cover coupling member 149*a*.

The discharge cover 200 may be mounted on or at a discharge side of the frame 110. The discharge cover 200 may be fixed to and mounted on the frame 110 by a discharge cover coupling member 219*b*. The discharge cover coupling member 219*b* may pass through the discharge cover 200 from the outside of the discharge cover 200 and then be coupled to the frame 110. Thus, three discharge cover coupling members 219*b* may be circularly arranged at an angle of about 120° around the center of the axial direction of the compressor 10. The discharge cover coupling member 219*b* may be disposed or provided between the cover coupling members 149*a*.

The discharge cover coupling member 219*b* may not be disposed at a center between the cover coupling members 149*a*, but be disposed or provided at a position which is biased to one side between the cover coupling members 149*a* due to a disposition of the terminal part 141*d* and an arranged structure of the connection pipe 261 and the loop pipe 262.

However, each of the discharge cover coupling members 219*b* may be disposed to be spaced a same distance from the corresponding cover coupling member 149*a*, and also, the discharge cover coupling members 219*b* may be disposed to be spaced a same distance from each other. Thus, a load applied to the frame 110 may be uniformly dispersed.

As described above, the adjacent components in the coupling structure between the discharge cover 200, the frame 110, the stator cover 300, the rear cover 170, and the first support device 500, which are successively arranged in the axial direction, may be coupled at positions which are circularly arranged at a predetermined angle, but not disposed in a same extension line, to transmit a load applied to the axial direction in a state in which the load is uniformly dispersed. Thus, the coupling structure between the discharge cover 200, the frame 110, the stator cover 300, the rear cover 170, and the second support device 600, which are separated from each other, may be stably maintained, and the load may be uniformly dispersed to the adjacent components to maintain an overall balance.

More particularly, the cover coupling member 149*a* and the resonant springs 176*a* and 176*b* may be disposed or provided in a same extension line. Thus, the frame 110 and the stator cover 300 may be fixed in a same first extension line L1.

Also, a first spring coupling member 540 and the rear cover coupling member 176 may be disposed or provided in a same extension line. Thus, the stator cover 300, the rear cover 170, and the first support device 500 may be fixed in a same second extension line L2.

The first extension line L1 and the second extension line L2 may rotate at an angle of about 60° in the rotational direction. Thus, the coupling structures may be provided to be circularly arranged at an angle of about 60° over an angle of about 360° to prevent the load from being concentrated to any one side within the compressor 10, thereby maintaining the overall balance.

Also, as the adjacent components do not overlap or interfere with each other due to the coupling structure, it may be unnecessary to provide a separate structure for avoiding interference therebetween. Thus, each of the components may be compact and also easier in assembling work.

Thus, if maintenance in overall balance of the main body and interference between the coupling structures do not occur, the circularly arranged angles of the components may be adjustable in a state in which each of the components is coupled or supported at the three points.

Hereinafter, the main body will be described.

Figure 7:
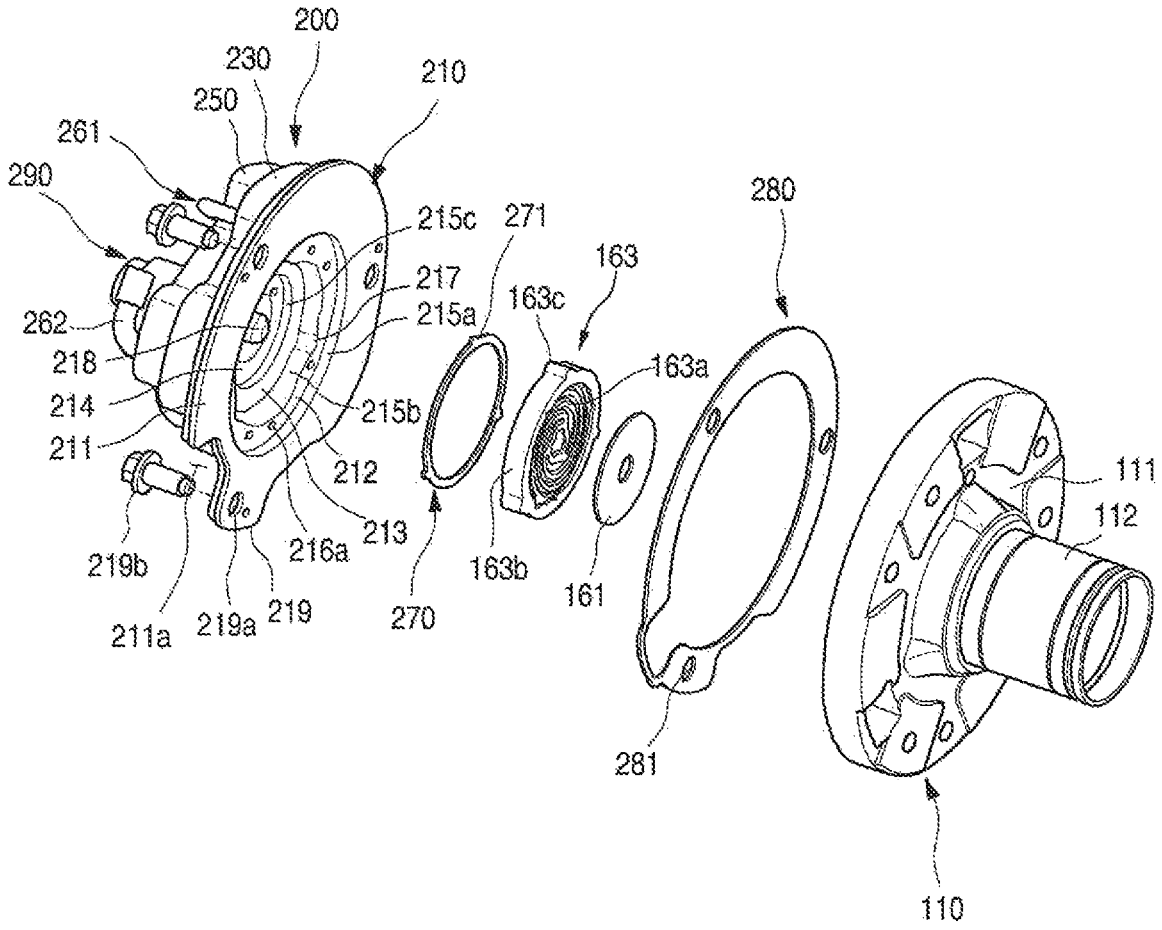
FIG. 7 is an exploded perspective view illustrating a coupling structure of a discharge cover, a discharge valve, a gasket, and a frame according to an embodiment.
Figure 8:
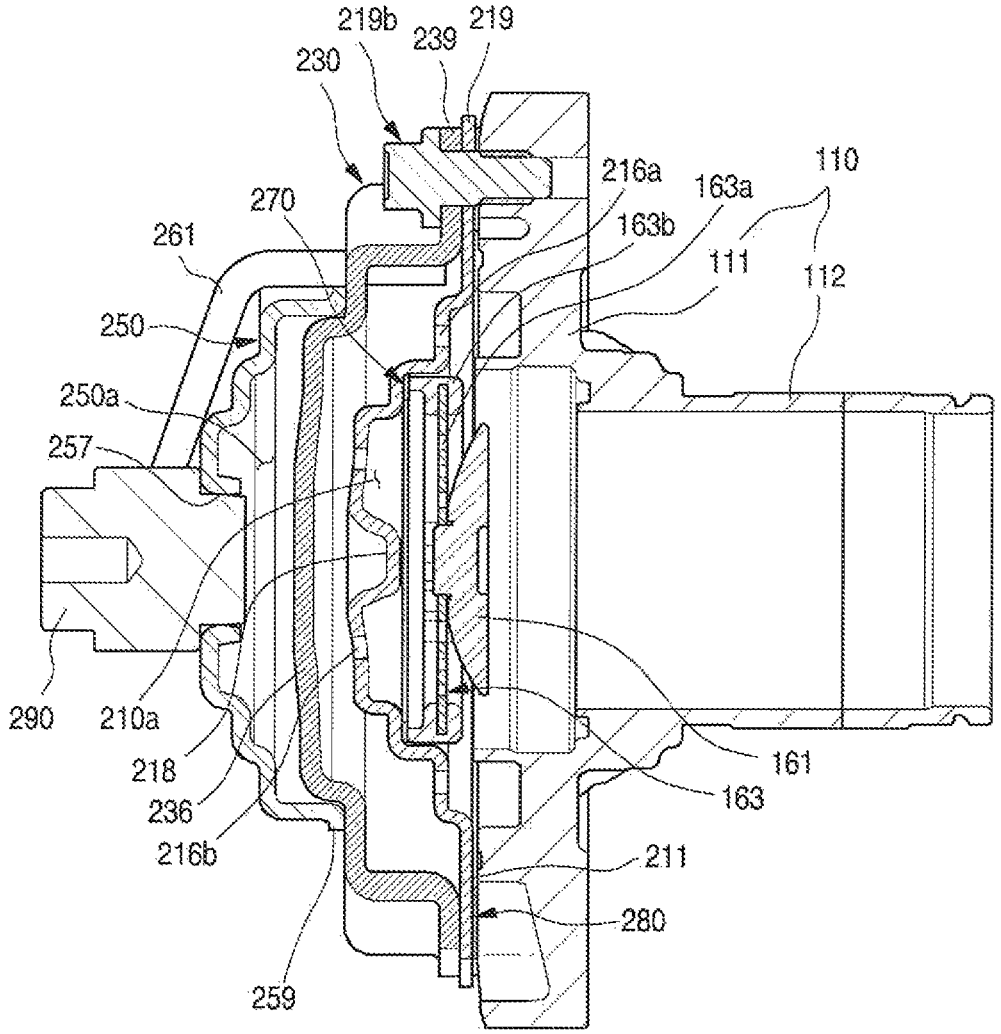
FIG. 8 is a cross-sectional view illustrating a state in which the frame and the discharge cover are coupled to each other according to an embodiment.

FIG. 7 is an exploded perspective view illustrating a coupling structure of the discharge cover, the discharge valve, the gasket, and the frame according to an embodiment. FIG. 8 is a cross-sectional view illustrating a state in which the frame and the discharge cover are coupled to each other according to an embodiment.

As illustrated in the drawings, the linear compressor 10 according to an embodiment may include discharge valve assembly 161 and 163 and the discharge cover 200 coupled to the discharge valve assembly 161 and 163 to define a discharge space for the refrigerant discharged from the compression space P of the cylinder 120. For example, the discharge valve assembly 161 and 163 may be press-fitted and coupled to the discharge cover 200.

A first gasket 270 may be disposed or provided between the discharge valve assembly 161 and 163 and the discharge cover 200, and a second gasket 280 may be disposed or provided between the discharge cover 200 and the frame 110 to reduce noise and vibration, which occurs in the discharge cover 200.

The discharge valve assembly 161 and 163 may include the discharge valve 161 installed or provided on or at a front end of the cylinder 120 to selectively open the compression space P and the spring assembly 163 coupled to a front side of the discharge valve 161. When the discharge valve 161 is closely attached to the front end of the cylinder 161, the compression space P may be closed. When the discharge valve 161 moves forward and then is spaced apart from the cylinder 161, the refrigerant compressed in the compression space P may be discharged.

The spring assembly 163 may include the valve spring 163*a* coupled to the discharge valve 161. For example, the valve spring 163*a* may include a plate spring having a plurality of cutoff grooves. A coupling hole to which the discharge valve 161 may be coupled may be defined in an approximately central portion of the valve spring 163*a*.

The spring assembly 163 may include the spring support part 163*b* coupled to the valve spring 163*a*. The spring support part 163*b* may be understood as a component coupled to the discharge cover 200 to support the valve spring 163*a* to the discharge cover 200. For example, the spring support part 163*b* may be press-fitted and coupled to the discharge cover 200. Also, the spring support part 163*b* may be integrally injection-molded to the valve spring 163*a* through an insertion injection molding process, for example.

Due to the injection molding of the spring support part 163*b*, the spring assembly 163 may stably support the discharge valve 161 inside of the discharge cover 200 under an environment of a high temperature of about 150℃. Also, a structure in which the spring assembly 163 is press-fitted and fixed inside of the discharge cover 200 may be provided to prevent the spring assembly 163 from moving.

The discharge cover 200 may further include the first gasket 270 installed or provided on the front side of the spring assembly 163. The first gasket 270 may allow the spring assembly 163 to be closely attached to the discharge cover 200 and prevent refrigerant from leaking through a space between the spring assembly 163 and the discharge cover 200.

The spring support part 163*b* may include a first protrusion 163*c* that prevents the discharge valve 161 and the spring assembly 163 from rotating. A plurality of first protrusion 163*c* may be provided on an outer circumferential surface of the spring support part 163*b*.

For example, three first protrusions 163*c* may be disposed or provided at a same interval along a circumference of the spring support part 163*b*. That is, the first protrusions 163*c* may be circularly arranged at an angle of about 120° around the center of the spring assembly 163. Thus, the spring assembly 163 may be maintained in balance of an overall weight and structure thereof to prevent local tilting and vibration from occurring.

A plurality of second protrusions 271 that protrudes outward may be disposed or provided on the first gasket 270. Three second protrusions 271 may be disposed or provided at a same interval along a circumference of the first gasket 270. The second protrusion 271 may be disposed or provided at a same position as the first protrusion 163*c*. Thus, the first gasket 270 may also be maintained in balance of the overall weight and structure to prevent the local tilting and vibration from occurring.

The discharge cover 200 may further include a recess part or recess 217 coupled to an outer circumferential surface of the spring assembly 163 or an outer circumferential surface of the gasket 270. Each of the first protrusion 163*c* and the second protrusion 271 may be accommodated in the recess part 217. The recess part 217 may be defined in the first cover 210 and a plurality of the recess part 217 may be to correspond to the plurality of protrusions 163*c* and 271.

A process of coupling the spring assembly 163 to the discharge cover 200 will be described hereinafter. The first gasket 270 may be seated on a third part or portion 213 of the discharge cover 200. The second protrusion 217 of the first gasket 270 may be inserted into the recess part 217.

The spring assembly 163 may be press-fitted into the discharge cover 200. When the first gasket 270 is pressed, a front surface of the spring assembly 163 may be coupled to the third part 213, and the first protrusion 163*c* may be disposed or provided in the recess part 217.

As the spring assembly 163 is press-fitted into the discharge cover 200, the spring assembly 163 and the discharge valve 161 may be stably supported to or by the discharge cover 200. Also, as the first and second protrusions 163*c* and 271 are coupled to the recess parts 217, rotation of the spring assembly 163 and the discharge valve 161 may be prevented. As the recess parts 217 and the protrusions 163*c* and 271 are coupled to each other, the spring assembly 163 and the first gasket 270 may not rotate, but be maintained to be fixed and mounted inside of the discharge cover 200. Thus, an occurrence of vibration and clearance due to rotation may be prevented.

The discharge cover 200 may include a plurality of covers 210, 230, and 250 that defines a plurality of discharge spaces or a plurality of discharge chambers. The plurality of covers 210, 230, and 250 may be coupled to the frame 110 and stacked forward with respect to the frame 110.

The discharge cover 200 may include a first cover 210 that defines a first space part or space 210*a* in which the discharge valve 161 and the spring assembly 163 may be disposed. The first cover 210 may be stepped forward.

The first cover 210 may include a first part or portion 211 that defines a rear surface of the first cover 210 and provides a coupling surface to which the frame 110 may be coupled and a stepped part or step 215*a* that extends forward from the first part 211. The first cover 210 may have a shape which is recessed forward from the first part 211 by the first stepped part 215*a*.

The first cover 210 may include a second part or portion 212 that extends a first predetermined length inward from the first stepped part 215*a* in the radial direction. The first cover 210 may further include a second stepped part or step 215*b* that extends forward from the second part 212. The first cover 210 may have a shape which is recessed forward from the second part 212 by the second stepped part 215*b*. The recess part 217 may be defined in an outer circumferential surface of the second stepped part 215*b*.

The first cover 210 may include a third part or portion 213 that extends by a second predetermined length inward from the second stepped part 215*b* in the radial direction. The third part 213 may have a seating surface on which the spring assembly 163 is seated.

The first gasket 270 may be disposed on the third part 213, and the spring assembly 163 may be coupled to a rear side of the third part 213. Thus, the third part 213 may be coupled to a front surface of the spring assembly 163. Also, the outer circumferential surface of the spring assembly 163 may be press-fitted into the second stepped part 215*b*.

The first cover 210 may further include a third stepped part or step 215*c* that extends forward from the third part 213. The first cover 210 may have a shape which is recessed forward from the third part 213 by the third stepped part 215*c*. The first cover 210 may also include a fourth part or portion 214 that extends inward from the third stepped part 215 in the radial direction.

A stopper 218 that protrudes backward may be disposed on an approximately central portion of the fourth part 214. When the linear compressor 10 abnormally operates, particularly, when an opened degree of the discharge valve 161 is greater than a preset or predetermined level, the stopper 218 may protect the discharge valve 161 or the valve spring 163*a*.

The abnormal operation may be understood as a momentary abnormal behavior of the discharge valve 161 due to a change in flow rate or pressure within the compressor. The stopper 218 may interfere with the discharge valve 161 or the valve spring 163*a* to prevent the discharge valve 161 or the valve spring 163*a* from further moving forward.

Discharge holes 216*a* and 216*b*, through which the refrigerant flowing through the first space part 200*a* may be transferred to the second cover 230, may be defined in the first cover 200. The discharge holes 216*a* and 216*b* may include a first discharge hole 216*a* defined in the second part 212. A plurality of the first discharge hole 216*a* may be provided, and the plurality of first discharge holes 216*a* may be disposed or provided to be spaced apart from each other along a circumference of the second part 212.

As the discharge valve 161 is opened, the refrigerant, which does not pass through the spring assembly 163, of the refrigerant flowing into the first space part 210*a*, that is, the refrigerant existing in an upstream side of the spring assembly 163 may be discharged to the outside of the first cover 210 through the first discharge hole 216*a*. Also, the refrigerant discharged through the first discharge hole 216*a* may be introduced into the second space part 230*a* of the second cover 230.

The discharge holes 216*a* and 216*b* may include a second discharge hole 216*b* defined in the fourth part 214. A plurality of the second discharge hole 216*b* may be provided, and the plurality of second discharge holes 216*b* may be disposed or provided to be spaced apart from each other along a circumference of the fourth part 214.

When the discharge valve 161 is opened, the refrigerant, which passes through the spring assembly 163, of the refrigerant flowing into the first space part 210*a*, that is, the refrigerant existing in a downstream side of the spring assembly 163 may be discharged to the outside of the first cover 210 through the second discharge hole 216*b*. Also, the refrigerant discharged through the second discharge hole 216*b* may be introduced into the second space part 230*a* of the second cover 230.

A number of second discharge holes 216*b* may be less than a number of first discharge holes 216*a*. Thus, in the refrigerant passing through discharge valve 161, a relatively large amount of refrigerant may pass through the first discharge holes 216*a*, and a relatively small amount of refrigerant may pass through the second discharge holes 216*b*.

A volume ratio of the first to third space parts 210*a*, 230*a*, and 250*a* may be determined to a preset or predetermined ratio. The second space part 230*a* may have a volume greater than a volume of the first space part 210*a*, and the third space part 250*a* may have a volume less than the volume of the second space part 230*a*. Thus, the refrigerant may flow from the first space part 210*a* to the second space part 230*a* having the relatively large volume to reduce a pulsation and noise. Also, the refrigerant may flow from the second space part 230*a* to the third space part 250*a* having the relatively small volume to secure a flow rate of the refrigerant.

The discharge cover 200 may further include the connection pipe 260 through which the refrigerant within the second space part 230*a* may be transferred to the third space part 250*a* of the third cover 250. The connection pipe 260 may be coupled to the second cover 230 to extend to the outside of the second cover 230 and then be bent at least one time and coupled to the third cover 250.

As the connection pipe 260 extending to the outside of the second cover 230 and coupled to the outer surface of the third cover 250 is provided, the discharge passage for the refrigerant may be elongated, and thus, the pulsation of the refrigerant may be reduced. The refrigerant flowing through the connection pipe 260 may flow through the loop pipe 262 and then be discharged to the outside of the linear compressor 10 through the discharge pipe 105 connected to the loop pipe 262.

A discharge cover coupling hole 219*a*, through which a coupling member 219*b* that couples the discharge cover 200 to the frame 110 may pass, may be defined in the discharge cover 200. Three discharge cover coupling holes 219*a* may be defined at a predetermined interval along the outer circumference of the discharge cover 200. That is, the three coupling members 219*b* may be circularly arranged at an angle of about 120° around the center of the discharge cover 200. Thus, the discharge cover 200 may be stably coupled to the frame 110.

A cover flange 219 into which one side of the discharge cover 200 protrudes may be disposed or provided on or at one side of the discharge cover 200, and one of the discharge cover coupling holes 219*a* may be defined in the cover flange 219. The cover flange 219 may extend by a predetermined length so that one of the three discharge cover coupling holes 219*a* defined at the same interval is defined in the discharge cover 200 having the asymmetric shape.

A cover recess part or recess 211*a* that is recessed inward may be defined in one side of the cover flange 219. The cover recess part 211*a* may be defined in a position corresponding to a terminal insertion part 119*c*, which will be described hereinafter, and be recessed to have a shape corresponding to a shape of at least a portion of an outer circumference of the terminal insertion part 119*c*. Thus, as the terminal insertion part 119*c* is exposed through the cover recess part 211*a* in a state in which the discharge cover 200 is coupled to the front surface of the frame 110, a terminal connected to an electric wire may pass through the cover recess part 211*a* and the terminal insertion part 119*c*.

The second gasket 280 may be disposed or provided between the discharge cover 200 and the frame 110. The second gasket 280 may come into contact with or contact each of the rear surface of the discharge cover 200 and the front surface of the frame 110 to prevent vibration of the discharge cover 200 from being transmitted to the frame 110. That is, as the second gasket 280 may be disposed or provided on the vibration transmission path from the discharge cover 200, in which vibration necessarily occurs, to the frame 110, transmission of the vibration may be prevented, and thus, the occurrence of noise due to the transmission of the vibration may be prevented.

The frame 110 may include a frame body 111 extending in the axial direction and a frame flange 112 that extends outward from the frame body 111 in the radial direction. The frame body 111 has a space which has a cylindrical shape with a central axis in the axial direction and in which the cylinder is accommodated.

Figure 9:
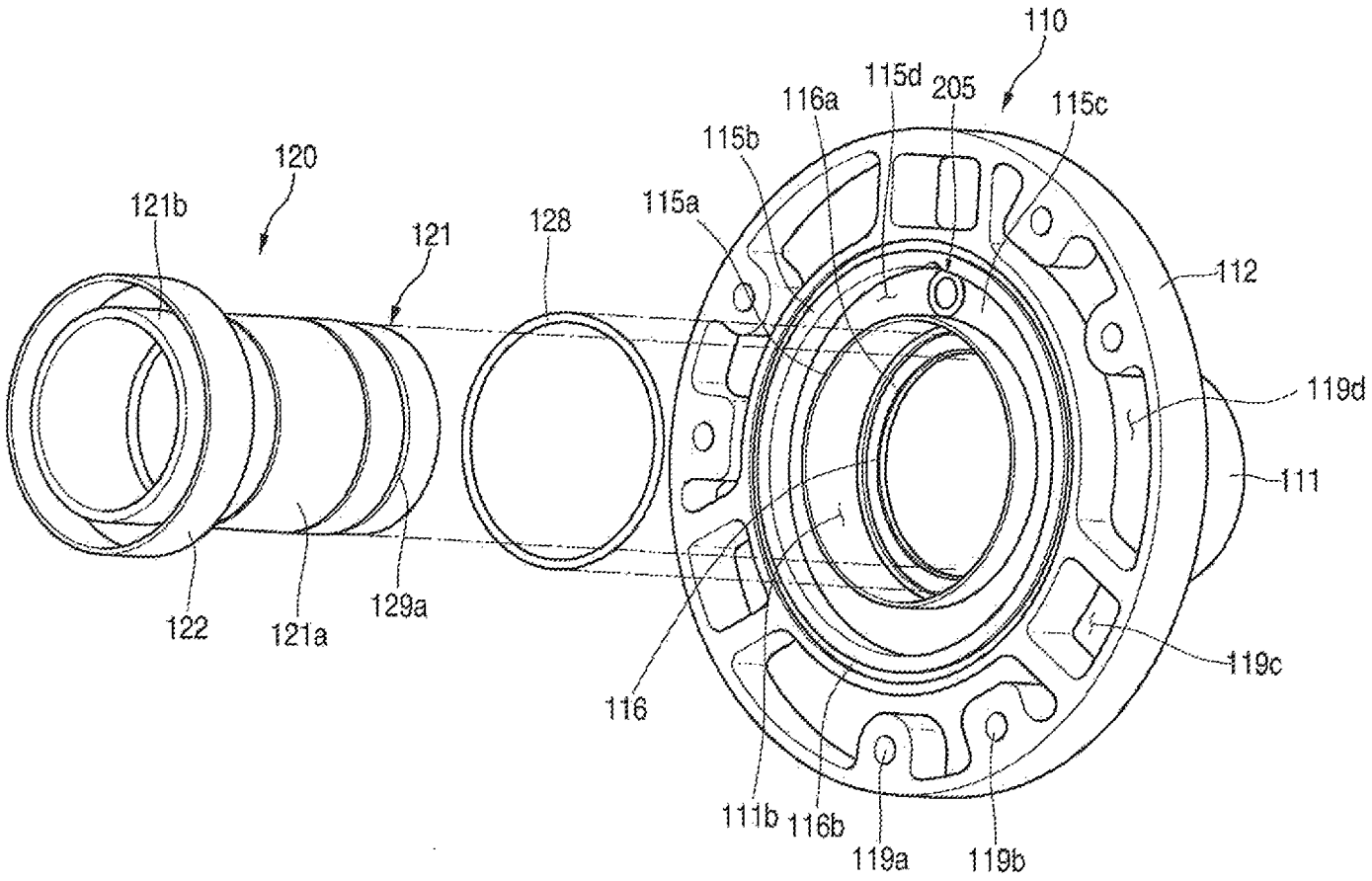
FIG. 9 is an exploded perspective view illustrating the frame and a cylinder according to an embodiment.
Figure 10:
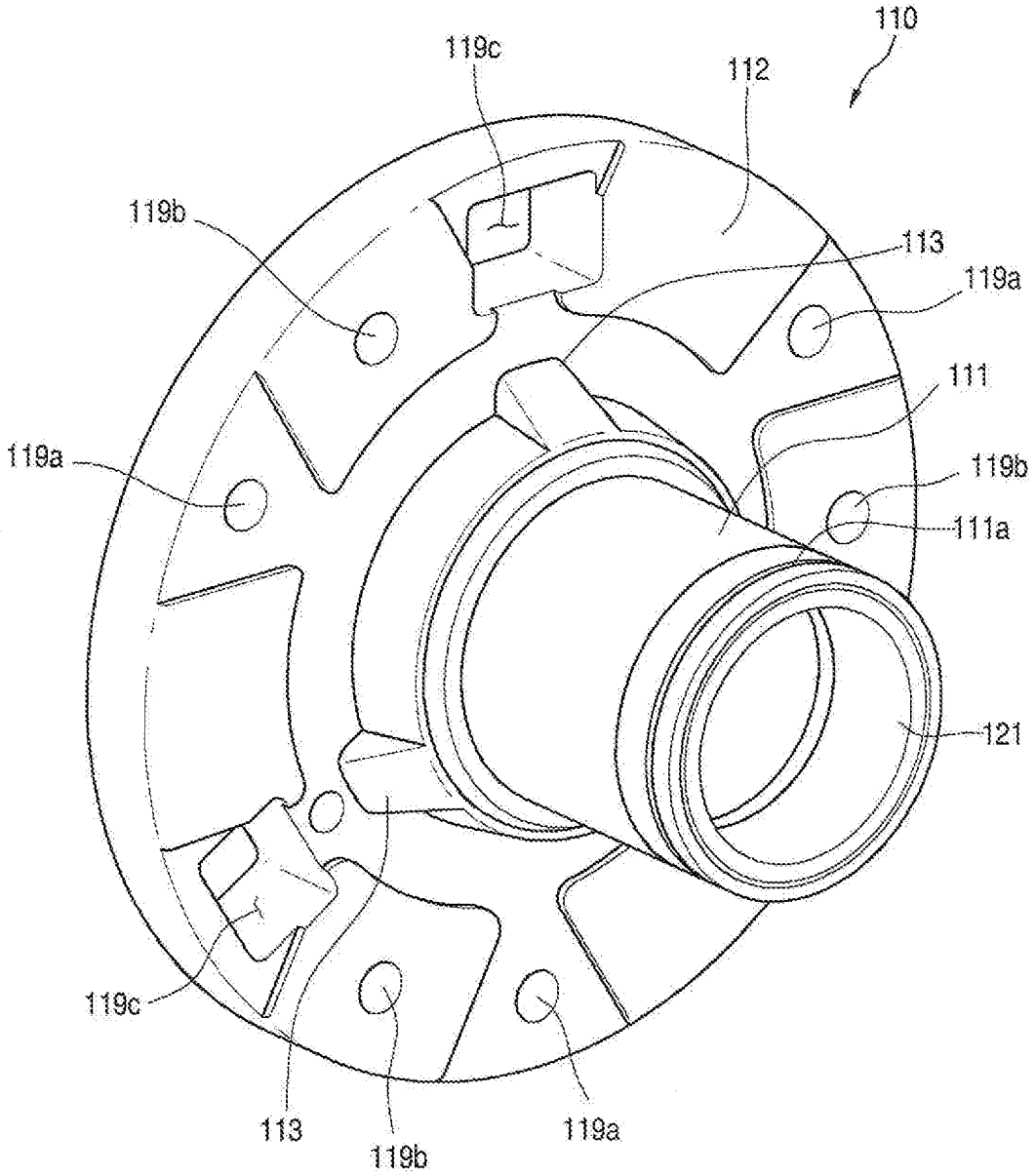
FIG. 10 is a perspective view illustrating a state in which the frame and the cylinder are coupled to each other according to an embodiment.
Figure 11:
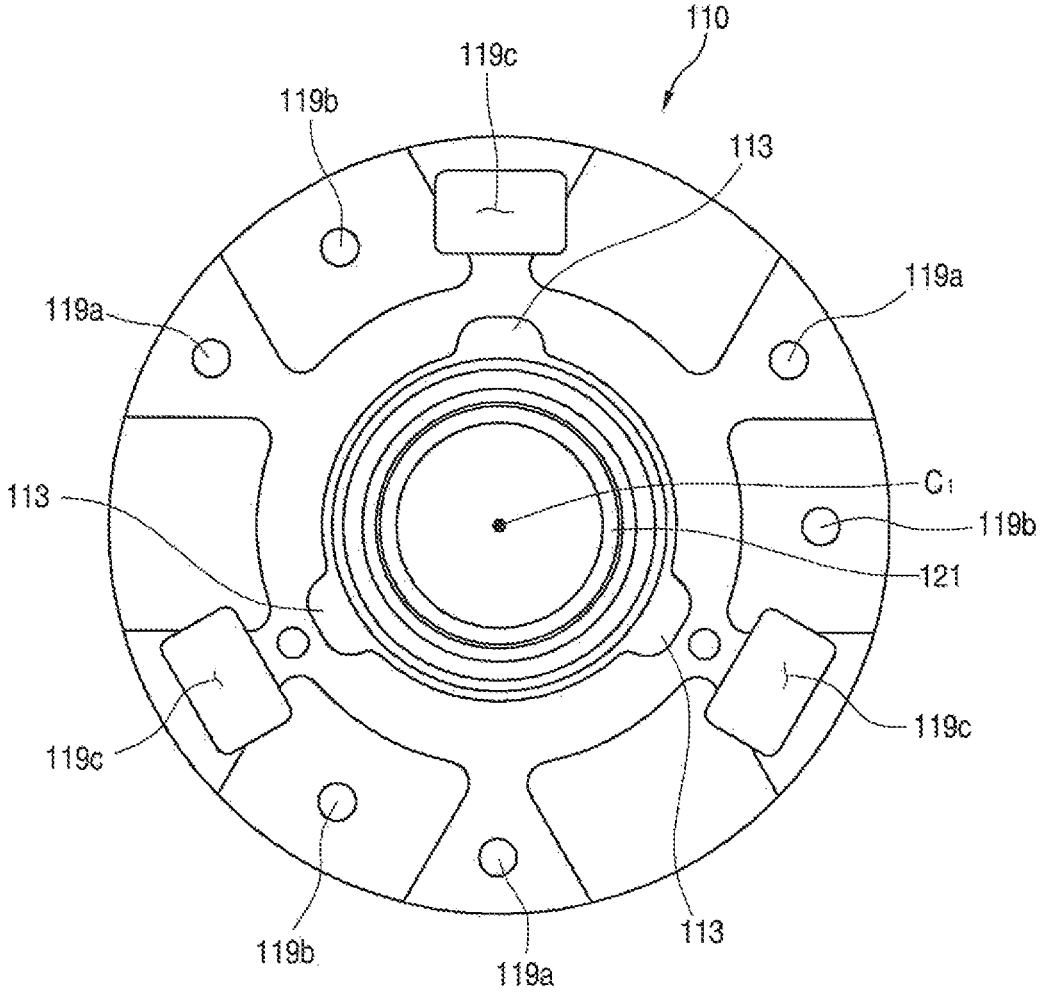
FIG. 11 is a plan view illustrating a state in which the frame and the cylinder are coupled to each other according to an embodiment.
Figure 12:
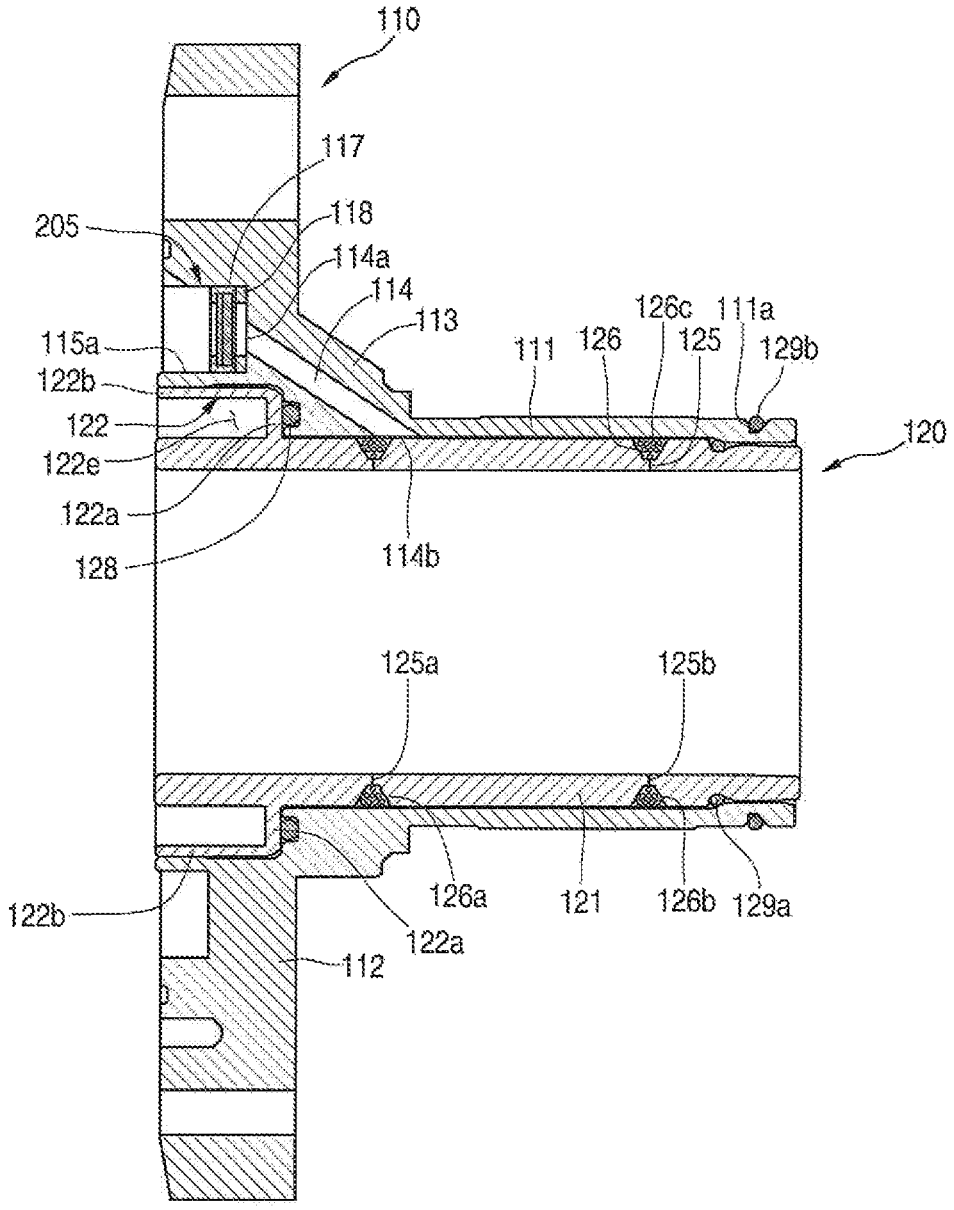
FIG. 12 is a cross-sectional view of a state in which the frame and the cylinder are coupled to each other according to an embodiment.

FIG. 9 is an exploded perspective view illustrating the frame and the cylinder according to an embodiment. FIG. 10 is a perspective view illustrating a state in which the frame and the cylinder are coupled to each other according to an embodiment. FIG. 11 is a plan view illustrating a state in which the frame and the cylinder are coupled to each other according to an embodiment. FIG. 12 is a cross-sectional view of a state in which the frame and the cylinder are coupled to each other according to an embodiment.

As illustrated in the drawings, the cylinder 120 according to an embodiment may be coupled to the frame 110. For example, the cylinder 120 may be inserted into the frame 110.

The frame 110 may include a frame body 111 that extends in the axial direction and frame flange 112 that extends outward from the frame body 111 in the radial direction. The frame body 111 may include a main body accommodation space having a cylindrical shape with a central axis in the axial direction and accommodating the cylinder body 121 therein. A third installation groove 111*a* into which a fourth sealing member or seal 129*b* disposed between the frame body 111 and the inner stator 148 may be inserted may be defined in a rear portion of the frame body 111.

The frame flange 112 may include a first wall 115*a* having a ring shape and coupled to the cylinder flange 122, a second wall 115*b* having a ring shape and disposed to surround the first wall 115*a*, and a third wall 115*c* that connects a rear end of the first wall 115*a* to a rear end of the second wall 115*b*. Each of the first wall 115*a* and the second wall 115*b* may extend in the axial direction, and the third wall 115*c* may extend in the radial direction.

Thus, a frame space part or space 115*d* may be defined by the first to third walls 115*a*, 115*b*, and 115*c*. The frame space part 115*d* may be recessed backward from a front end of the frame flange 112 to form a portion of the discharge passage through which the refrigerant discharged through the discharge valve 161 may flow.

A second installation groove 116*b* defined in a front end of the second wall 115*b* and in which the first sealing member 127 may be installed may be defined in the frame flange 112. A flange accommodation part 111*b*, into which at least a portion of the cylinder 120, for example, the cylinder flange 122 may be inserted, may be defined in an inner space of the first wall 115*a*. For example, the flange accommodation part 111*b* may have an inner diameter equal to or less than an outer diameter of the cylinder flange 122.

When the cylinder 120 is press-fitted into the frame 110, the cylinder flange 122 may interfere with the first wall 115*a*. In this process, the cylinder flange 122 may be deformed.

The frame flange 112 may further include a sealing member seating part or seat 116 extending inward from a rear end of the first wall 115*a* in the radial direction. A first installation groove 116*a*, into which the second sealing member 128 may be inserted may be defined in the sealing member seating part 116. The first installation groove 116*a* may be recessed backward from the sealing member seating part 116.

The frame flange 112 may include coupling holes 119*a* and 119*b* to couple the frame 110, the discharge cover coupling member 219*b*, and the cover coupling member 149*a* to each other. A plurality of the coupling holes 119*a* and 119*b* may be provided along an outer circumference of the second wall 115*b*.

The coupling holes 119*a* and 119*b* may include a first coupling hole 119*a* to which the cover coupling member 149*a* may be coupled. Three first coupling holes 119*a* may be defined in positions corresponding to the three cover coupling members 149*a* so that the three first coupling holes 119*a* may be respectively coupled to the three cover coupling members 149*a*. Also, the first coupling holes 119*a* may be circularly arranged at the same angle, that is, an angle of about 120° around the center of the axial direction of the compressor 10. That is, the first coupling holes 119*a* may be arranged at the same interval along the circumference of the frame flange 112.

The coupling holes 119*a* and 119*b* may further include a second coupling hole 119*b* to which a predetermined coupling member to couple the discharge cover 200 to the frame 110 may be coupled. Three second coupling holes 119*b* may be defined in positions corresponding to the three discharge cover coupling members 219*b* so that the three second coupling holes 119*b* are respectively coupled to the three discharge cover coupling members 219*b*. Also, the second coupling holes 119*b* may be circularly arranged at the same angle, that is, an angle of about 120° around the center of the axial direction of the compressor 10. That is, the second coupling holes 119*b* may be arranged at the same interval along the circumference of the frame flange 112.

A portion in which the first and second coupling holes 119*a* and 119*b* are defined may be stepped on the front surface of the frame flange 112. That is, a protrusion protruding to be stepped in a shape corresponding to a cross-sectional shape of the stator core 141*a* may be disposed or provided at a portion in which the second coupling hole 119*b* is defined. The portion in which the second coupling hole 119*b* is defined may protrude further than the portion in which the first coupling hole 119*a* is defined. Thus, when the compressor 10 is driven, air may flow through the portion, in which the first coupling hole 119*a* is defined, to prevent a loss due to air resistance from occurring.

The frame flange 112 may include the terminal insertion part 119*c* which provides a lead-out path of a terminal part or portion 141*d* of the motor assembly 140. The terminal part 141*d* may extend forward from the coil 141*c* and be inserted into the terminal insertion part 119*c*. Thus, the terminal part 141*d* may extend from the motor assembly 140 and the frame 110 to pass through the terminal insertion part 119*c* and then be connected to a cable which is directed to the terminal 108.

Three terminal insertion parts or portions 119*c* may be provided, and the three terminal insertion parts 119*c* may be disposed or provided along an outer circumference of the second wall 115*b*. The terminal part 141*d* may be inserted into one terminal insertion part 119*c* of the three terminal insertion parts 119*c*. The rest of the terminal insertion parts 119*c* may be provided to prevent the frame 110 from being deformed and maintain a balance of the frame 110. The terminal insertion parts 119*c* may be circularly arranged at the same angle, that is, an angle of about 120° around the center of the axial direction of the compressor 10 in consideration of an overall balance in the frame flange 112 and a relationship between the first and second coupling holes 119*a* and 119*b*.

A frame recess part or recess 119*d* in which the remaining portion except for the first coupling hole 119*a*, the second coupling hole 119*b*, and the terminal insertion part 119*c* is recessed may be defined along a circumference of a left or first surface of the frame flange 112. Three frame recess parts 119*d* may be provided in a same shape as the arranged shape of the first and second coupling holes 119*a* and 119*b* and the terminal insertion part 119*c*. Similarly, the three frame recess parts 119*d* may be circularly arranged at the same angle, that is, an angle of about 120° around the center of the axial direction of the compressor 10.

Thus, the three holes, that is, the first and second coupling holes 119*a* and 119*b*, the terminal insertion part 119*c*, and the frame recess part 119*b* may be provided along the circumference of the frame flange 112 and also disposed or provided at a predetermined interval in a circumferential direction around the central portion in the axial direction of the frame 110. Thus, the frame 110 may be supported at three points to the peripheral parts, that is, the stator cover 300 and the discharge cover 200 to maintain a weight balance and realize a stable coupling.

When the frame 110 is coupled to the stator cover 300 or the discharge cover 200 or press-fitted and coupled to the cylinder 120, a large stress may be applied to the frame 110. Also, the load generated while the compressor is driven may be transmitted through the coupling structure.

In this embodiment, as the first and second coupling holes 119*a* and 119*b*, the terminal insertion part 119*c*, and the frame recess part 119*d* may be disposed or provided at the three points of the frame flange 112, that is, may be uniformly disposed or provided in the circumferential direction around the central portion in the axial direction of the frame 110, a concentration of the stress may be prevented, and a load generated during operation may be uniformly dispersed.

The frame recess part 119*d* may prevent a fine deformation of the frame 110, which occurs when the coupling member is coupled to the first and second coupling holes 119*a* and 119*b*, from having an influence on the flange accommodation part 111*b* in which the cylinder 120 is inserted, thereby preventing the cylinder 120 from being deformed and preventing mounting defects of the cylinder 120 from occurring. That is, when the coupling member is coupled to the first and second coupling holes 119*a* and 119*b*, deformation may occur in only an area adjacent to the first and second coupling holes 119*a* and 119*b* in an inner area of the frame recess part 119*d*.

The frame 110 may further include a frame inclination part or portion 113 that extends at an incline from the frame flange 112 to the frame body 111. An outer surface of the frame inclination part 113 may be inclined at an angle of about 0° to about 90° with respect to the outer circumferential surface of the frame body 111, that is, in the axial direction.

A gas hole 114 that guides the refrigerant discharged from the discharge valve 161 to a gas inflow part or inflow 126*a* of the cylinder 120 may be defined in the frame inclination part 113. The gas hole 114 may pass through the inside of the frame inclination part 113.

The gas hole 114 may extend from the frame flange 112 up to the frame body 111 via the frame inclination part 113. As the gas hole 114 is defined by passing through a portion of the frame having a relatively thick thickness up to the frame flange 112, the frame inclination part 113, and the frame body 111, the frame 110 may be prevented from being reduced in strength due to the formation of the gas hole 114. The gas hole 114 may extend at an incline corresponding to an extension direction of the frame inclination part 113.

A discharge filter 205 that filters foreign substances from the refrigerant introduced into the gas hole 114 may be disposed on an inlet port 114*a* of the gas hole 114. The discharge filter 205 may be installed or provided on the third wall 115*c*.

The discharge filter 205 may be installed on or in a filter groove 117 defined in the frame flange 112. The filter groove 117 may be recessed backward from the third wall 115*c* and have a shape corresponding to a shape of the discharge filter 205.

That is, the inlet port 114*a* of the gas hole 114 may be connected to the filter groove 117, and the gas hole 114 may pass through the frame flange 112 and the frame inclination part 113 from the filter groove 117 to extend to the inner circumferential surface of the frame body 111. Thus, an outlet port 114*b* of the gas hole 114 may communicate with the inner circumferential surface of the frame body 111.

The linear compressor 10 may further include a filter sealing member or seal 118 installed or provided at a rear side, that is, an outlet side of the discharge filter 205. Each of the filter sealing members 118 may have an approximately ring shape. The filter sealing member 118 may be placed on the filter groove 117. When the discharge filter 200 presses the filter groove 117, the filter sealing member 118 may be press-fitted into the filter groove 117.

Three frame inclination parts 113 may be provided along the circumference of the frame body 111. The gas hole 114 may be defined in only one frame inclination part 113 of the three frame inclination parts 113. The remaining frame inclination parts 113 may be provided to prevent the frame 110 from being deformed and maintain the balance of the frame 110.

The frame inclination parts 113 may also be circularly arranged at an angle of about 120° around the center in the axial direction of the compressor 10. Also, the terminal insertion part 119*c* and the frame inclination part 113 may be disposed at the same angle, that is, in the same extension line. Thus, an overall structure of the frame flange 112 may be further improved in stability, and the frame 110 may be generally maintained in a stable state during operation of the compressor 10.

Also, when the frame 110 is coupled to the stator cover 300 or the discharge cover 200 or press-fitted and coupled to the cylinder 120, a large stress may be applied to the frame 110. If only one frame inclination part 113 is provided in the frame 110, the stress may be concentrated to a specific point, causing deformation of the frame 110. Thus, in this embodiment, the three frame inclination parts 113 may be provided outside of the frame body 111, that is, uniformly disposed in the circumferential direction around the central portion in the axial direction of the frame 110 to prevent the stress from being concentrated.

That is, the cylinder 120 may be coupled to the inside of the frame 110. For example, the cylinder 120 may be coupled to the frame 110 through a press-fitting process, for example.

The cylinder 120 may include cylinder body 121 that extends in the axial direction and cylinder flange 122 disposed or provided outside of a front portion of the cylinder body 121. The cylinder body 121 may have a cylindrical shape with a central axis in the axial direction and be inserted into the frame body 111. Thus, an outer circumferential surface of the cylinder body 121 may be disposed to face an inner circumferential surface of the frame body 111. Gas inflow part 126 into which the gas refrigerant flowing through the gas hole 114 may be introduced may be provided in the cylinder body 121.

The linear compressor 10 may further include a gas pocket 110*b* disposed or provided between the inner circumferential surface of the frame 110 and the outer circumferential surface of the cylinder 120 so that the gas used as the bearing may flow. A cooling gas passage from the outlet port 114*b* of the gas hole 114 to the gas inflow part 126 may define at least a portion of the gas pocket 110*b*. Also, the gas inflow part 126 may be disposed or provided at an inlet side of a cylinder nozzle 125, which will be described hereinafter.

The gas inflow part 126 may be recessed inward from the outer circumferential surface of the cylinder body 121 in the radial direction. Also, the gas inflow part 126 may have a circular shape along the outer circumferential surface of the cylinder body 121 with respect to the central axis in the axial direction.

A plurality of the gas inflow part 126 may be provided. For example, two gas inflow parts 126 may be provided. A first gas inflow part 126*a* of the two gas inflow parts 126 may be disposed or provided on a front portion of the cylinder body 121, that is, at a position which is close to the discharge valve 161, and a second gas inflow part 126*b* may be disposed on a rear portion of the cylinder body 121, that is, at a position which is close to a compressor suction side of the refrigerant. That is, the first gas inflow part 126*a* may be disposed or provided at a front side with respect to a central portion in a frontward and rearward direction of the cylinder body 121, and the second gas inflow part 126*b* may be disposed or provided at a rear side.

The first gas inflow part 126*a* may be disposed or provided at a position which is adjacent to the outlet port 114*b* of the gas hole 114. That is, a distance from the outlet port 114*b* of the gas hole 114 to the first gas inflow part 126*a* may be less than a distance from the outlet port 114*b* to the second gas inflow part 126*b*.

As an inner pressure of the cylinder 120 is relatively high at a position which is close to the discharge side of the refrigerant, that is, the inside of the first gas inflow part 126*a*, the outlet port 114*b* of the gas hole 114 may be disposed or provided adjacent to the first gas inflow part 126*a*, and thus, a relatively large amount of refrigerant may be introduced into the cylinder 120 through the first gas inflow part 126*a*. As a result, a function of the gas bearing may be enhanced. Also, while the piston 130 reciprocates, abrasion of the cylinder 120 and the piston 130 may be prevented.

A cylinder filter member 126*c* may be installed or provided on the gas inflow part 126. The cylinder filter member 126*c* may prevent a foreign substance having a predetermined size or more from being introduced into the cylinder 120 and perform a function for absorbing oil contained in the refrigerant. The predetermined size may be about 1 μm.

The cylinder filter member 126*c* may include a thread which is wound around the gas inflow part 126, for example. The thread may be made of a polyethylene terephthalate (PET) material and have a predetermined thickness or diameter, for example.

The thickness or diameter of the thread may be determined to have adequate dimensions in consideration of a strength of the thread. If the thickness or diameter of the thread is too small, the thread may be easily broken due to a very weak strength thereof. On the other hand, if the thickness or diameter of the thread is too large, a filtering effect with respect to the foreign substances may be deteriorated due to a very large pore in the gas inflow part 126 when the thread is wound.

The cylinder body 121 may further include the cylinder nozzle 125 that extends inward from the gas inflow part 126 in the radial direction. The cylinder nozzle 125 may extend up to the inner circumferential surface of the cylinder body 121.

The cylinder nozzle 125 may include a first nozzle part or nozzle 125*a* that extends from the first gas inflow part 126*a* to the inner circumferential surface of the cylinder body 121 and a second nozzle part or nozzle 125*b* that extends from the second gas inflow part 126*b* to the inner circumferential surface of the cylinder body 121.

The refrigerant which is filtered by the cylinder filter member 126*c* while passing through the first gas inflow part 126*a* may be introduced into a space between the inner circumferential surface of the first cylinder body 121 and the outer circumferential surface of the piston body 131 through the first nozzle part 125*a*. Also, the refrigerant which is filtered by the cylinder filter member 126*c* while passing through the second gas inflow part 126*b* may be introduced into a space between the inner circumferential surface of the first cylinder body 121 and the outer circumferential surface of the piston body 131 through the second nozzle part 125*b*. The gas refrigerant flowing to the outer circumferential surface of the piston body 131 through the first and second nozzle parts 125*a* and 125*b* may provide a levitation force to the piston 130 to perform a function as the gas bearing with respect to the piston 130.

The cylinder flange 122 may include first flange 122*a* that extends outward from the cylinder body 121 in the radial direction and second flange 122*b* that extends forward from the first flange 122*a*. A cylinder front part or portion 121*a* of the cylinder body 121 and the first and second flanges 122*a* and 122*b* may define deformable space part or space 122*e* which is deformable when the cylinder 120 is press-fitted into the frame 110. The second flange 122*b* may be press-fitted into an inner surface of the first wall 115*a* of the frame 110. That is, the inner surface of the first wall 115*a* and the outer surface of the second flange 122*b* may respectively provide press-fitting parts which are press-fitted with respect to each other.

Guide groove 115*e* for easily processing the gas hole 114 may be defined in the frame flange 112. The guide groove 115*e* may be formed by recessing at least a portion of the second wall 115*b* and defined in an edge of the filter groove 117.

While the gas hole 114 is processed, a processing mechanism may perform drilling from the filter groove 117 to the frame inclination part 113. The processing mechanism may interfere with the second wall 115*b*, causing a limitation in that the drilling is not easy. Thus, in this embodiment, the guide groove 115*e* may be defined in the second wall 115*b*, and the processing mechanism may be disposed in the guide groove 115*e* to facilitate processing of the gas hole 114.

Figure 13:
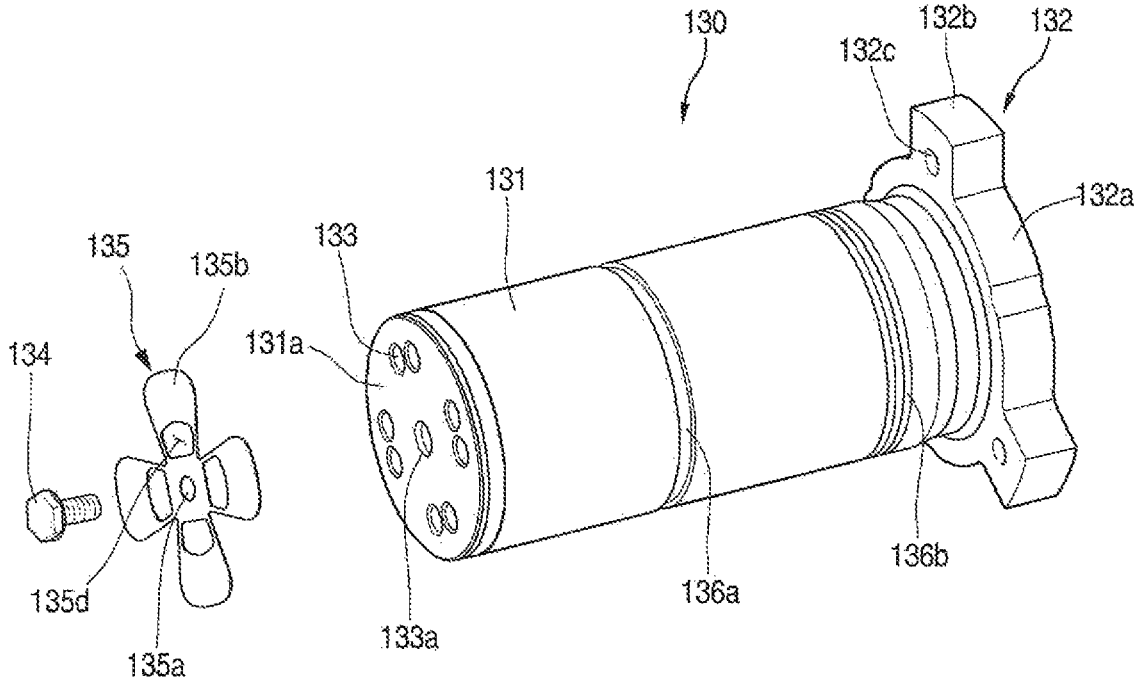
FIG. 13 is an exploded perspective view illustrating a piston and a suction valve according to an embodiment.
Figure 14:
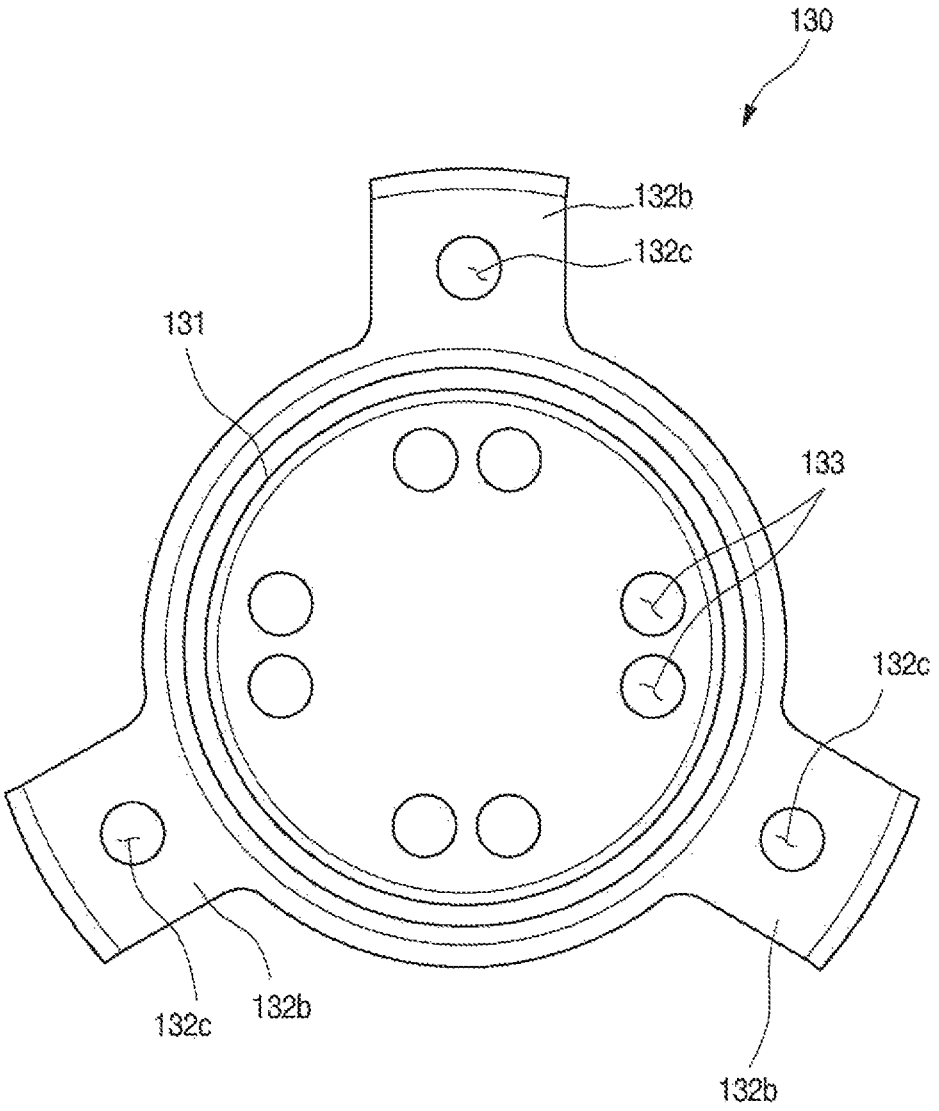
FIG. 14 is a left or first side view of the piston.
Figure 15:
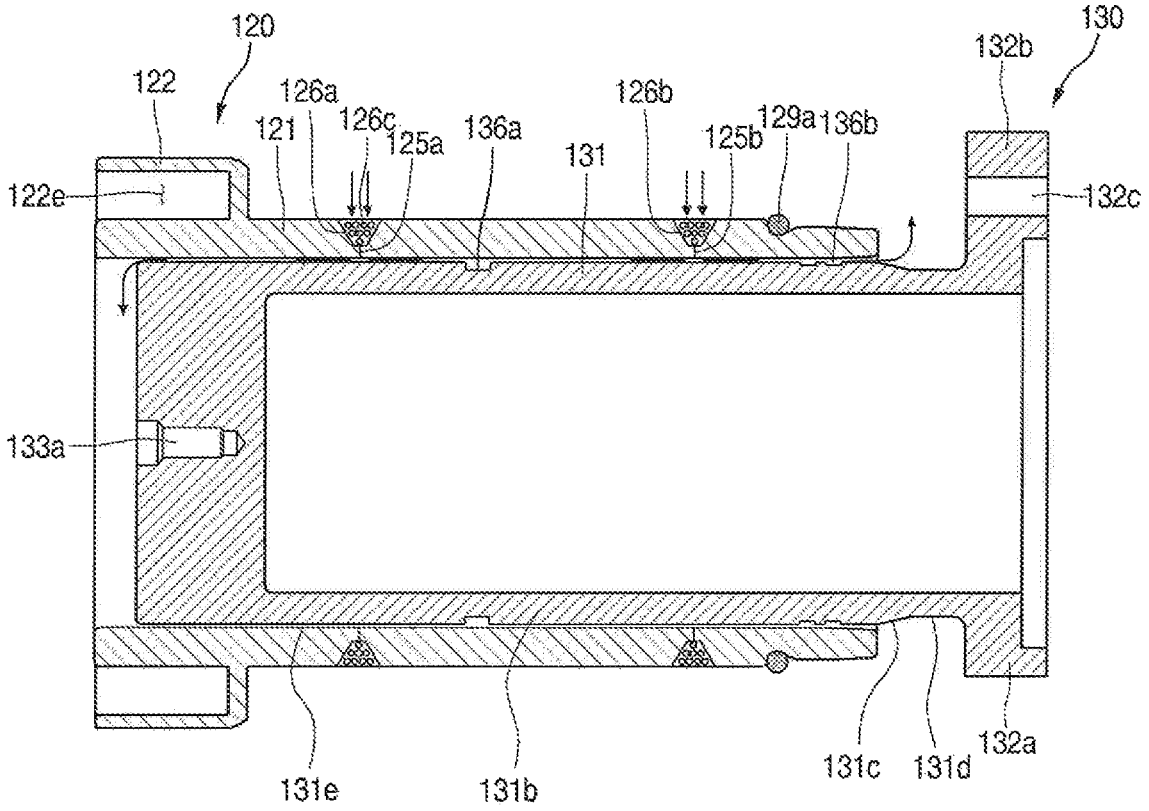
FIG. 15 is a cross-sectional view illustrating a state in which the piston is inserted into the cylinder according to an embodiment.

FIG. 13 is an exploded perspective view illustrating the piston and the suction valve according to an embodiment. FIG. 14 is a left or side view of the piston. FIG. 15 is a cross-sectional view illustrating a state in which the piston is inserted into the cylinder according to an embodiment.

As illustrated in the drawings, the piston 130 may reciprocate in the axial direction, that is, the frontward and rearward direction within the cylinder 120, and the suction valve 135 may be coupled to a front surface of the piston 130.

The linear compressor 10 may further include a valve coupling member 134 that couples the suction valve 135 to a coupling hole 133*a* of the piston 130. The coupling hole 133*a* may be defined in an approximately central portion of a front end surface of the piston 130. The valve coupling member 134 may pass through a valve coupling hole 135*a* of the suction valve 135 and be coupled to the coupling hole 133*a*.

The piston 130 may include piston body 131 having an approximately cylindrical shape and extending in the frontward and rearward direction and piston flange 132 that extends outward from the piston body 131 in the radial direction. The front portion of the piston body 131 may include a main body front end 131*a* in which the coupling hole 133*a* may be defined. A suction hole 133 which is selectively covered by the suction valve 135 may be defined in the main body front end 131*a*.

A plurality of the suction hole 133 may be provided, and the plurality of suction holes 133 may be defined outside of the coupling hole 133*a*. The plurality of suction holes 133 may be circularly arranged around the coupling hole 133*a*.

A number of suction holes 133 may be determined according to a flow rate of the refrigerant passing through the suction holes 133. Thus, a sum of total areas of the plurality of suction holes 133 may be the same, and the number and size of suction holes 133 may be adjusted.

When the plurality of suction holes 133 are provided, although a portion of the suction holes 133 is blocked or abnormal, the refrigerant may be introduced. When the plurality of suction holes 133 are provided, an excessive pressure may not be applied to the suction valve 135 which is elastically deformable when the refrigerant passes to prevent the suction valve 135 from being damaged.

A pair of suction holes 133 may be disposed or provided adjacent to each other. The plurality of suction holes 133, in which two suction holes 133 is provided in pairs, may be disposed or provided at a same interval around the coupling hole 133*a*. That is, the plurality of pairs of suction holes 133 may be circularly arranged at an angle of about 90° around a center of the piston 130.

The suction valve 135 may have a plate-shaped structure, that is, a shape of a plate made of an elastic metal or resin material to open and close the suction hole 133 according to the flow of the refrigerant. The suction valve 135 may include by a plurality of cover plates 135*b* extending outward with respect to the central portion in which the valve coupling hole 135*a* may be defined. Four cover plates 135*b* may be disposed or provided with a same arrangement as that of the suction holes 133. That is, one cover plate 135*b* may cover the pair of suction holes 133 which are successively disposed adjacent to each other.

The cover plate 135*b* may have a width that gradually increases outward from the central portion. Thus, the covered portion of the suction hole 133 may increase in width, and the elastic deformable portion connected to the central portion may decrease in width to allow the cover plate 135*b* to be easily elastically deformed.

The cover plate 135*b* and the adjacent cover plate 135*b* may rotate at an angle of about 90° with respect to each other and thus be spaced apart from each other. Thus, an effect of the refrigerant passing through the suction holes 133 adjacent to each other may be minimized to allow the refrigerant to smoothly flow. Also, one cover plate 135*b* may be configured to cover two suction holes 133 so that the cover plate 135*b* having a preset or predetermined elastic constant may be easily elastically deformed when the refrigerant flows and then opened.

An opening 135*d* may be defined in one side of the cover plate 135*b* adjacent to the central portion. The opening 135*d* may be defined between the coupling hole 135*a* and the suction hole 133 to allow the cover plate 135*b* to be more effectively elastically deformed.

A rear portion of the piston body 131 may be opened to suction the refrigerant. At least a portion of the suction muffler 150, that is, first muffler 151 may be inserted into the piston body 131 through the opened rear portion of the piston body 131.

A first piston groove 136*a* may be defined in the outer circumferential surface of the piston body 131. The first piston groove 136*a* may be defined in a front side with respect to a central line C1 in a radial direction of the piston body 131. The first piston groove 136*a* may be understood as component that guides a smooth flow of the refrigerant gas introduced through the cylinder nozzle 125 and prevents a pressure loss from occurring. The first piston groove 136*a* may be defined along a circumference of the outer circumferential surface of the piston body 131 and have, for example, a ring shape.

A second piston groove 136*b* may be defined in the outer circumferential surface of the piston body 131. The second piston groove 136*b* may be defined in a rear side with respect to the central line C1 in the radial direction of the piston body 131. The second piston groove 136*b* may be understood as a "discharge guide groove" that guides discharge of the refrigerant gas used for levitating the piston 130 to the outside of the cylinder 120. As the refrigerant gas is discharged to the outside of the cylinder 120 through the second piston groove 136*b*, the refrigerant gas used as the gas bearing may be prevented from being introduced again into the compression space P via the front side of the piston body 131.

The second piston groove 136*b* may be spaced apart from the first piston groove 136*a* and defined along the circumference of the outer circumferential surface of the piston body 131. For example, the second piston groove 136*b* may have a ring shape. A plurality of the second piston groove 136*b* may be provided.

The second piston groove 136*b* may have a size less than a size of the first piston groove 136*a*. Due to the above-described structure, a too great amount of refrigerant gas used as the gas bearing may flow to the second piston groove 136*b* when compared to the first piston groove 136*a* to prevent the gas bearing from being deteriorated in performance.

Also, a width of the first piston groove 136*a* in the frontward and rearward direction may be greater than a width of the second piston groove 136*a* in the frontward and rearward direction.

The piston flange 132 may include flange body 132*a* that extends outward from the rear portion of the piston body 131 in the radial direction and a piston coupling part or portion 132*b* further extending outward from the flange body 132*a* in the radial direction. The piston coupling part 132*b* may include a piston coupling hole 132*c* to which a support coupling member 460 may be coupled. The support coupling member 460 may pass through the piston coupling hole 132*c* and be coupled to magnet frame 138 and the support 400. Also, three piston coupling parts 132*b* may be provided and circularly arranged at an angle of about 120° around the center of the piston.

Thus, deformation of the piston 130 when the piston 130, the magnet frame 110, and the support 400 are coupled to each other by the support coupling member 460 may be prevented. Also, a load transmitted during operation of the compressor 10 may be uniformly dispersed to the overall piston 130 to maintain a balance of the piston 130.

The second piston groove 136*b* may be disposed or provided between the first piston groove 136*a* and the piston flange 132. The piston body 131 may include a first body 131*b* in which piston grooves 136*a* and 136*b* are defined and extending in the axial direction, a piston inclination part or portion 131*c* that extends at an incline from the first body 131*a* in the axial direction, and a second body 131*d* that extends from the piston inclination part 131*c* to the piston flange 132 in the axial direction. The piston inclination part 131*c* may extend backward to the inside in the radial direction at a predetermined angle (θ).

The second body 131*d* may have an outer diameter less than an outer diameter of the first body 131*b*. Also, an inner circumferential surface 131*e* of the first body 131*b* and an inner circumferential surface of the second body 131*d* may form one curved surface. Thus, the first body 131*b* may have a thickness greater than a thickness of the second body 131*d*.

Due to a difference in shape and thickness of the first body 131*b* and the second body 131*d*, a flow space through which the refrigerant gas used as the gas bearing flows may be relatively large outside of the second body 131*d*. Thus, the refrigerant gas flowing through the second piston groove 136*b* may be easily discharged.

Further, as the outer circumferential surface of the second body 131*d* is disposed or provided at a position which is relatively away from the inner circumferential surface of the cylinder 120, a force (lateral force) in the radial direction may be applied to the piston 130 while the piston 130 reciprocates, movement of the piston 130 in the radial direction may occur. Thus, a phenomenon in which the piston body 131 interferes with the rear end of the cylinder 120 may be prevented. Furthermore, as the movement of the piston body 131 is guided so that a degree of freedom of the resonant springs 176*a* and 176 is secured, a stress applied to the resonant springs 176*a* and 176*b* while the compressor operates may be reduced, preventing the resonant springs 176*a* and 176*b* from being worn and damaged.

The piston 130 may be levitated from the inner circumferential surface of the cylinder 120 by a pressure of the refrigerant introduced via the cylinder nozzle parts 125*a* and 125*b*. The refrigerant passing through the cylinder 120 may have a flow cross-section area that gradually increases from the cylinder nozzle parts 125*a* and 125*b* toward a space between the cylinder 120 and the piston 130 to prevent the pressure from suddenly dropping when the refrigerant flows.

The piston 130 may reciprocate within the cylinder 120 in the frontward and rearward direction. During the reciprocation of the piston 130, the first piston groove 136*a* defined in the piston body 131 may be disposed between the two cylinder nozzles 125*a* and 125*b* provided in the cylinder 120. Thus, during the reciprocation of the piston 130, the refrigerant discharged through the discharge valve 161 may uniformly flow to the outer circumferential surface of the piston body 131 through the gas inflow part 126 and the cylinder nozzle 125 of the cylinder 120.

At least a portion of the refrigerant flowing to the inner circumferential surface of the cylinder 120 through the second nozzle part 125*b* and the second gas inflow part 126*b* may flow forward to the first piston groove 136*a*, and the remaining refrigerant may flow backward. As described above, due to the structure of the first piston groove 136*a*, the refrigerant may be uniformly supplied from the front side to the rear side of the piston body 131.

The refrigerant flowing to the outer circumferential surface of the piston body 131 and thus used as the gas bearing may be discharged to the outside of the cylinder 120. At least a portion of the refrigerant used as the gas bearing may flow to the rear side of the cylinder 120, that is, a portion into which the refrigerant is suctioned into the cylinder 120, and the remaining refrigerant may flow to the front side of the cylinder 120, that is, a portion in which the compression space P is defined.

The refrigerant flowing to the front and rear sides of the cylinder 120 and then discharged from the cylinder 120 may be introduced again to the compression space P to interrupt the flow of the refrigerant flowing to the compression space P through the suction valve 135. Thus, compression performance of the refrigerant may be deteriorated.

Thus, the second piston groove 136*b* may be defined in the rear portion of the piston body 131 to increase an amount of refrigerant used as the gas bearing, that is, refrigerant flowing to the rear side of the cylinder 120 in the refrigerant flowing to the outer circumferential surface of the piston body 131 through the cylinder nozzle 125. The refrigerant flowing to the rear side of the cylinder 120 may contain the refrigerant passing through the first piston groove 136*a*.

As the second piston groove 136*b* is provided in the piston body 131, the pressure loss in the rear side of the cylinder 120 may be reduced, and thus, discharge of the refrigerant through the rear side of the cylinder 120 may be more easily performed. The refrigerant may be discharged to the outside through a space between the rear end of the cylinder 120 and the piston flange 132.

Thus, an amount of refrigerant flowing to the rear side of the cylinder 120 in the refrigerant used as the gas bearing may increase to relatively reduce an amount of refrigerant introduced into the compression space P. As a result, compression efficiency of the linear compressor 10 may be improved, and power consumption may be reduced. Thus, when the linear compressor 10 is provided in a refrigerator, power consumption of the refrigerator may be reduced.

For example, when the second piston groove 136*b* is not provided in the piston body 131, a fact in which a ratio of the refrigerant flowing to the front side and the rear side of the cylinder 120 is about 45:55 is confirmed through experimental results. On the other hand, when the second piston groove 136*b* is provided in the piston body 131, that a ratio of the refrigerant flowing to the front side and the rear side of the cylinder 120 is about 40:60 is confirmed through the experimental results.

Figure 16:
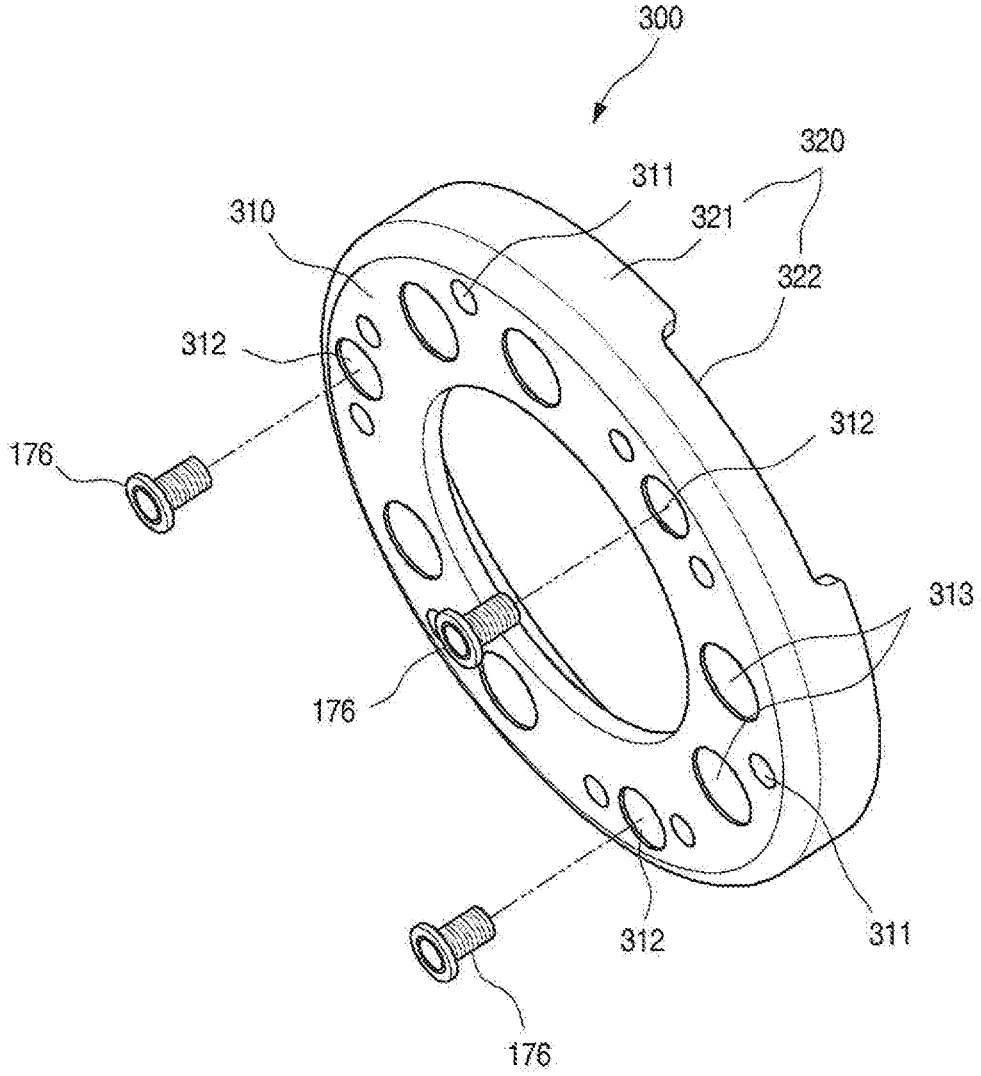
FIG. 16 is a perspective view of a stator cover according to an embodiment.

FIG. 16 is a perspective view of the stator cover according to an embodiment. As illustrated in the drawing, the stator cover 300 may include a plan part or portion 310 having a circular shape and a rim 320 that extends backward along a circumference of the plan part 310. A center of the plan part 310 may be open, and the muffler 150 and the magnet frame 110 may pass through the open center of the plan part 310. Also, an entire surface of the plan part 310 may support the stator cover 300 at a rear side.

A third coupling hole 311 to which the cover coupling member 149*a* may be coupled may be defined in the stator cover 300. Three third coupling holes 311 may be provided to correspond to the number of cover coupling members 149*a* and disposed at the same interval along the plan part 310 of the stator cover 300. That is, the third coupling holes 311 may be defined at the same interval around the center of the axial direction of the compressor 10 and circularly arranged at an angle of about 120°.

A fourth coupling hole 312 to which the rear cover coupling member 176 to be coupled to the rear cover 170 may be coupled may be defined in the plan part 310. Also, three fourth coupling holes 312 may be disposed or provided at a same interval around the center of the axial direction of the compressor 10 and circularly arranged at an angle of about 120°. The fourth coupling hole 312 may be defined in a center between the third coupling holes 311 spaced apart from each other. That is, the third coupling holes 311 and the fourth coupling holes 312 may be successively circularly arranged at an angle of about 60° around the center of the stator cover 300. Thus, the third coupling holes 311 and the fourth coupling holes 312 may be alternately successively arranged at the same interval along the circumference of the plan part 310 of the stator cover 300.

The third coupling holes 311 and the fourth coupling holes 312 may be defined in a central portion between the stator covers 141*a* which are successively arranged in the motor assembly 140. Thus, an arranged space of the cover coupling member 149*a* and the rear cover coupling member 176, which are coupled to the third and fourth coupling holes 311 and 312, may be secured to improve workability and realize a compact size. Also, to this end, six stator cores 141*a* may be provided. The cover coupling member 149*a* and the rear cover coupling member 176 may be disposed between the stator cores 141*a*.

A stator-side support part or support 313 that supports a front end of the first resonant spring 176*a* may be disposed or provided on the plan part 310. The stator-side support part 313 may protrude backward from a position corresponding to a mounted position of the first resonant spring 176*a* and be formed through a processing process, such as forming when the stator cover 300 is molded. Also, the stator-side support part 313 may be inserted into the first resonant spring 176*a* to maintain a stably seated state of the first resonant spring 176*a*.

A pair of stator-side support parts 313 may be disposed or provided adjacent to each other to correspond to the arrangement of the first resonant springs 176*a*, and all six stator-side support parts 313 in which two stator-side support parts 313 are provided in pairs, may be arranged at a same interval. That is, the stator-side support parts 313 may be circularly arranged in pairs at an angle of 120° around the center in the axial direction of the compressor 10. Also, the stator-side support part 313 may be disposed at a center between the fourth coupling holes 312.

The rim 320 may include a first rim 321 and a rim 322, each of which has a predetermined height. The first rim 321 may be disposed at a position corresponding a position that of the stator-side support part 313 and be higher than the second rim 322. Also, the first rim 321 may cover a lower end of the first resonant spring 176*a* mounted on the stator-side support part 313 to maintain a stably mounted state without separating the first resonant spring 176*a* (see FIG. 5).

The second rim 322 may be lower than the first rim 321 and disposed or provided between the first rims 321. Also, the second rim 322 has a width equal to or greater somewhat than a width of the coupling leg 174 of the rear cover 170. Thus, in a state in which the rear cover 170 is coupled to the stator cover 300, the leg coupling part 175 of the coupling leg 174 coming into contact with or contacting the plan part 310 may be exposed through the second rim 322 (see FIG. 5).

Figure 17:
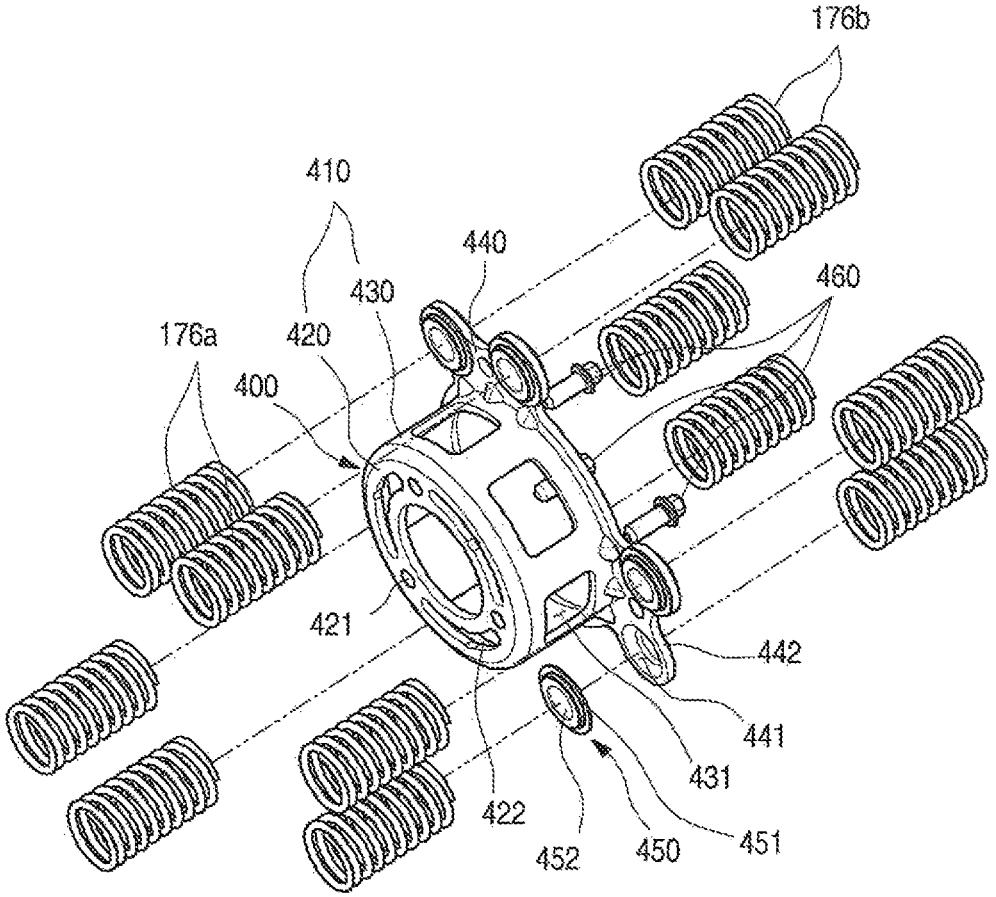
FIG. 17 is an exploded perspective view illustrating a coupling structure of a support and a resonant spring according to an embodiment.
Figure 18:
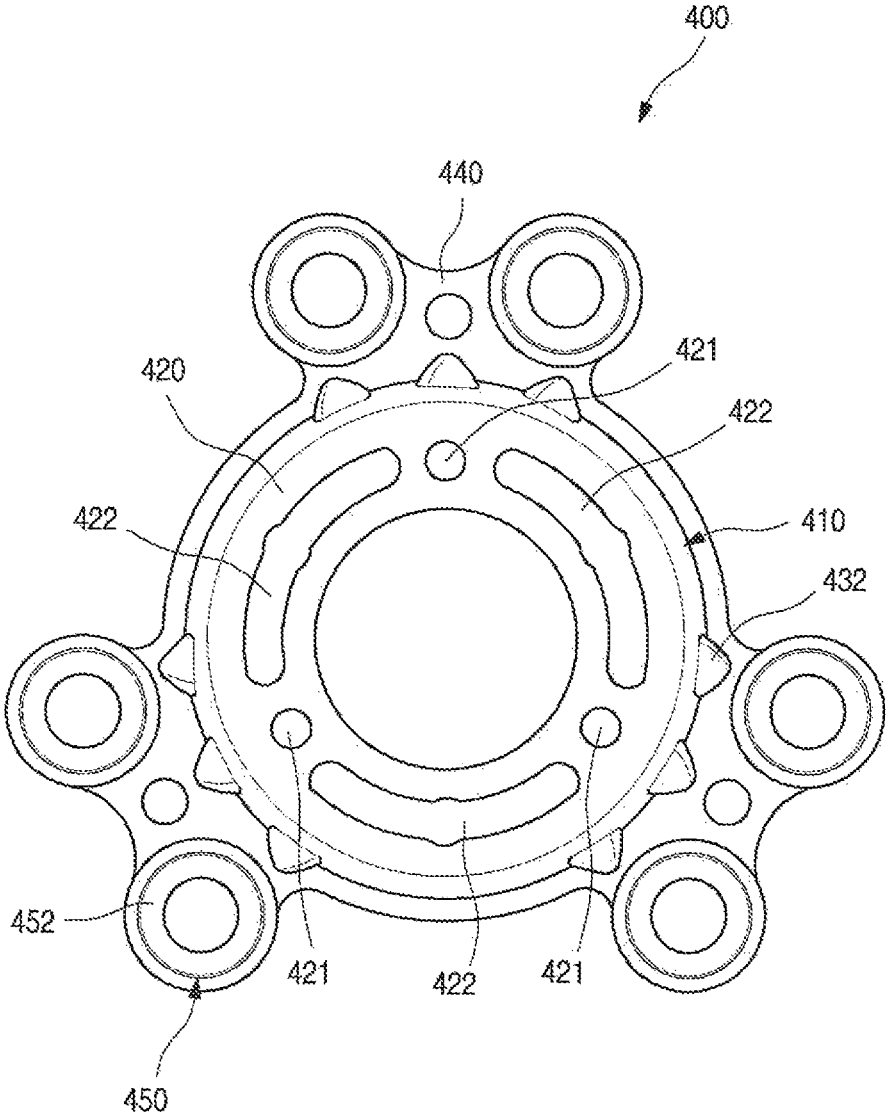
FIG. 18 is a plan view of the support.

FIG. 17 is an exploded perspective view illustrating a coupling structure of a support and a resonant spring according to an embodiment. FIG. 18 is a plan view of the support.

As illustrated in the drawings, the support 400 may include a support body 410 and a spring support part or portion 440 that extends along a circumference of the support body 410. The support 400 may support a rear end of the first resonant spring 176*a* and a front end of the second resonant spring 176*b* through the spring support part 440.

The support body 410 may have a cylindrical shape, a rear surface of which is completely opened. The support body 410 may have a support front surface 420 and a support circumferential surface 430. The support front surface 420 may have a center which is circularly open, and thus, the third muffler 153 may pass through the open center of the support front surface 420. Also, the support front surface 420 may be coupled to the magnet frame 110 and the piston 130 and reciprocate together with the piston 130 when the piston 130 reciprocates.

A support hole 421 to which the support coupling member 460 for coupling the support 400, the magnet frame 110, and the piston 130 to each other may be coupled may be defined in the support front surface 420. Three support holes 421 may be defined at a same interval. That is, the three support holes 421 may be circularly arranged at an angle of about 120° around a center of the support 400.

A first front hole 422 may be defined between the support holes 421. The first front holes 422 may extend lengthwise along the front surface of the support 400 to allow air to flow when the support 400 reciprocates in the frontward and rearward directions.

A plurality of side holes 431 may be defined along a circumference of the support circumferential surface 430. The side holes 431 may effectively discharge air within the support body 410 to the outside when the support 400 reciprocates to prevent the support 400 from having an influence on a wind speed. Also, the support 400 may be lightweight due to the side hole 431, and a structurally unnecessary portion may be removed to reduce manufacturing costs.

The spring support part 440 may be disposed or provided on the support circumferential surface 430. The spring support part 440 may be bent outward from an open rear end of the support body 410. Also, a reinforcement part or portion 432 that prevents the spring support part 440 from being deformed may protrude from an edge at which the spring support part 440 and the support body 410 come into contact with or contact each other. A plurality of the reinforcement part 432 may be provided, and the plurality of reinforcement parts 432 may successively protrude at a predetermined interval along the spring support part 440.

Also, three spring support parts 440 may be provided and circularly arranged at an angle of about 120° around the center of the axial direction of the support 400. Also, the spring support part 440 may be disposed or provided at a same position as those of the resonant springs 176*a* and 176*b*. Thus, the rear end of the first resonant spring 176*a* and the rear end of the second resonant spring 176*b* may be supported by the spring support part 440.

A pair of spring seating parts or seats 442 and 452 may be disposed or provided on the spring support part 440 to support the pair of resonant springs 176*a* and 176*b*. The spring seating parts 442 and 452 may include a rear protrusion 442 that protrudes from the spring support part 440 and a front protrusion 452 on which a seating member or seat 450 mounted on the spring support part 440 may be disposed or provided.

The support 400 may be manufactured through sheet metal processing, for example. When the support 400 is processed, the rear protrusion 442 protruding outward from the spring support part 440 may be formed. Also, the rear protrusion 442 may be disposed or provided along a circumference of a support hole 441 defined in the spring support part 440. Thus, the rear protrusion 442 may have a circular shape and be inserted into the front end of the second resonant spring 176*b*.

Also, the seating member 450 having a ring shape may be inserted into the support hole 441. The seating member 450 may be injection-molded using a plastic material and press-fitted into the spring support part 440, for example. The seating member 450 may include a press-fitting part or portion 451 press-fitted into the support hole 441 and a front protrusion 452 that protrudes forward from the spring support part 440. The front protrusion 452 may have a same shape as the rear protrusion 442 and be inserted into the rear end of the first resonant spring 176*a*.

Thus, each of the two first resonant springs 176*a* and the two second resonant springs 176*b* may be supported by the one spring support part 440. Also, the six first resonant springs 176*a* and the six second resonant springs 176*b* may be supported on the whole by the support 400.

If necessary, the support 400 may be processed through the sheet metal processing to form the bent spring support part 440, and then, the front protrusion 452 and the rear protrusion 442 may be formed through cutting processing, for example. However, due to the above-described structure, the support 400 may be very simply formed through the sheet metal processing, and the seating member 450 which may be is injection-molded may be assembled to support the resonant springs 176*a* and 176*b* disposed on both sides thereof in the frontward and rearward direction. Thus, productivity may be improved, and manufacturing costs may be reduced when compared to those in the above-described process in which the cutting processing is performed after performing the sheet metal processing is performed so as to form the front and rear protrusions 452 and 442, which protrude to both sides.

Figure 19:
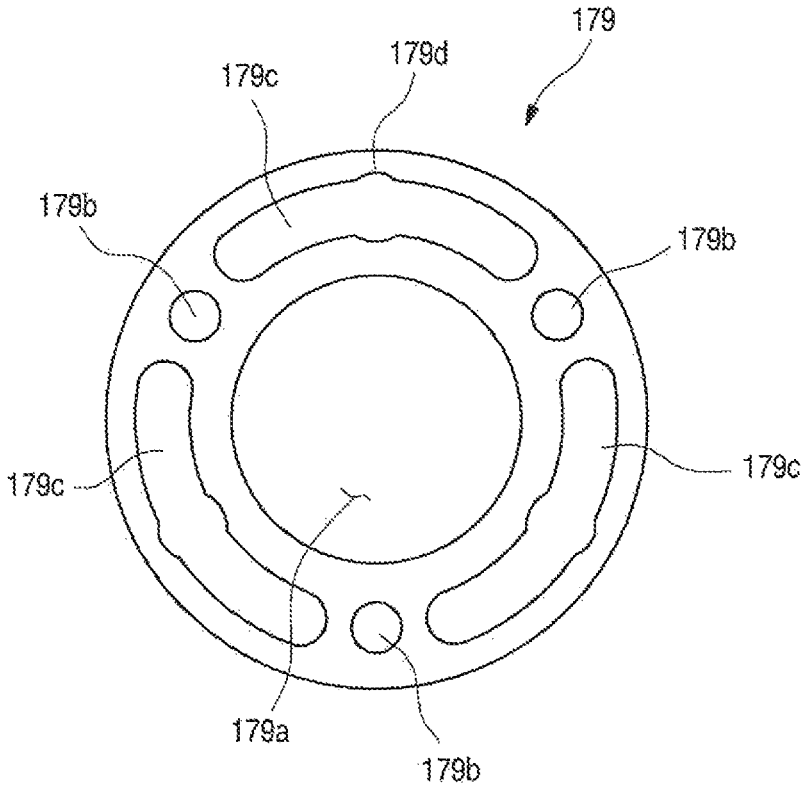
FIG. 19 is a plan view of a balance weight according to an embodiment.

FIG. 19 is a plan view of a balance weight according to an embodiment. As illustrated in the drawing, the balance weight 179 may have a circular plate shape with a central front opening 179*a* and be mounted on the inner surface of the support 400. The balance weight 179 may be integrally coupled to the support 400 by the support coupling member 460 coupled to the support 400. Also, the balance weight 179 may have a same shape as a shape of the support front surface 420.

That is, three weight holes 179*b* may be defined in the balance weight 179, and three second front holes 179*c* may be defined between the weight holes 179*a*. Each of the weight holes 179*b* may have a same size as the support hole 421 and be disposed or provided at a same position as the support hole 421. Thus, the balance weight 179 may be fixed to and mounted on the support 400 by the support coupling member 460. Also, the second front hole 179*c* may have a same size and shape as the side hole 431 and be disposed or provided at a same position as the side hole 431. Thus, when the support 400 reciprocates, a flow of air to the inside and outside of the support 400 may be enabled.

A jig groove 179*d* into which a jig may be inserted may be defined in a center of the second front hole 179*c* to facilitate the assembling process. The jig groove 179*d* may be equally formed at a position corresponding to the support 400.

The three weight holes 179*b* defined in the balance weight 179 may also be circularly arranged at a same interval at an angle of about 120° around a center of the balance weight 179. Also, one second front hole 179*c* may be defined between the two weight holes 179*b*. The balance weight 179 may also have the coupling structure in which the balance weight 179 is supported at three points. Thus, a weight balance of the support coupling member 460 may be balanced on the whole, stress may be uniformly dispersed when the support coupling member 460 is coupled, and a load generated during operation of the compressor 10 may be uniformly transmitted.

Figure 20:
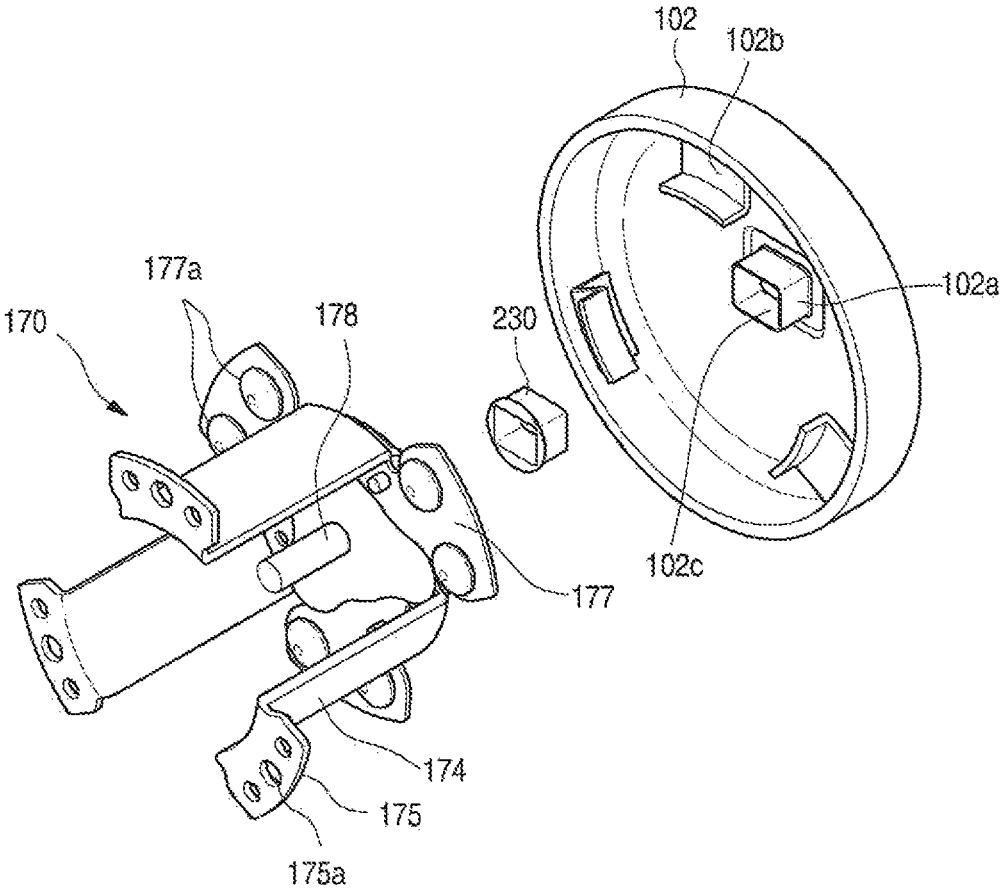
FIG. 20 is an exploded perspective view of a rear cover and a first shell cover when viewed from a front side according to an embodiment.
Figure 21:
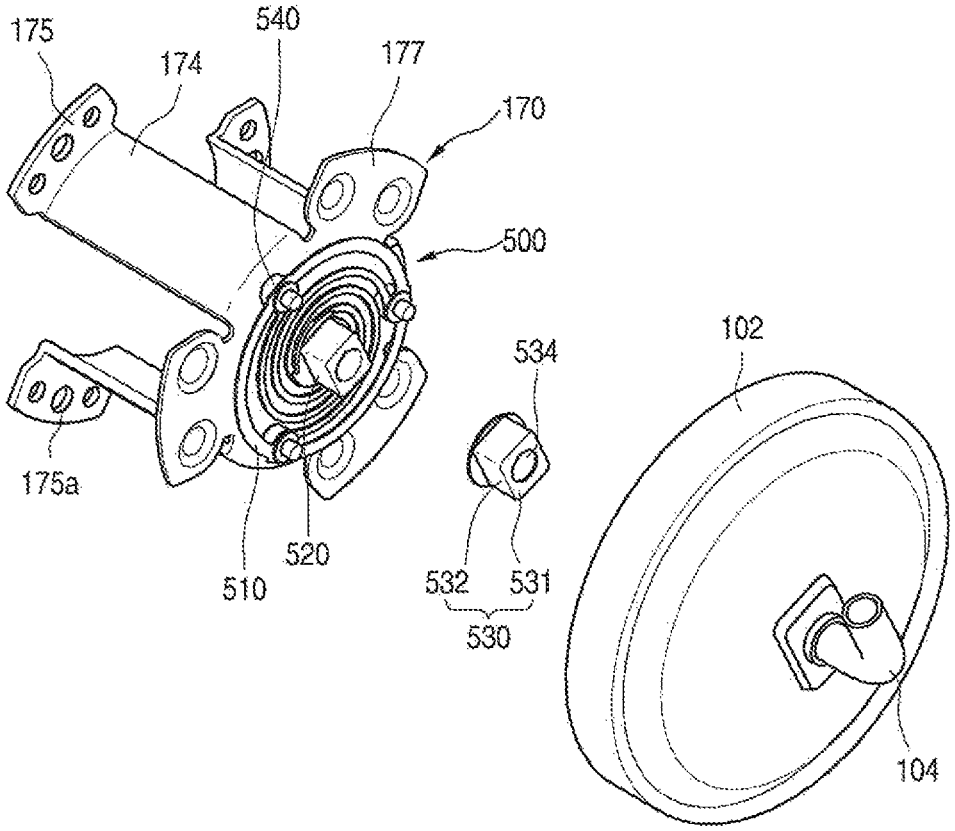
FIG. 21 is an exploded perspective view of the rear cover, a first support device or support, and a first shell cover when viewed from a rear side.
Figure 22:
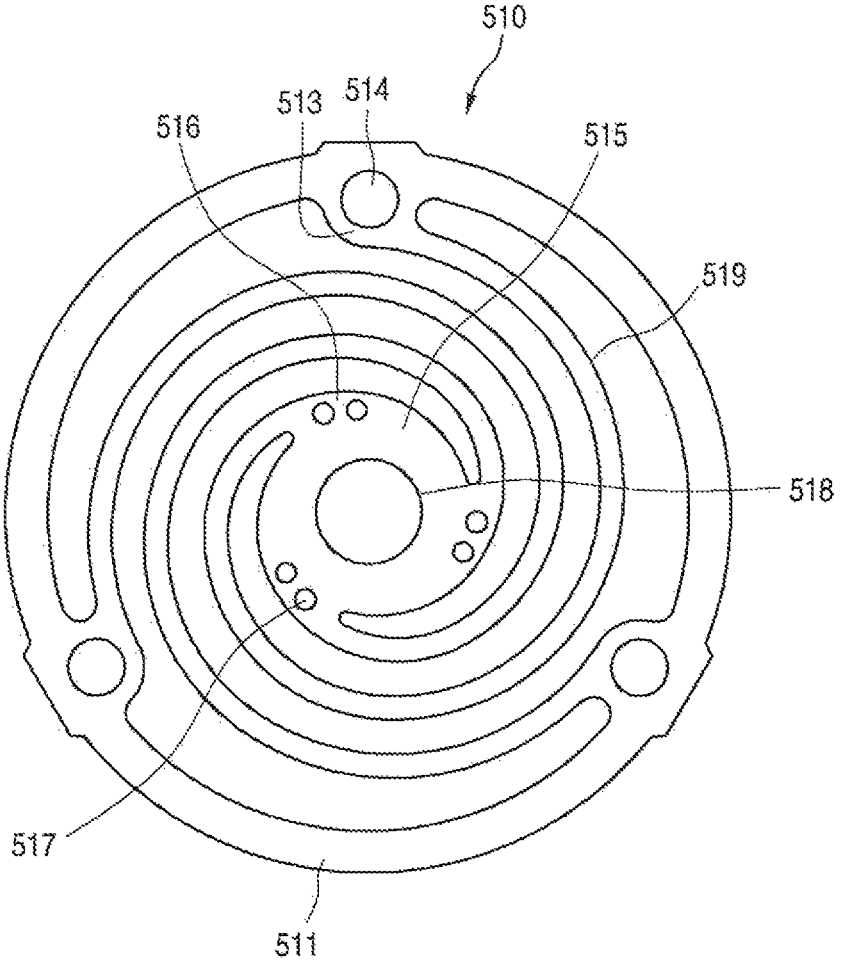
FIG. 22 is a plan view of a first plate spring according to an embodiment.

FIG. 20 is an exploded perspective view of a rear cover and a first shell cover when viewed from a front side according to an embodiment. FIG. 21 is an exploded perspective view of the rear cover, the first support device, and the first shell cover when viewed from a rear side. FIG. 22 is a plan view of a first plate spring according to an embodiment.

As illustrated in the drawings, the first support device 500 may be coupled to the first shell cover 102 in a state in which the first support device 500 is coupled to an end of the compressor body 100, that is, an end of the rear cover 170. The first support device 500 may include first plate spring 510. When the first support device 500 is coupled to the first shell cover 102, the first plate spring 510 may be fixed to the rear cover 170.

The first plate spring 510 may be disposed to stand up within the shell 101 so that the axis of the compressor body 100 passes therethrough. When the first support device 500 includes the first plate spring 510, the first support device 500 may be reduced in size. In addition, vibration of the compressor body 100 may be effectively absorbed, and also a collision between the compressor body 100 and the shell 101 may be prevented by a large transverse stiffness (stiffness in a direction perpendicular to an axial direction of the compressor body) and a small longitudinal stiffness (stiffness in the axial direction of the compressor body).

The first support device 500 may further include a first spring connection part or portion 520 connected to the first plate spring 510. The first spring connection part 520 may allow the first support device 500 to be easily coupled to the first shell cover 102.

Cover support part 102*a* that couples the first support device 500 may be provided on the first shell cover 102. The cover support part 102*a* may be integrated with the first shell cover 102 or coupled to the first shell cover 102.

The first spring connection part 520 may be inserted into an accommodation part or portion 102*c* of the cover support part 102*a*. A buffer part or buffer 530 may be disposed or provided between the first spring connection part 520 and the cover support part 102*a*. Thus, the vibration transmitted from the first spring connection part 520 may not be transmitted to the cover support part 102*a*, but may be absorbed by the buffer part 530.

The buffer part 530 may be made of a rubber material or a material which is capable of absorbing an impact while being deformed by an external force. The buffer part 530 may have an opening 534 through which the refrigerant may pass.

In this embodiment, vibration in the axial direction of the compressor body 100 may be absorbed by the first plate spring 510, and vibration in the radial direction may be absorbed by the buffer part 530. Thus, transmission of the vibration of the compressor body 100 to the shell 101 may be effectively prevented by the first shell cover 102.

The first spring connection part 520 may include a refrigerant passage through which the refrigerant suctioned through the suction pipe 104 may pass.

The first plate spring 510 may include an outer rim 511, an inner rim 515, and a connection part or portion 519 having a spiral shape and connecting the outer rim 511 to the inner rim 515. The inner rim 515 may include a plurality of rounded extension parts or portions 516 spaced apart from each other in a circumferential direction. Also, the connection part 519 may be connected to each of the plurality of rounded extension parts 516.

The first spring connection part 520 may be integrally formed with the inner rim 515 through insertion injection molding, for example. Thus, in a state in which the first spring connection part 520 is insertion injection-molded to the inner rim 515, the first spring connection part 520 may be prevented from being separated in the axial direction of the compressor body 100. In a state in which the first spring connection part 520 is insertion injection-molded to the first plate spring 510, a plurality of holes 517 filled with a resin when the insertion injection molding is performed may be defined in the inner rim 515 to prevent the first spring connection part 520 from rotating with respect to the first plate spring 510.

A plurality of extension parts or portions 513 may be disposed or provided on an inner circumferential surface of the outer rim 511. The plurality of extension parts 513 may be disposed or provided to be spaced apart from each other in the circumferential direction of the outer rim 511, and the connection part 519 may be connected to each of the plurality of extension parts 513. A coupling hole 514 through which the first spring coupling member 540 may pass to couple the first plate spring 510 to the rear cover 170 may be defined in each of the plurality of extension parts 513.

The first spring coupling member 540 may pass through the first plate spring 510 and be coupled to the rear cover coupling hole 172. Also, the rear cover coupling member 149*a* may be coupled in a state in which the first plate spring 510 is spaced a predetermined distance backward from the rear cover 170 and be elastically deformed in the axial direction of the first plate spring 510.

The first plate spring 510 may be fixed to the rear cover 170 by the three rear cover coupling members 149*a*. To this end, three rear cover coupling holes 514 may be provided. Also, the three rear cove coupling holes 514 may be circularly arranged at an angle of 120° around a center of the rear cover 170. The rear cover coupling holes 514 may be circularly arranged at a same interval in the circumferential surface of the first plate spring 510. Also, three extension parts 513 and three connection parts 519 connecting the extension parts 513 may be provided.

Thus, when the compressor 10 operates, a load applied to the first plate spring 510 may not be biased to any one side, but be uniformly distributed on the entire first plate spring 510. Thus, the load may be effectively dispersed, and the buffer effect of the first plate spring 510 may be realized while maintaining the balance.

The rear cover 170 may include cover body 171 in which the rear cover coupling hole 172 may be defined and three coupling legs 174 that extends toward the motor 140. Also, each of the coupling legs 174 may be coupled to the rear surface of the stator cover 300.

Leg coupling part 175 may be bent outward and disposed or provided on a lower end of each coupling leg 174. A leg hole 175*a* may be defined in the leg coupling part 175, and the rear cover coupling member 176 may be coupled to the leg hole 175*a* to couple the rear cover 170 to the stator cover 300.

The cover-side seating part 177 may extend outward and be disposed or provided in a space between an upper end of the rear cover 170 and the rear cover coupling members 176. The rear end of the second resonant spring 176*b* may be supported by the cover-side seating part 177.

A number of first stoppers 102*b* may be the same as a number of coupling legs 174. The plurality of first stoppers 102*b* may extend from an inner circumferential surface of the first shell cover 102 to the axis of the compressor body 100. The plurality of first stoppers 102*b* may be disposed or provided to be spaced apart from the inner circumferential surface of the first shell cover 102 in the circumferential direction. Also, the plurality of coupling legs 174 may be disposed or provided to be spaced apart from each other in the circumferential direction of the cover body 171.

In a state in which the compressor body 100 is fixed to the first shell cover 102 by the first support device 500, each of the plurality of coupling legs 174 may be disposed to face each of the plurality of first stoppers 102*b*. Each of the plurality of coupling legs 174 may be spaced apart from each of the plurality of first stoppers 102*b*. That is, three first stoppers 102*b* may be provided like the leg coupling parts 175 and circularly arranged at a same interval at an angle of about 120° around a center of the shell 101.

In a state in which the compressor body 100 does not operate, a distance between the shell 101 and the motor 140 may be greater than a distance between the frame 110 and the shell 101 and between the stator cover 300 and the shell 101.

Thus, according to an embodiment, although the compressor body 100 vibrates in the radial direction, other components of the compressor body 100 in addition to the motor 140 may not directly collide with the shell 101, but first come into contact with or contact the first stopper 102*b* to prevent the compressor body 100 in addition to the motor 140 from being damaged during transfer of the compressor 10.

The three coupling legs 174 may be provided, and also, the stator cover 300 and the first plate spring 510, which are coupled to the coupling legs 174, and other components linked with the stator cover 300 and the first plate spring 510 may be also coupled at three points to maintain an overall weight balance and prevent local deformation from occurring during assembly. Also, although the coupling leg 174 comes into contact with or contacts the first stopper 102*b* to generate an impact, a load may be uniformly dispersed to the whole rear cover 170 and the whole stator cover 300 and the whole first plate spring 510, which are connected to the rear cover 170, to minimize damage of the compressor body 100.

A recess part or recess 171*a* is defined in the cover body 171. The recess part 171*a* is recessed from the cover body 171 to the motor 140. In the state in which the compressor body 100 does not operate by the recess part 171*a*, the first spring connection part 520 may be spaced apart from the recess part 171*a*.

When the compressor body 100 moves toward the first spring connection part 520 by the vibration in the axial direction of the compressor body 100, if the recess part 171*a* comes into contact with the first spring connection part 520, the compressor body 100 may not move any more toward a right side. Thus, a moving distance of the compressor body 100 in the axial direction may be reduced to prevent the first plate spring 510 from being excessively deformed. That is, according to an embodiment, the first spring connection part 520 may function as a "third stopper" that restricts movement of the compressor body 100 in one direction when vibration of the compressor body 100 in the axial direction occurs.

Figure 23:
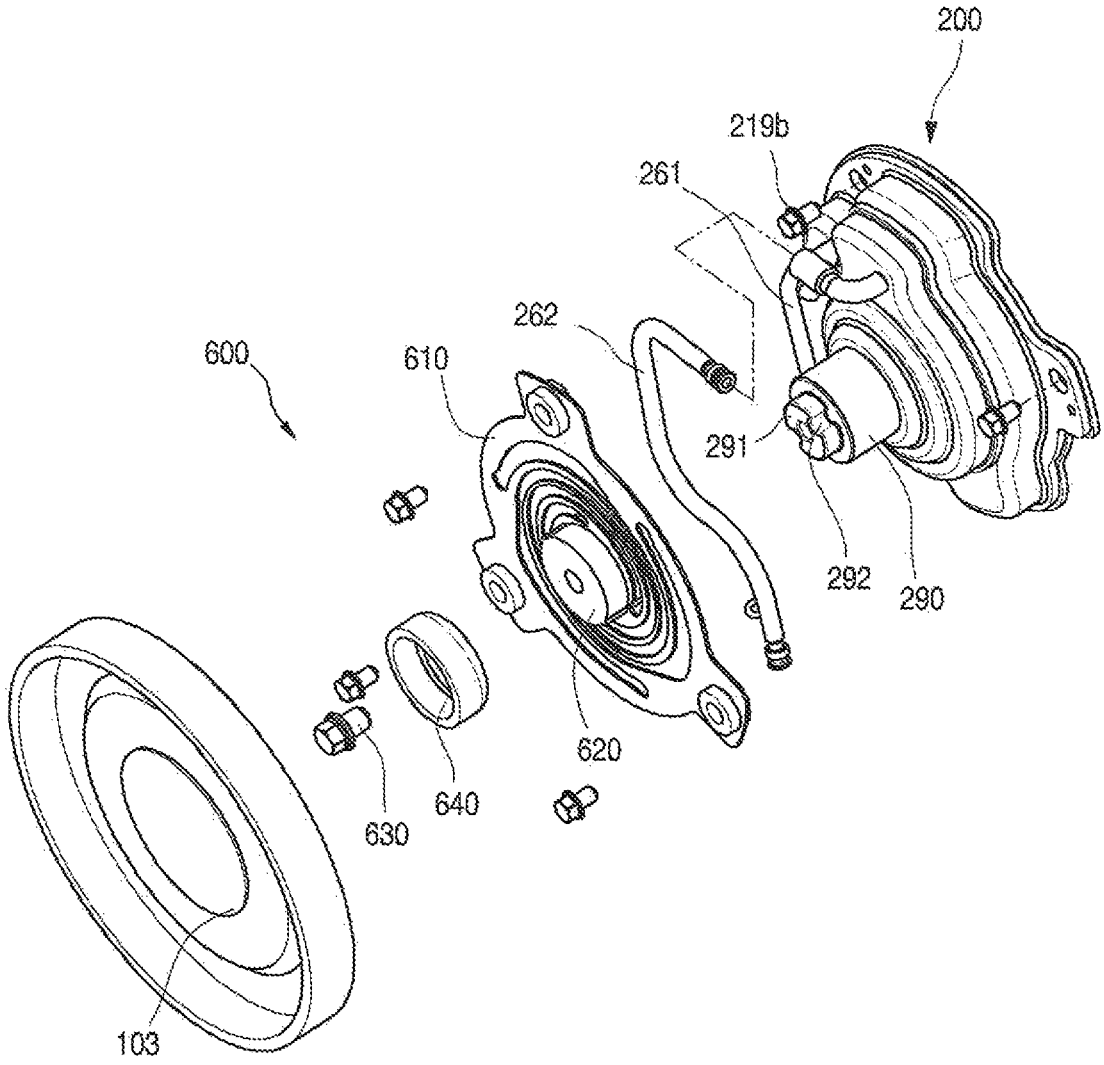
FIG. 23 is an exploded perspective view of a discharge cover, a second support device or support, and a second shell cover when viewed from a front side according to an embodiment.
Figure 24:
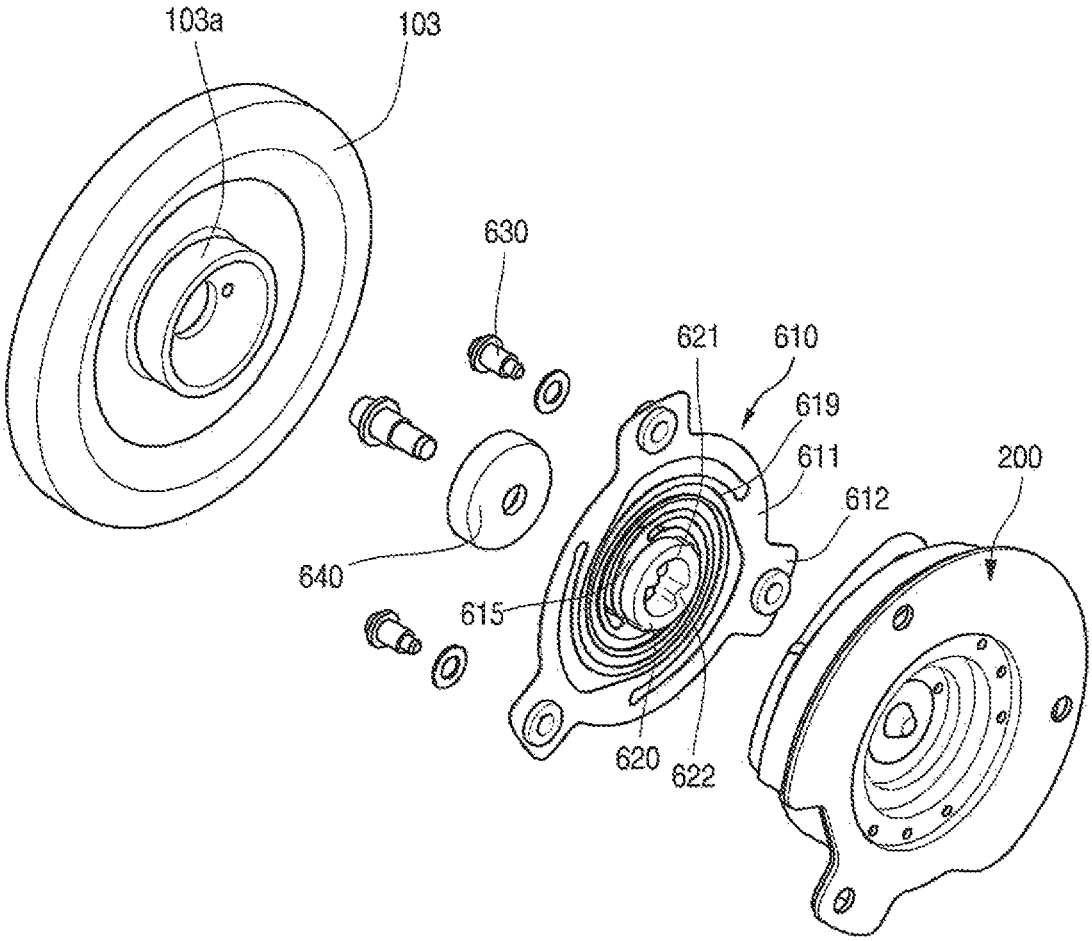
FIG. 24 is an exploded perspective view of the discharge cover, the second support device, and the second shell cover when viewed from a rear side.
Figure 25:
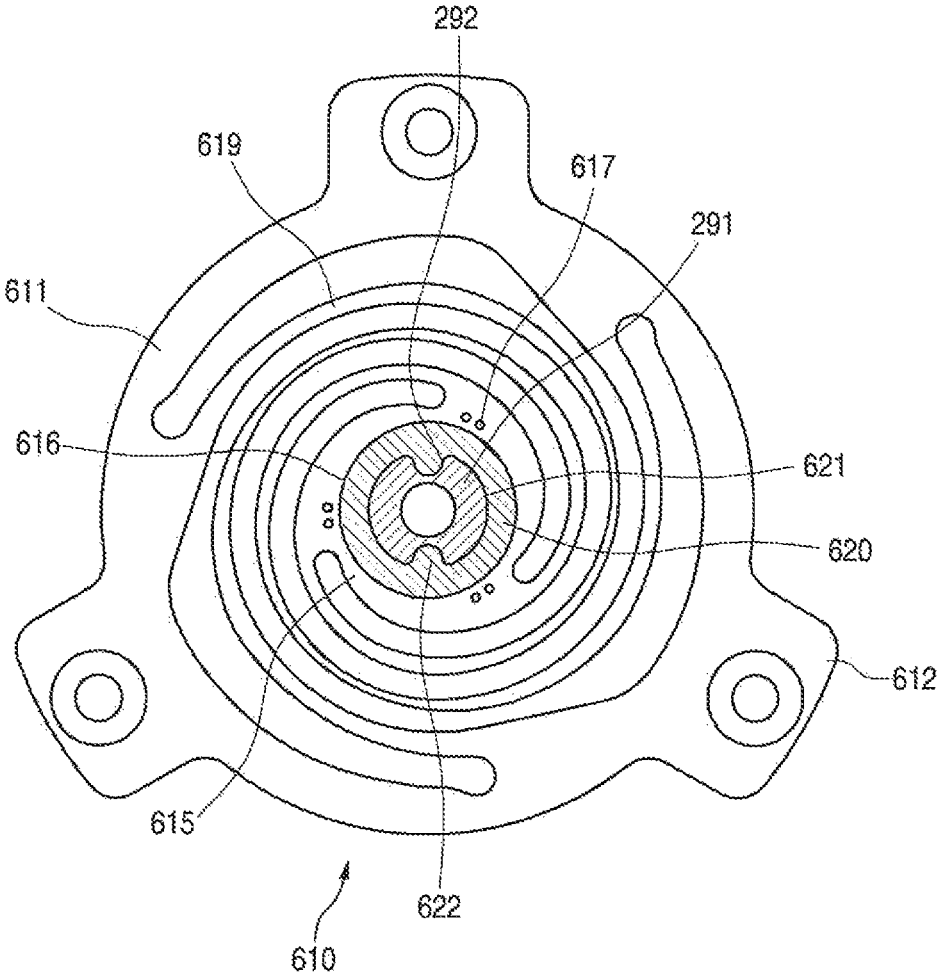
FIG. 25 is a plan view of the second support device according to an embodiment.

FIG. 23 is an exploded perspective view of a discharge cover, a second support device, and a second shell cover when viewed from a rear side according to an embodiment. FIG. 24 is an exploded perspective view of the discharge cover, the second support device, and the second shell cover when viewed from a rear side. FIG. 25 is a plan view of the second support device according to an embodiment.

As illustrated in the drawings, the second support device 600 may be coupled to the shell 101 in a state of being connected to the discharge cover 200 of the compressor body 100. The second support device 600 may include second plate spring 610 that reduces drooping of the compressor body 100 to prevent the compressor body 100 from colliding with the shell. The second support device 600 may further include a second spring connection part or portion 620 connected to the second plate spring 610. The second spring connection part 620 may be coupled to the discharge cover 200. Also, the second support device 600 may further include a second support device coupling member 630 that couples the second spring connection part 620 to the discharge cover 200.

The discharge cover 200 may include a cover protrusion 290 to which the second spring connection part 620 may be coupled. The cover protrusion 290 may be integrated with the discharge cover 200 or coupled to the discharge cover 200. Also, the cover protrusion 290 may include an insertion part or portion 291 inserted into the second spring connection part 620.

In a state in which the insertion part 291 is inserted into the second spring connection part 620, a protrusion 622 may be disposed or provided on an inner circumferential surface 621 of the second spring connection part 620 to prevent the cover protrusion 290 and the second spring connection part 620 from relatively rotating with respect to each other, and a protrusion accommodation groove 292 into which the protrusion 322 may be accommodated may be defined in the cover protrusion 290. Also, the second support device coupling member 630 may be coupled to the insertion part 291 of the cover protrusion 290 inserted into the second spring connection part 620.

The second spring connection part 620 may be integrally formed with the second plate spring 610 through insertion injection molding, for example. The second spring connection part 620 may be made of a rubber material to absorb vibration, for example.

The second plate spring 610 may include an outer rim 611, an inner rim 615, and a connection part or portion 619 having a spiral shape and connecting the outer rim 611 to the inner rim 615. In a state in which the second spring connection part 620 is insertion injection-molded to the second plate spring 610, holes 617 having a same function as the plurality of holes 517 defined in the first plate spring 510 may be defined in the inner rim 615 to prevent the second spring connection part 620 from rotating with respect to the second plate spring 610.

A plurality of fixing parts or portions 612 that extends outward in the radial direction may be disposed or provided on the outer rim 611.

The second support device 600 may further include a washer 640 coupled to the second spring connection part 620 by the second support device coupling member 630. The washer 640 may have one side having an open cylindrical shape.

The second shell cover 103 may include a second stopper 103*a* that restricts movement of the compressor body 100 in the axial direction when the compressor body 100 vibrates in the axial direction to prevent the second plate spring 610 from being deformed and prevent the compressor body 100 from colliding with the shell 101 when the compressor body 100 vibrates in the radial direction.

The second stopper 103*a* may have a cylindrical shape into which the washer 640 is accommodated and be opened toward the washer 640. That is, the washer 640 and the second stopper 103*a* may be disposed so that the open portions thereof face each other. The washer 640 may have an inner diameter less than a diameter of the second stopper 103*a*, and thus, the washer 640 may be accommodated into the stopper 103*a*.

While the compressor body 100 operates, when the compressor body 100 vibrates in the radial direction, the washer 640 may come into contact with an inner circumferential surface of the second stopper 103*a* in a state in which the washer 640 is accommodated into the second stopper 103*a* to restrict movement of the compressor body in the radial direction, thereby preventing the compressor body 100 from colliding with the shell 101. Also, in a state in which the operation of the compressor body 100 is stopped, an open end of the washer 640 may be laterally spaced apart from a facing surface of the second stopper 103*a*. Thus, while the compressor body 100 operates, when the compressor body 100 vibrates in the axial direction, the washer 640 may come into contact with or contact the facing surface of the second stopper 103*a* in the axial direction to restrict movement of the compressor body 100 in the axial direction.

The second support device 600 may be fixed to and mounted on the spring coupling part 101*a* by the second support device coupling member 630 provided on the inner surface of the shell 101. The second spring connection part 620 may be in a state of being seated on the cover protrusion 290. Also, when the second shell cover 103 is mounted on the opening of the shell 101, the washer 640 may be in a state of being inserted into the second stopper 103*a*.

Figure 26:
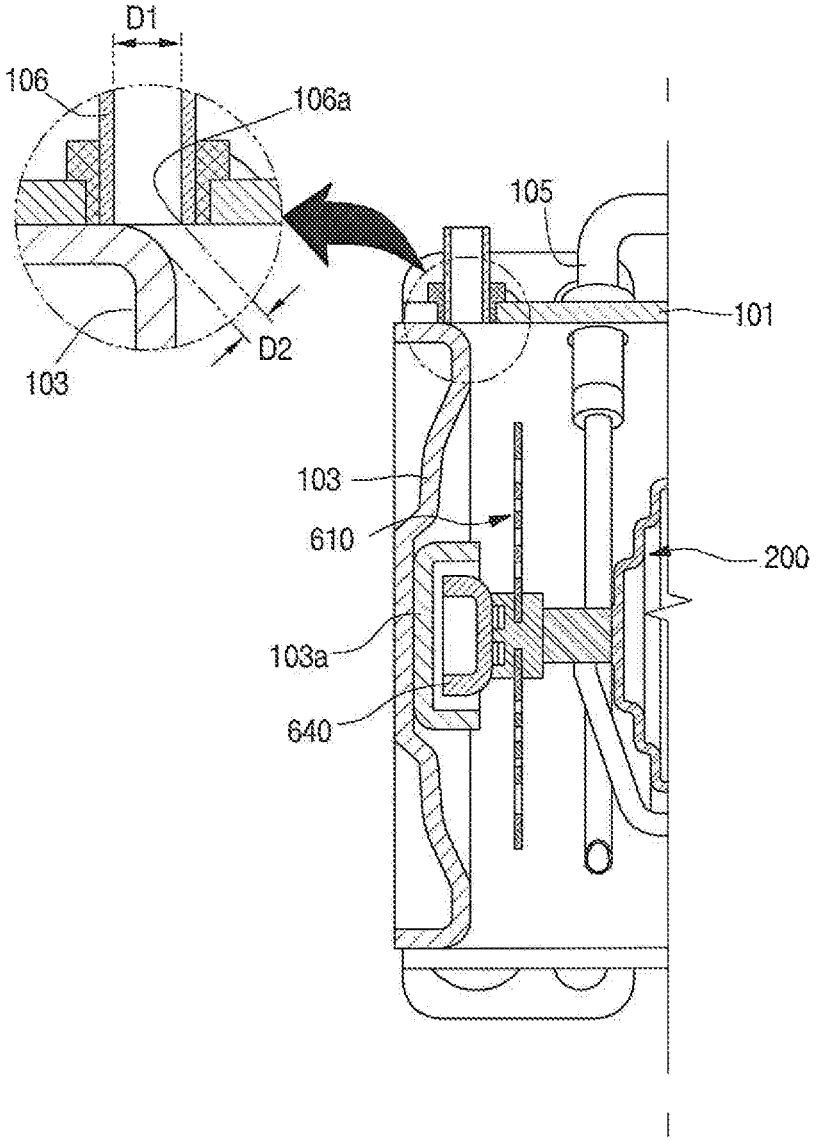
FIG. 26 is a cross-sectional view illustrating an arrangement relationship of a process pipe and the second shell cover according to an embodiment.

FIG. 26 is a cross-sectional view illustrating an arrangement relationship of a process pipe and a second shell cover according to an embodiment. As illustrated in the drawings, when the refrigerant is injected into the shell 101 through a supply opening 106*a* of the process pipe 106 connected to the shell 101, a resistor that separates the refrigerant from oil may be provided in the shell 101 if the oil is contained in the refrigerant.

At least a portion of the second shell cover 103 may be disposed or provided adjacent to the inner circumferential surface of the shell 101, which corresponds to a point at which the process pipe 106 is coupled. That is, at least a portion of the second shell cover 103 may act as a flow resistance of the refrigerant injected through the process pipe 106. That is, the second shell cover 103 may be a resistor that restricts the flow of the refrigerant.

At least a portion of the second shell cover 103 may be disposed or provided to overlap the supply opening 106*a* in a direction in which the refrigerant is supplied from the process pipe 106 so as to allow the second shell cover 103 to act as the flow resistance. Also, to allow the second shell cover 103 to act as the resistance of the refrigerant, a minimum distance between the second shell cover 103 and the supply opening 106*a* has to be less than an inner diameter D1 of the process pipe 106.

A diameter D2 of a supply passage defined by the supply opening 106*a* and the second shell cover 103 may be less than the inner diameter D1 of the process pipe 106. Thus, in view of the passage of the refrigerant, the passage of the refrigerant introduced through the process pipe 106 may have a size that gradually decreases toward the inner space of the shell 101.

The inside of the shell 101 may be in a vacuum-like state. Also, to reduce a time taken to inject the refrigerant, the refrigerant may be injected into the shell 101 when the linear compressor 10 operates. As the inner pressure of the shell 101 is similar to the vacuum, the liquid refrigerant may be naturally vaporized while the liquid refrigerant is injected through the process pipe 106.

In a state in which operation of the linear compressor 10 is stopped, although a portion of the liquid refrigerant is not vaporized while the liquid refrigerant is injected through the process pipe 106, the liquid refrigerant and the oil may be separated from each other by a different in density therebetween within the shell 101. However, when the refrigerant is injected into the shell 101 while the linear compressor 10 operates, if the liquid refrigerant is not vaporized, the liquid refrigerant from which the oil is not separated may flow into the suction muffler 150. Thus, to prevent the oil from flowing into the suction muffler 150 when the refrigerant is injected while the linear compressor 10 operates, the liquid refrigerant has to be quickly and completely vaporized to separate the oil.

According to an embodiment, when the liquid refrigerant is injected through the process pipe 106, the second shell cover 103 may act as the flow resistance of the refrigerant so that the liquid refrigerant is quickly and completely vaporized. Thus, according to an embodiment, the refrigerant may be reduced in pressure while the refrigerant is injected, and thus, the liquid refrigerant may be completely vaporized. In this process, the oil contained in the refrigerant may be separated.

When the oil is separated from the refrigerant, only the refrigerant may be suctioned into the piston 130 to prevent the cylinder nozzle part 125 of the cylinder 120 from being blocked. The liquid oil separated from the refrigerant may be attached to one or more surfaces of the inner circumferential surface of the shell 101, the outer circumferential surface of the second shell cover 103, and the outer circumferential surface of the compressor body 100.

The supply passage may have a diameter D2 which is smaller by about ½ or less than the diameter D1 of the process pipe 106 so that the pressure of the refrigerant is sufficiently reduced. Also, the supply passage may have a passage cross-sectional area which is smaller by about 50% or less than a cross-sectional area of the process pipe 106. If the passage cross-sectional area of the supply passage exceeds about 50% of the passage cross-sectional area of the process pipe 106, the liquid refrigerant may not be vaporized.

Also, the passage cross-section area of the supply passage may be larger by about 30% or more than the cross-sectional area of the process pipe 106. If the passage cross-sectional area of the supply passage is less about 30% than the cross-sectional area of the process pipe 106, the liquid refrigerant may be sufficiently vaporized, or the time taken to inject the refrigerant may significantly increase to deteriorate work efficiency.

Hereinafter, the above-described coupling structure within the compressor will be described according to a position thereof.

Figure 27:
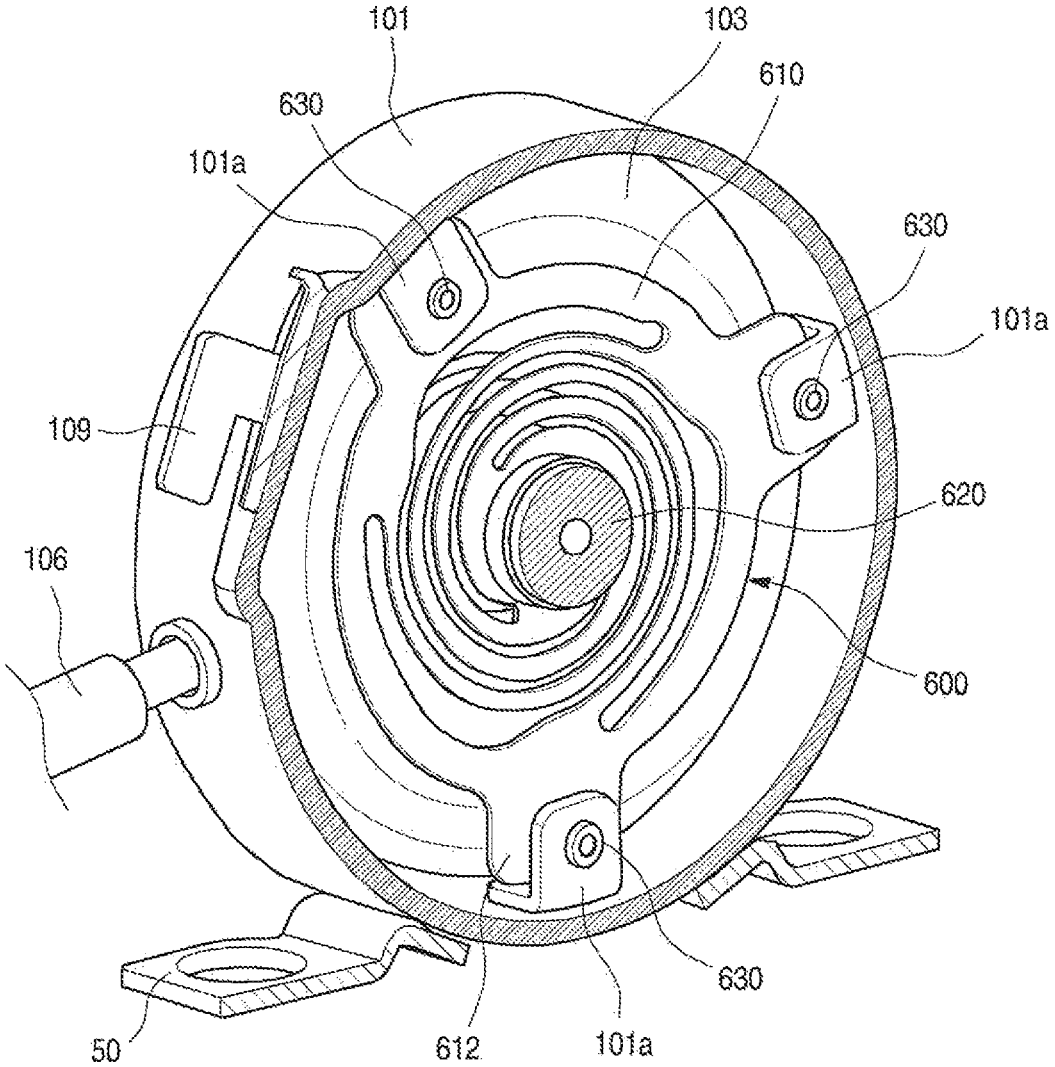
FIG. 27 is a cut-away perspective view taken along line XXVII-XXVII' of FIG. 1.

FIG. 27 is a cut-away perspective view, taken along line XXVII-XXVII' of FIG. 1. As illustrated in the drawing, the second support device 600 may be fixed to and mounted on the spring coupling part 101*a* provided inside of the shell 101 by the second support device coupling members 630. The second support device coupling members 630 may be circularly arranged at the same interval at an angle of about 120° around a center of the second support device 600. The second support device coupling members 630 may be circularly arranged at the same angle.

Three connection parts having the spiral shape of the second plate spring 610 forming the second support device 600 may be provided, and the connected points may be circularly arranged at the same interval. Also, the washer 640 mounted on the second spring connection part 519 may be in a state of being accommodated into the second stopper 103*a*. Thus, a load transmitted to the second support device 600 may be uniformly dispersed, and the second support device 600 may support the compressor body 100 while being maintained in balance.

Figure 28:
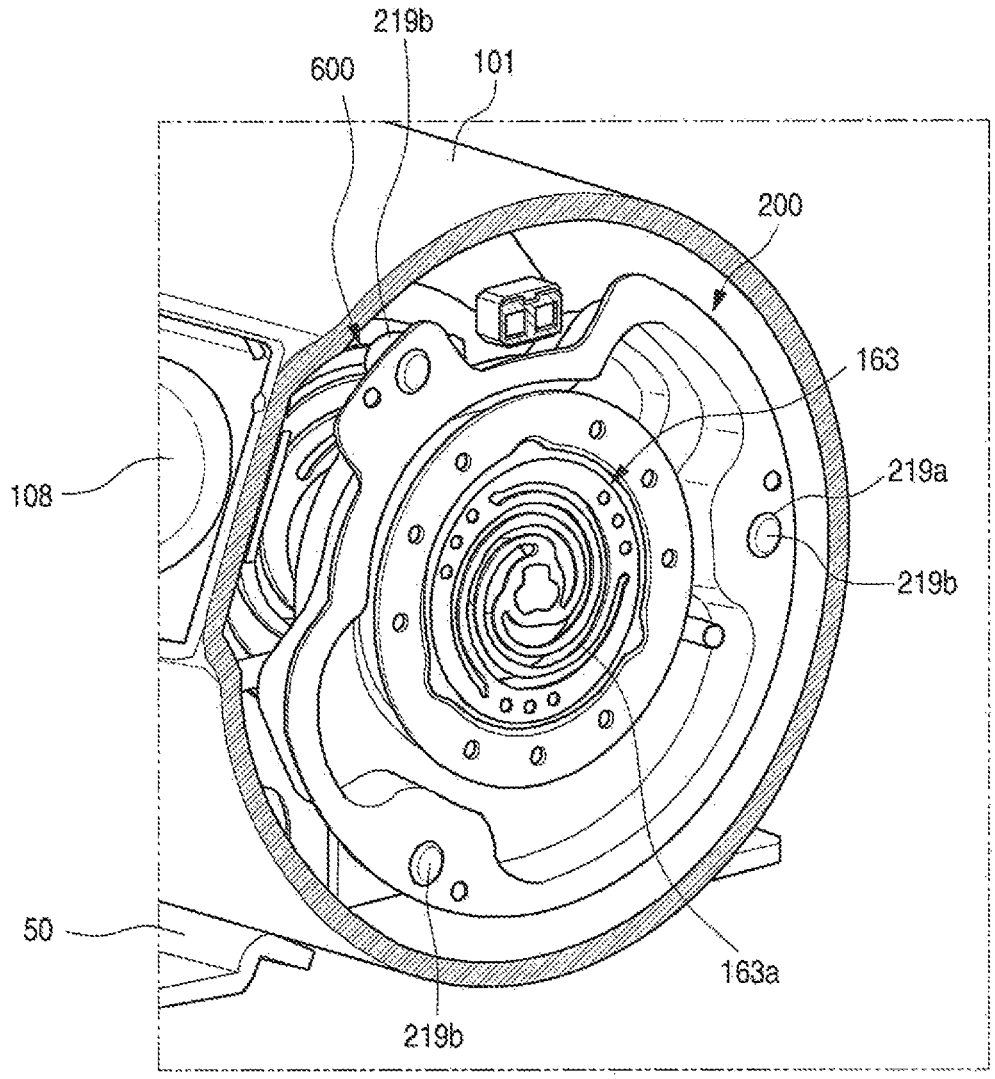
FIG. 28 is a cross-sectional view taken along line XXVIII-XXVIII' of FIG. 1.
Figure 29:
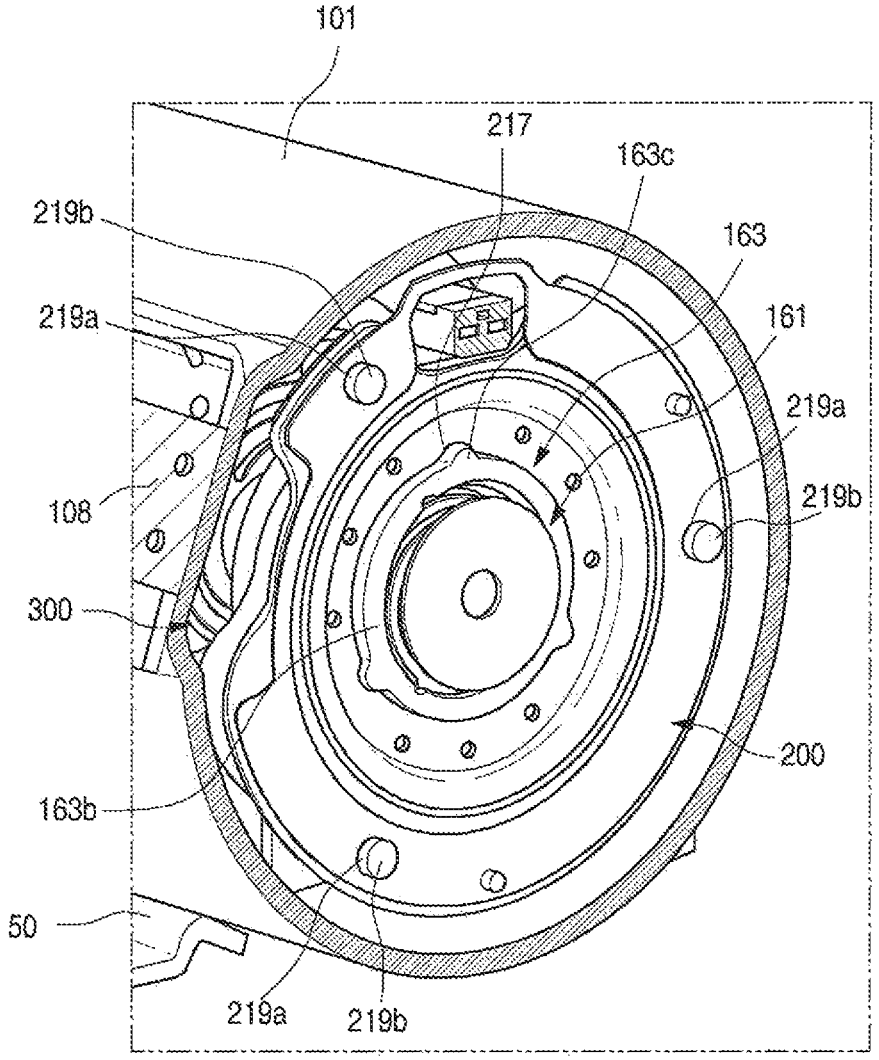
FIG. 29 is a cross-sectional view taken along line XXIX-XXIX' of FIG. 1.

FIG. 28 is a cross-sectional view, taken along line XXVIII-XXVIII' of FIG. 1. FIG. 29 is a cross-sectional view, taken along line XXIX-XXIX' of FIG. 1.

As illustrated in the drawings, the discharge cover 200 may be fixed to the frame 110 by the discharge cover coupling member 219*b*. The discharge cover 200 may have a plurality of partitioned spaces in which the compressed refrigerant may be accommodated. The discharge cover coupling member 219*b* may not pass through the inner space of the discharge cover 200, but extend to outside to pass through a portion closely attached to the frame 110 and thus be coupled to the frame 110.

The three discharge cover coupling members 219*b* may be circularly arranged at the same interval at an angle of about 120° around a center of the discharge cover 200. Thus, the discharge cover 200 may be stably fixed to and mounted on the frame 110 to prevent deformation from occurring when the discharge cover 200 is coupled and uniformly disperse a load occurring during operation of the compressor 10.

Also, the spring assembly 163 may be provided inside of the discharge cover 200 to elastically support the discharge valve 161. Thus, when the pressure of the compressed refrigerant, which is applied to the discharge valve 161, reaches a preset or predetermined pressure, the spring assembly 163 may be elastically deformed to move backward and open the discharge valve 161.

The spring assembly 163 may include valve spring 163*a* formed by three spiral connection parts and spring rim 163*b* disposed or provided on a circumference of the valve spring 163*a*. Also, three first protrusions 163*c* may be circularly arranged on the spring rim 163*a* at the same interval and combined with the recess parts 217 within the discharge cover 200. Thus, the spring assembly 163 may not rotate to the inside of the discharge cover 200, but be stably fixed to and mounted.

Figure 30:
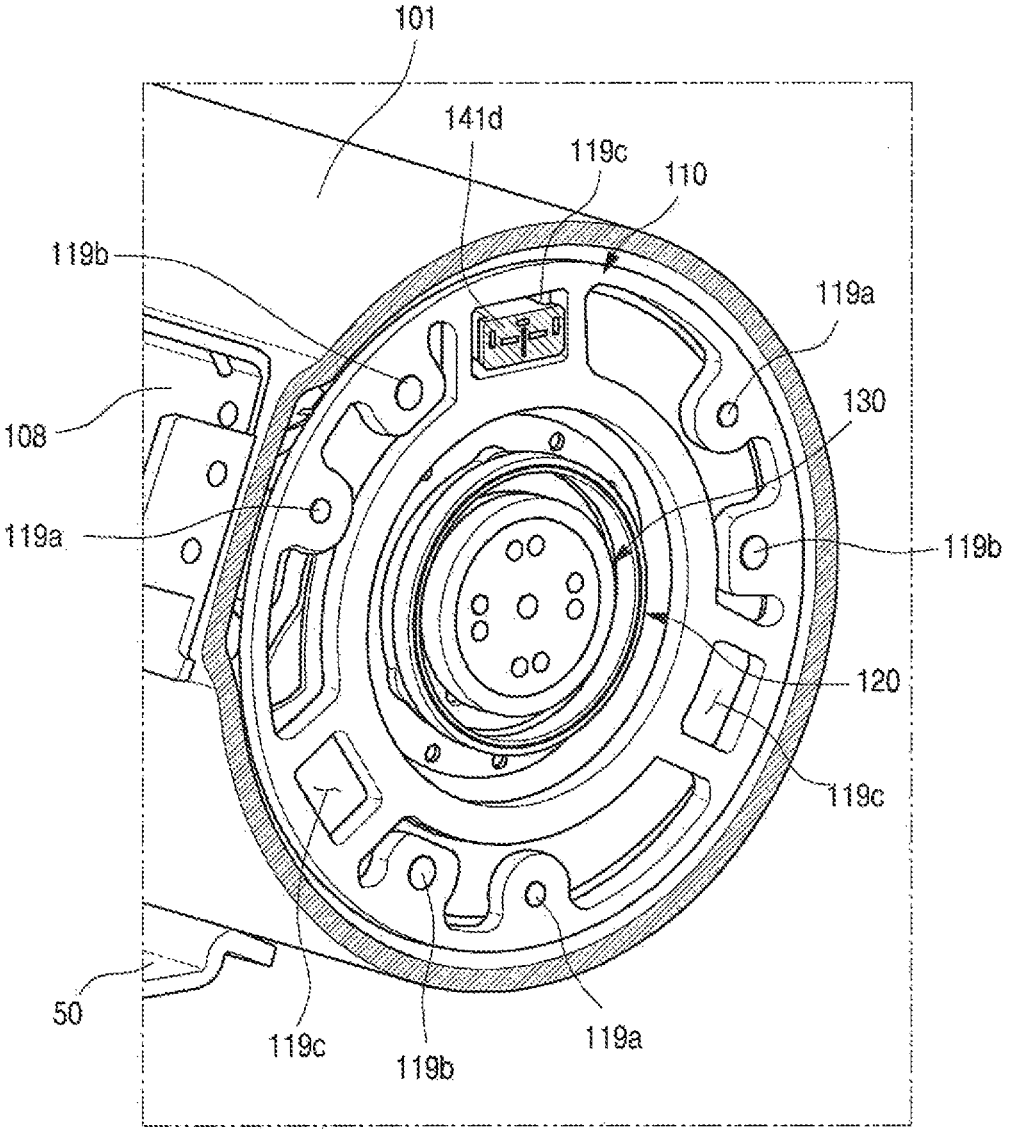
FIG. 30 is a cross-sectional view taken along line XXX-XXX' of FIG. 1.

FIG. 30 is a cross-sectional view, taken along line XXX-XXX' of FIG. 1. As illustrated in the drawing, the cylinder 120 and the piston 130 may be disposed at the center of the frame 110. Also, three first coupling holes 119*a*, the second coupling holes 119*b*, and three terminal insertion parts 119*c* may be circularly arranged in the circumferential direction of the frame flange 112.

The three first coupling holes 119*a* coupled to the cover coupling member 149*a* may be circularly arranged at an angle of about 120° around the center of the frame 110. Also, the three second coupling holes 119*b* coupled to the discharge cover coupling member 219*b* may be circularly arranged at an angle of about 120° around the center of the frame 110. Also, the terminal insertion parts 119*c* may be circularly arranged at an angle of about 120° around the center of the frame 110.

Thus, the second coupling holes 119*b* and the terminal insertion parts 119*c* may be disposed in a space between the first coupling holes 119*a*. Also, the first coupling holes 119*a* and the terminal insertion parts 119*c* may be circularly arranged at positions that rotate at an angle of about 60°, and the second coupling holes 119*b* may be disposed between the first coupling hole 119*a* and the terminal insertion part 119*c*.

As described above, the first coupling holes 119*a*, the second coupling holes 119*b*, and the terminal insertion parts 119*c* may be successively arranged on the frame flange 112 in the circumferential direction. Thus, the overall balance of the frame flange 112 may be maintained, and stress occurring when the frame 110 is assembled or a load occurring when the compressor operates may be uniformly transmitted to maintain a stable state.

Figure 31:
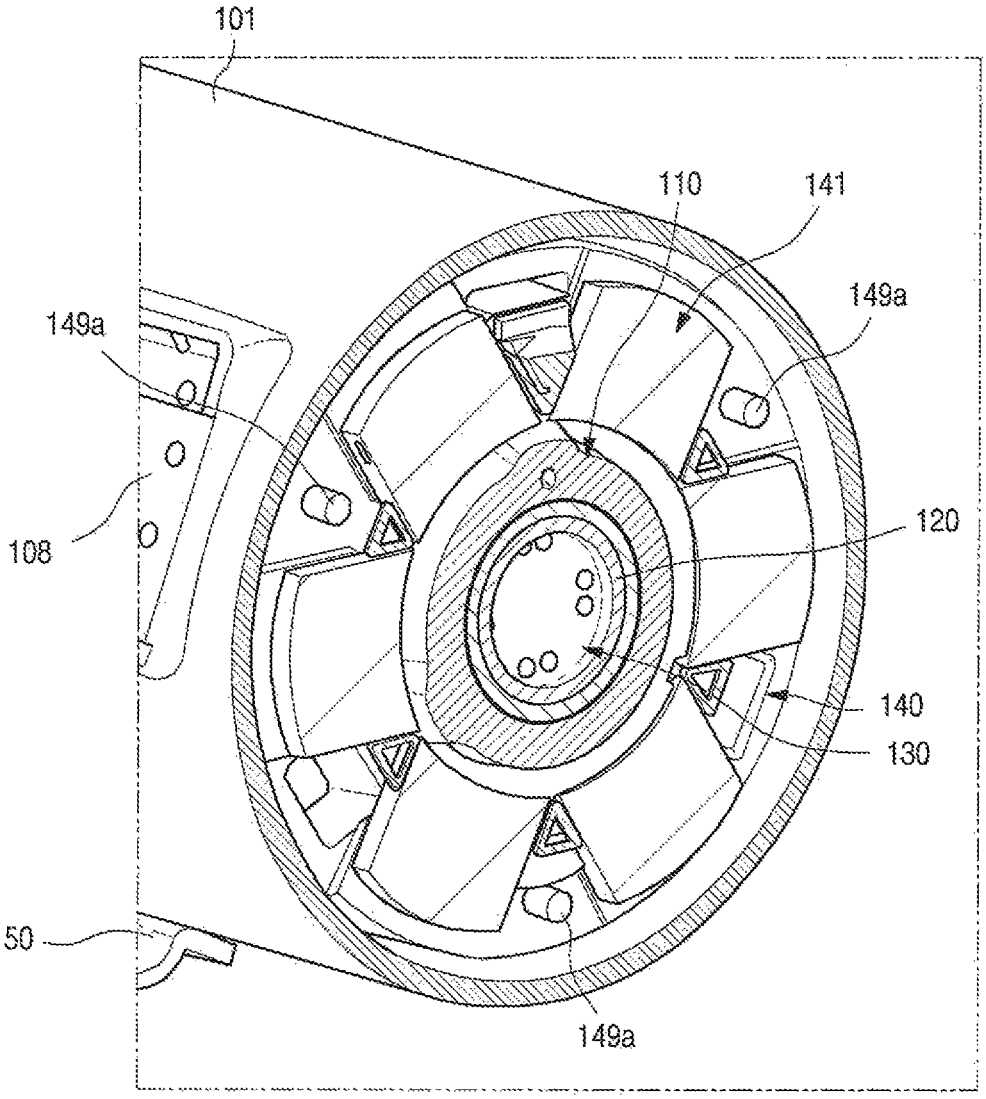
FIG. 31 is a cross-sectional view taken along line XXXI-XXXI' of FIG. 1.

FIG. 31 is a cross-sectional view, taken along line XXXI-XXXI' of FIG. 1. As illustrated in the drawing, the six stator cores 141*a* may be circularly arranged at the same interval outside of the frame body 111. Also, the stator cores 141*a* may be spaced the same interval from each other. For example, the stator cores 141*a* may be circularly arranged at an angle of 60° around a center of the motor assembly 140.

The cover coupling member 149*a* connecting the frame 110 to the stator cover 300 may be disposed in a space between the stator cores 141*a*. Thus, the three cover coupling members 149*a* may extend to cross the three spaces of the spaces defined by the six stator cores 141*a*.

The terminal insertion parts 119*c* may be provided in the frame 110 at positions corresponding to the spaces between the rest of the three stator cores 141*a* except for the space between the stator cores 141*a* in which the cover coupling member 149*a* is disposed. That is, the terminal insertion parts 119*c* may be circularly arranged to continue the cover coupling member 149*a* with the stator core 141*a* therebetween.

Figure 32:
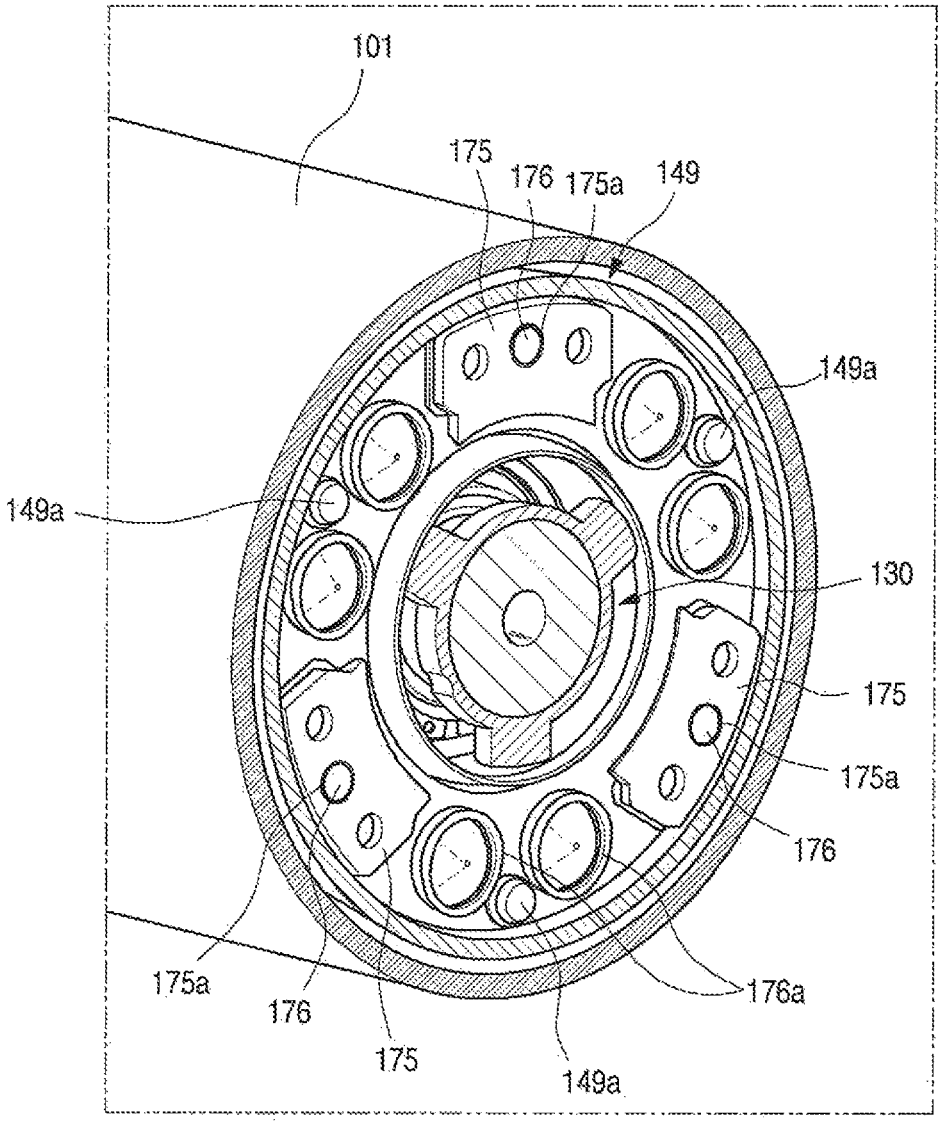
FIG. 32 is a cross-sectional view taken along line XXXII-XXXII' of FIG. 1.
Figure 33:
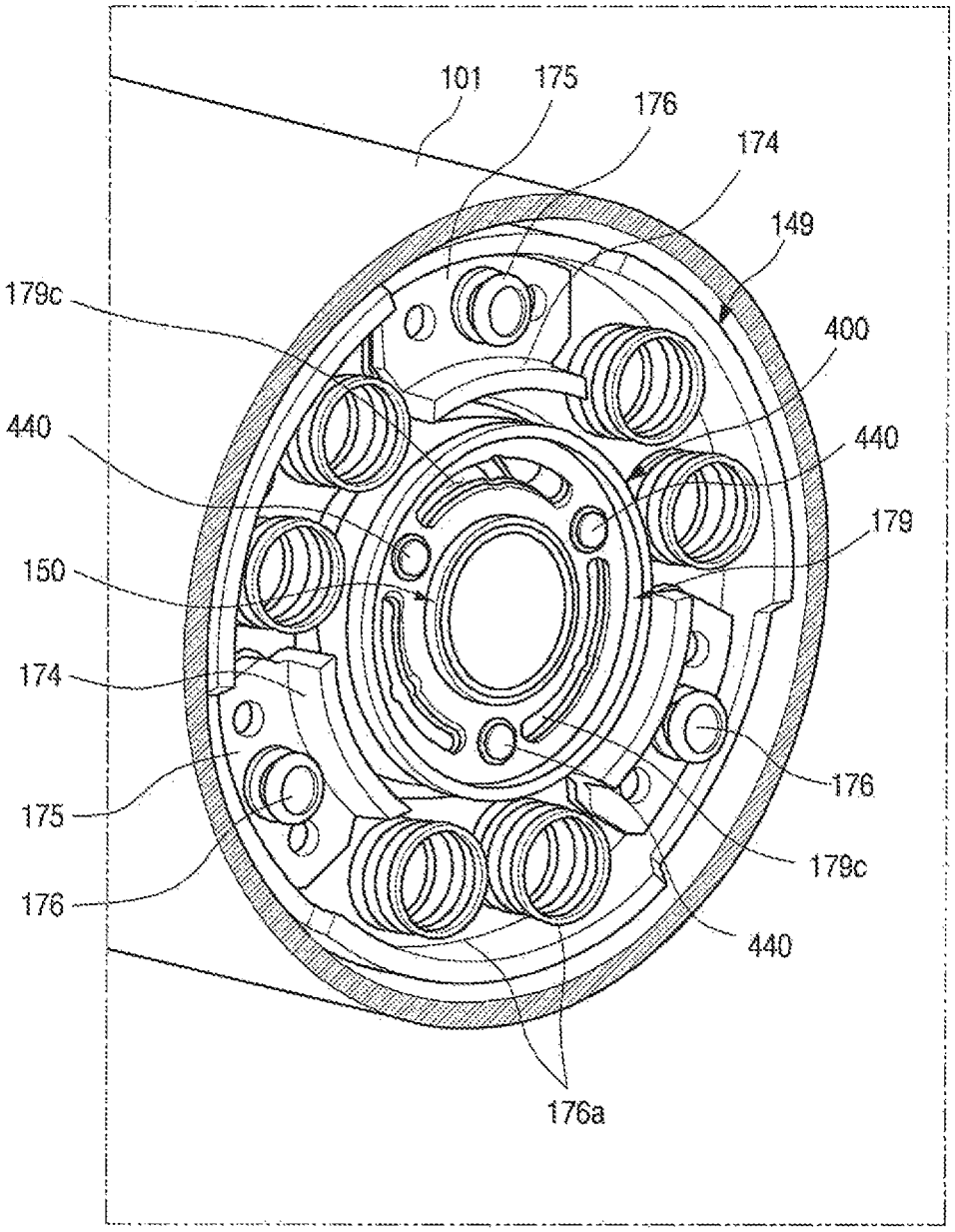
FIG. 33 is a cross-sectional view taken along line XXXIII-XXXIII' of FIG. 1.
Figure 34:
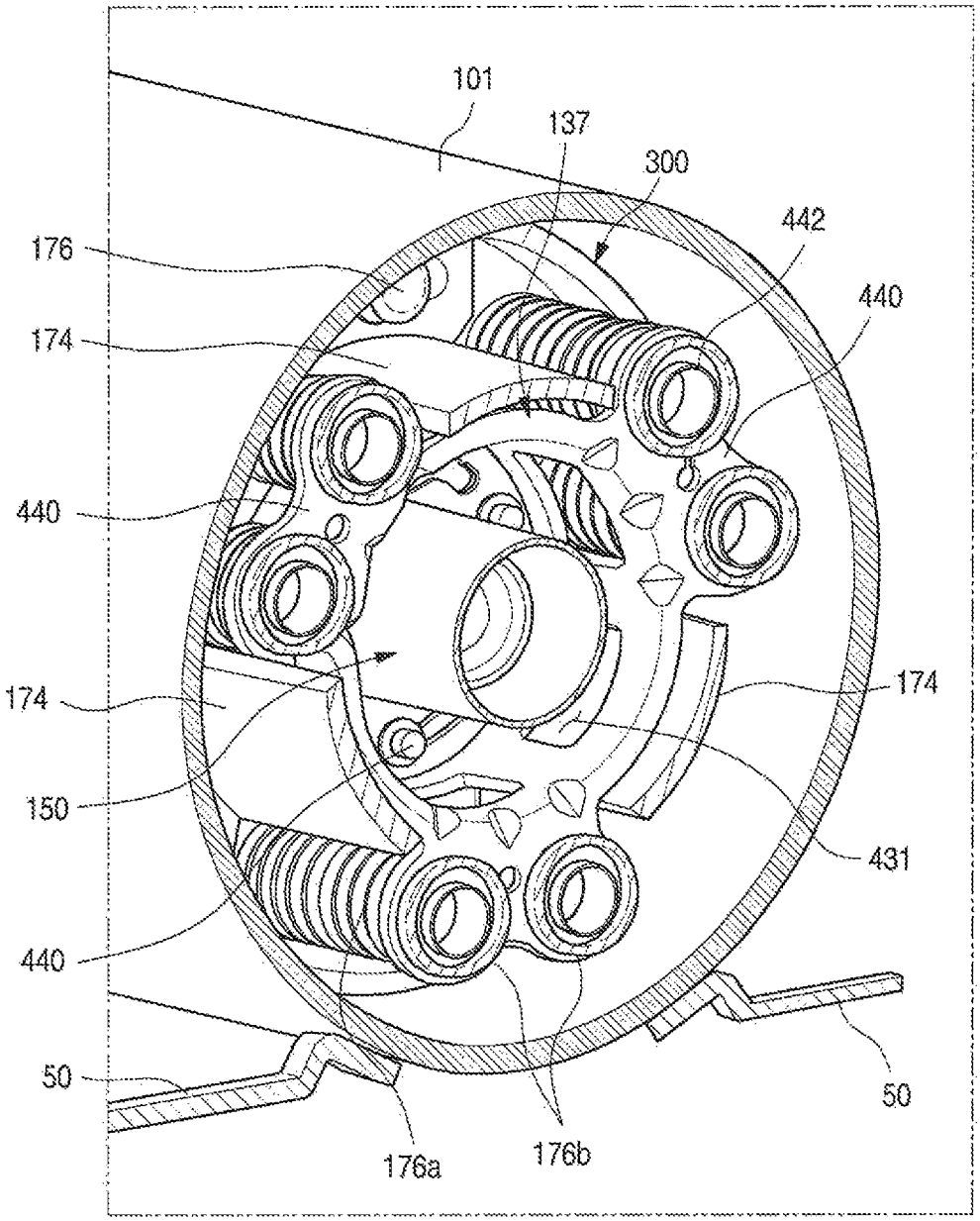
FIG. 34 is a cross-sectional view taken along line XXXIV-XXXIV' of FIG. 1.

FIG. 32 is a cross-sectional view, taken along line XXXII-XXXII' of FIG. 1. FIG. 33 is a cross-sectional view, taken along line XXXIII-XXXIII' of FIG. 1. FIG. 34 is a cross-sectional view taken, along line XXXIV-XXXIV of FIG. 1.

As illustrated in the drawings, the cover coupling member 149*a* may be coupled to the stator cover 300, and the rear cover 170 may be coupled to the stator cover 300 by the rear cover coupling member 176. The stator cover 300 may be configured to support the resonant springs 176*a* and 176*b*.

The third coupling holes 311 to which the cover coupling member 149*a* may be coupled may be circularly arranged at an angle of about 120° around the center of the stator cover 300. The leg coupling part 175 of the rear cover 170 may be disposed in a space between the cover coupling members 149*a*. The rear cover coupling member 176 passing through the leg coupling part 175 may be coupled.

The cover coupling member 149*a* and the rear cover coupling member 176 may be circularly arranged at an angle of about 60°. Thus, the cover coupling member 149*a* and the rear cover coupling member 176 may be alternately successively coupled along the circumference of the stator cover 300.

The pair of resonant springs 176*a* and 176*b* may be disposed between the coupling legs 174, and all six resonant springs 176*a* and 176*b* may be circularly arranged. Thus, the coupling leg 174 may extend to a space between the resonant springs 176*a* and 176*b*.

Also, the support 400 may be provided in the inner space of the rear cover 170, and the balance weight 179 may be provided on the inner surface of the support 400. The three weight holes 179*a* and three second front holes 179*c* may be defined in the balance weight 179 and be circularly arranged at the same interval around the center of the support 400. Also, the support coupling member 460 may be coupled to each of the weight holes 179*a*, and the balance weight 179 may be mounted on the support 400 and simultaneously coupled to the magnet frame 110 and the piston 130.

Thus, the balance weight 179, the magnet frame 110, and the piston 130, which are coupled to the support 400, in addition to the support 400 may be stably coupled at the same interval to maintain the weight balance. Also, stress occurring when the support coupling member 460 is coupled and a load occurring when the compressor 10 operates may be uniformly dispersed to maintain the overall balance.

The rear end of the first resonant spring 176*a* and the front end of the second resonant spring 176*b* may be supported by the spring support part 440 extending to the outside of the support 400. The spring support part 440 may extend to pass through the space between the coupling legs 174 inside of the rear cover 170. Also, the three spring support parts 440 may be circularly arranged at the same interval to uniformly disperse a load transmitted by the resonant springs 176*a* and 176*b*. Thus, a side force generated during operation of the compressor 10 may be maximally suppressed.

Figure 35:
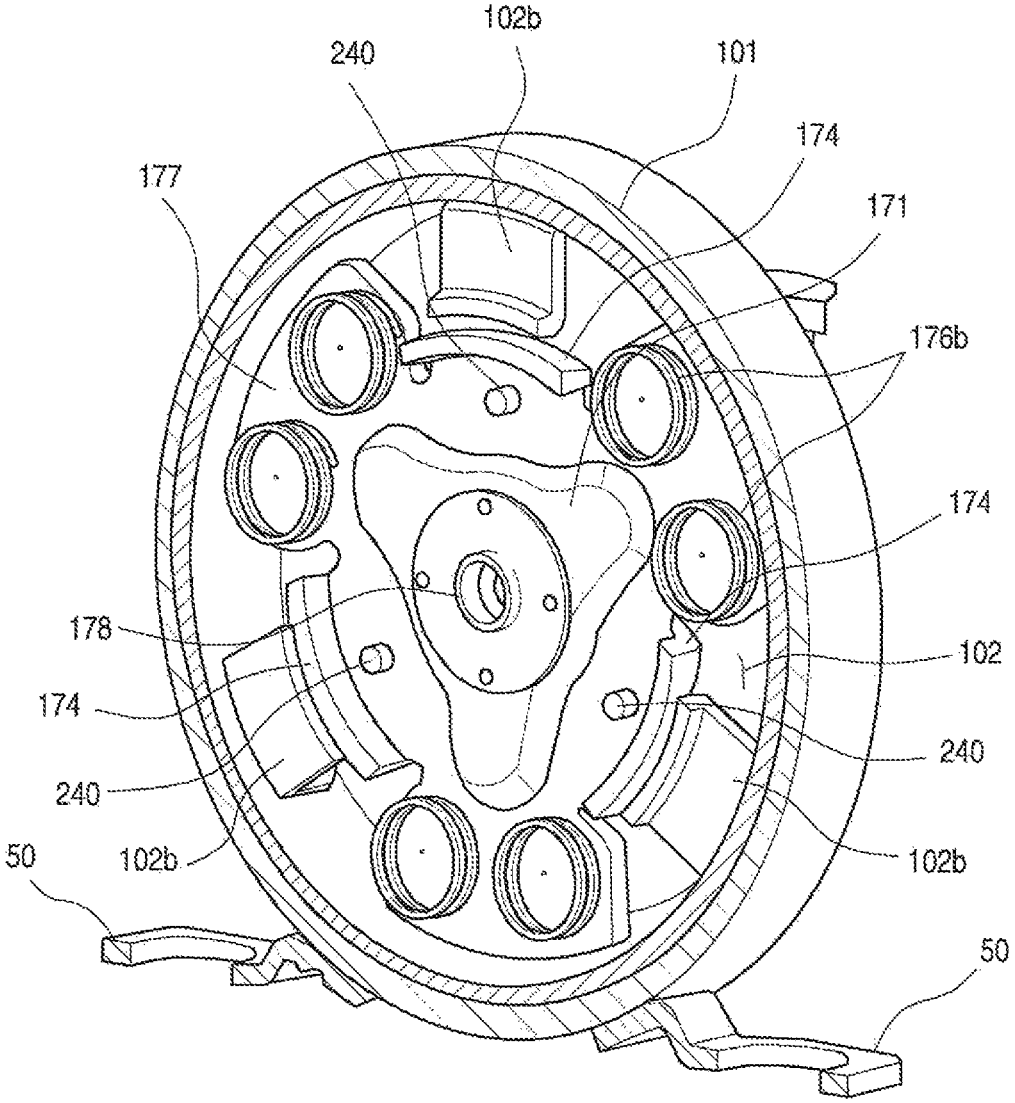
FIG. 35 is a cross-sectional view taken along line XXXV-XXXV' of FIG. 1.
Figure 36:
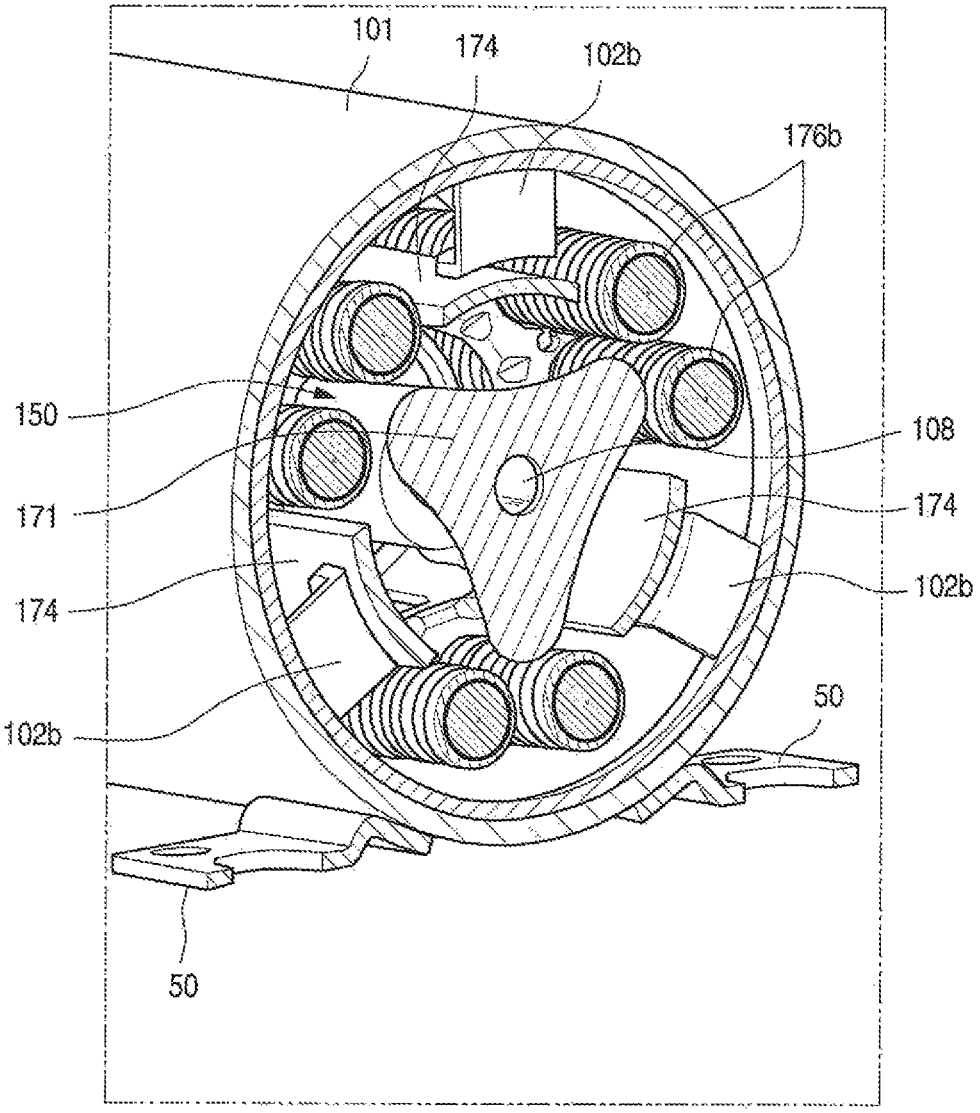
FIG. 36 is a cross-sectional view taken along line XXXVI-XXXVI' of FIG. 1.
Figure 37:
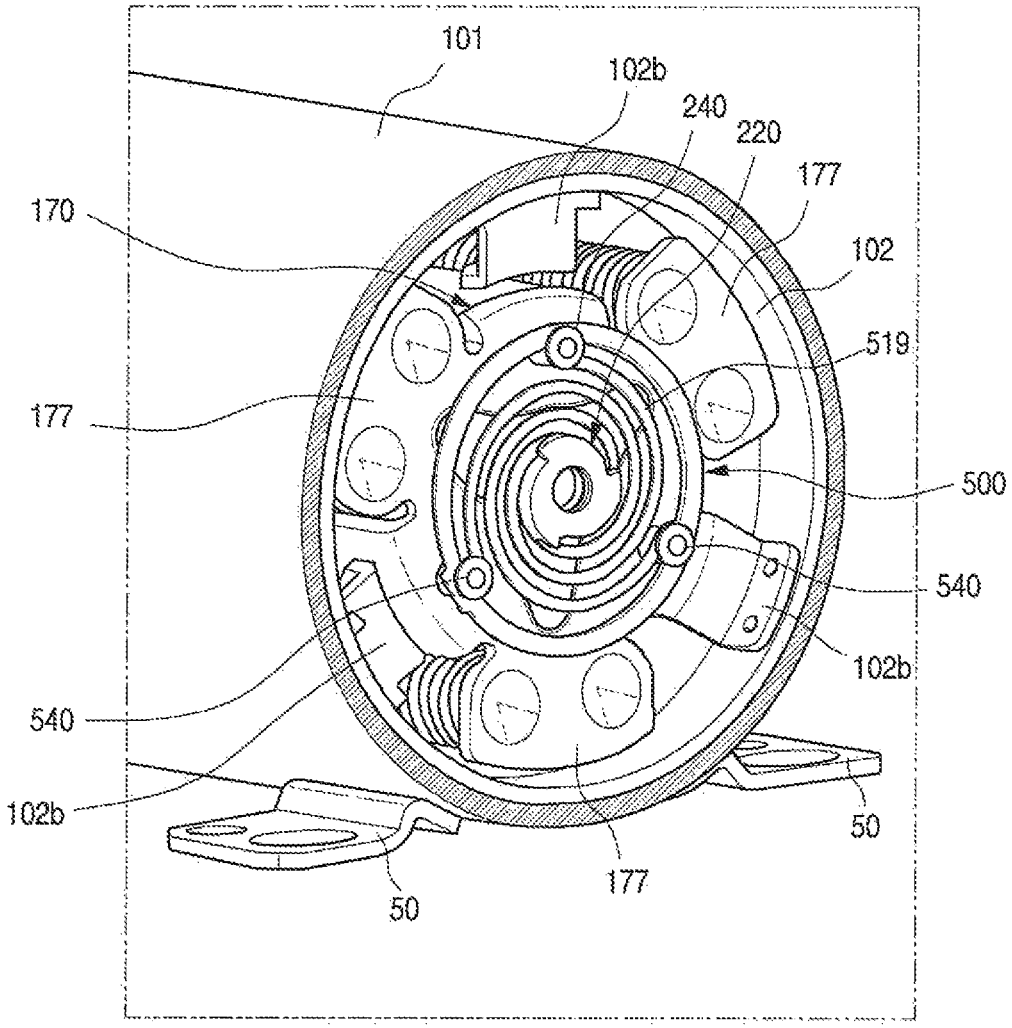
FIG. 37 is a cross-sectional view taken along line XXXVII-XXXVII' of FIG. 1.

FIG. 35 is a cross-sectional view taken along line XXXV-XXXV' of FIG. 1. FIG. 36 is a cross-sectional view, taken along line XXXVI-XXXVI' of FIG. 1. FIG. 37 is a cross-sectional view, taken along line XXXVII-XXXVII' of FIG. 1.

As illustrated in the drawings, the second resonant spring 176*b* may be supported by the cover-side seating part 177. The cover-side seating part 177 may protrude outward from the cover body 171 and extend from three points spaced the same interval from each other to stably support the second resonant spring 176*b*.

The coupling legs 174 may also be bent forward from the three points, and the first stoppers 102*b* may be disposed at positions corresponding to the coupling legs 174. The first stoppers 102*b* may be disposed at three points which are spaced the same interval from each other with respect to the center of the shell 101.

The rear cover coupling member 176 may be disposed between the cover-side seating parts 177 on which the second resonant spring 176*b* is disposed. Thus, the rear cover coupling member 176 may be coupled to position except for points at which a load is applied by the second resonant spring 176*b*, and thus, stress occurring when assembled and the load occurring when the compressor operates may be uniformly maintained along the circumference of the rear cover 170.

The recess part 171*a* may be defined in the inner surface of the rear cover 170, and a suction induction tube 178 may be provided in a center of the recess part 171*a*. The suction induction tube 178 may be disposed or provided at a center of the recess part 171*a*, that is, a center of the shell 101. Also, the recess part 171*a* may partially extend toward the resonant springs 176*a* and 176*b*. Also, three portions of the recess part 171*a* may extend toward the resonant springs 176*a* and 176*b*.

The first support device 500 may be coupled to the rear surface of the rear cover 170 by the first spring coupling member 540. The first spring coupling member 540 may space the first support device 500 from the rear cover 170 by a predetermined distance. The first support device 500 may be formed by the first plate spring 510 including the plurality of spiral connection parts 519 to reduce vibration and noise occurring during the operation of the compressor 10.

Figure 38:
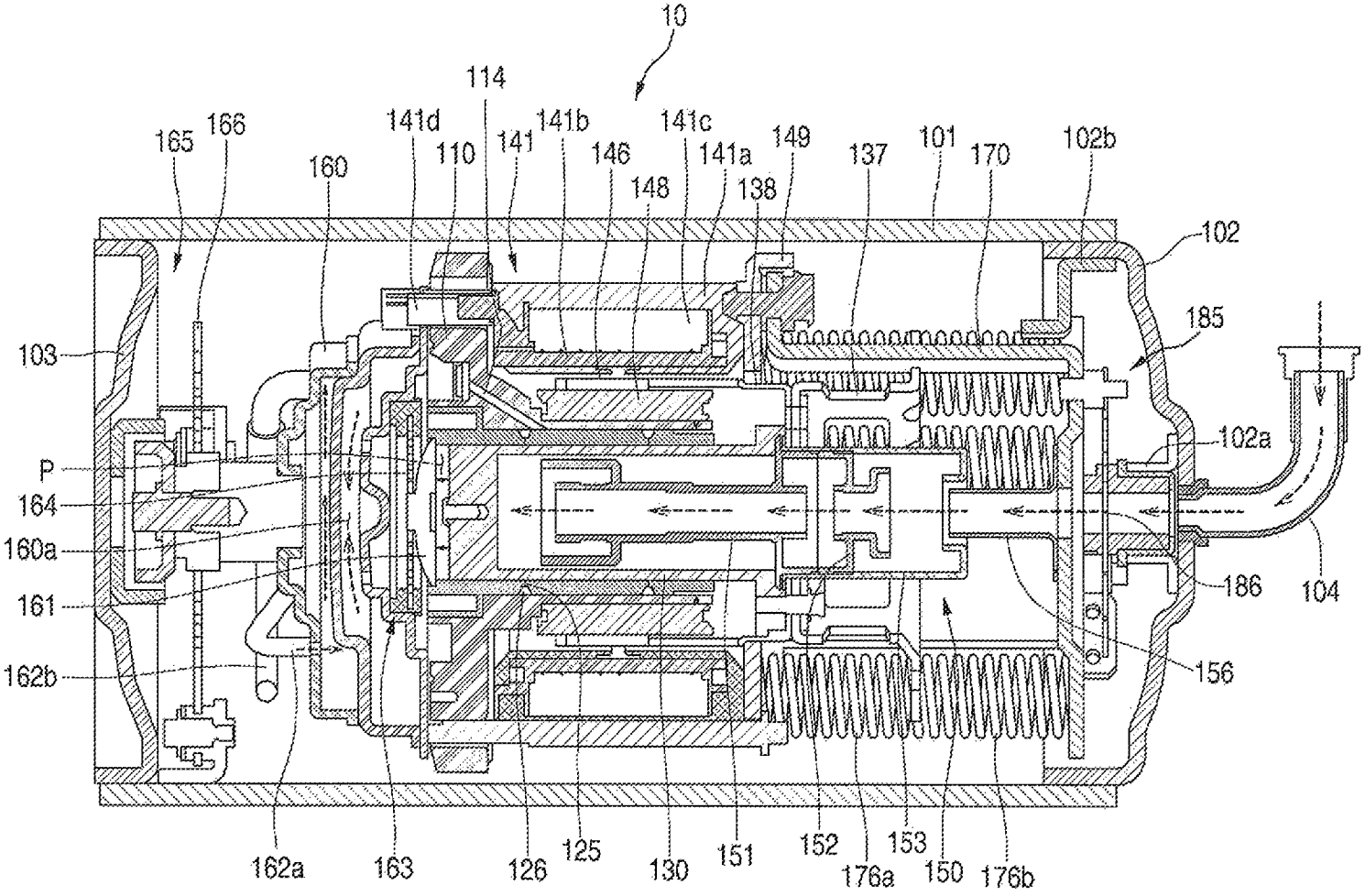
FIG. 38 is a cross-sectional view illustrating a state in which a refrigerant flows in the compressor according to an embodiment.

FIG. 38 is a cross-sectional view illustrating a state in which a refrigerant flows in the compressor according to an embodiment. As illustrated in the drawing, a refrigerant flow in the linear compressor 10 according to an embodiment will be described. The refrigerant suctioned into the shell 101 through the suction pipe 104 may be introduced into the piston 130 via the suction muffler 150. The piston 130 reciprocates in the axial direction by the driving of the motor assembly 140.

When the suction valve 135 coupled to the front side of the piston 130 is opened, the refrigerant may be introduced into the compression space P and then be compressed. When the discharge valve 161 is opened, the compressed refrigerant may be introduced into the discharge space of the discharge cover 200.

The refrigerant introduced into the discharge space may flow from the first space part 210*a* to the second space part 230*a* within the discharge cover 200, and the refrigerant within the second space part 230*a* may be introduced into the third space part 250*a* through the connection pipe 260. The refrigerant within the third space part 250*a* may be discharged from the discharge cover 200 through the loop pipe 262 and then discharged to the outside of the linear compressor 10 through the discharge pipe 105.

A linear compressor according to embodiments disclosed herein may have the following advantages.

According to embodiments disclosed herein, each of the first and second support devices, the discharge cover, the support, the stator cover, and the rear cover, which are provided in the cylindrical shell to form the main body of the compressor, may be supported and coupled at three points. Thus, when the components are coupled to each other, the components may be coupled at the same interval to prevent stress from being partially concentrated when coupled.

Further, for realizing the above-described coupling structure, each of the components may be coupled at the three points having the same distance therebetween in the same coupling structure. Thus, the components may be symmetric and harmonic in overall shape to each other to realize the balance in overall weight. Therefore, the balance of the main body of the compressor may be maintained even when the compressor is driven, and thus, occurrence of noise and vibration may be minimized.

Furthermore, the plurality of coupling members coupled to the support and the stator cover may be circularly arranged at the same interval to prevent the coupling members from interfering with each other, thereby improving the assembly workability and productivity. In addition, an additional structure for avoiding interference may be omitted to realize a compact structure. More particularly, as the support structures of the resonant springs as well as the plurality of coupling members are disposed at a predetermined distance in the circumferential direction of the support and the stator cover, the overall space of the support and the stator cover may be provided as the coupling structure to provide the more compact and balanced coupling structure.

Also, as the resonant springs are circularly arranged around the axial direction of the compressor, the compressor may be reduced in length while maintaining the stiffness thereof using the plurality of resonant springs to realize the more compact compressor. The resonant springs may be circularly arranged at the same interval at the three points, and the pair of resonant springs may be provided at each of the points to suppress the side force while maintaining suitable stiffness for resonance, thereby improving operation stability and reliability.

Embodiments disclosed herein provide a linear compressor which is capable of being improved in operation stability and reliability by maintaining a balance through three-point coupling and support structures of components of a main body within the compressor having a cylindrical shape. Embodiments disclosed herein also provide a linear compressor in which a plurality of resonant springs is circularly arranged to realize the compressor having a compact size. Embodiments disclosed herein further also provide a linear compressor in which a plurality of resonant springs is circularly arranged at the same interval to minimize a side force.

Embodiments disclosed herein additionally provide a linear compressor in which, when components of a main body within a shell are assembled, coupling members are circularly arranged to prevent the components from interfering with each other, thereby improving productivity and workability.

Embodiments disclosed herein provide a linear compressor that may include a shell having a cylindrical shape; a shell cover that covers both opened ends of the shell; a cylinder accommodated into the shell and defining a compression space for a refrigerant; a piston that reciprocates within the cylinder in an axial direction to compress the refrigerant within the compression space; a motor assembly including a motor that provides power to the piston and a stator cover that supports the motor; and resonant springs seated on the stator cover and supporting the piston to allow the piston to perform a resonant motion. The resonant springs may be circularly arranged at three points having a same interval around a center in an axial direction. A pair of resonant springs may be disposed in parallel at each of the three points.

The linear compressor may further include a rear cover coupled to the stator cover at a rear side of the stator cover and supporting the other end of each of the resonant spring. The rear cover may include a cover body disposed or provided at the rear side of the stator cover, and three coupling legs bent from an edge of the cover body to pass through a space between the resonant springs and extend to the stator cover. A rear cover coupling member passing through the coupling legs and coupled to the stator cover to couple the coupling legs to the stator cover may be disposed or provided on an end of each of the coupling legs.

The linear compressor may further include a frame which may be provided in the shell and on which the cylinder may be mounted, the frame being coupled to the motor assembly. Three cover coupling members connecting the frame to the stator cover may be provided, and the cover coupling members may be circularly arranged at three points having a same interval around the center in the axial direction. The rear cover coupling member may be coupled between cover coupling members of the stator cover. The cover coupling members may cross spaces between the plurality of stator cores defining the outside of the motor assembly to extend up to the frame.

A circumference of the stator cover may include a first circumferential part or portion that extends from a position corresponding to each of the resonant springs to cover a lower end of the resonant spring, and a second circumferential part or portion that extends from a position corresponding to each of the coupling leg between the first circumferential parts at a height less than that of each of the first circumferential parts so that a lower end of the coupling leg is exposed. A cover-side seating part or seat that extends outward between the coupling legs and supports the other end of each of the resonant springs may be disposed or provided on the cover body. Three cover-side seating part may be provided and circularly arranged at a same interval around the center in the axial direction.

A first support device or support having a plate spring shape, which connects the cover body to the shell cover, may be disposed or provided on the cover body, the first support device may be fixed to and mounted on the rear cover by the rear cover coupling members which may be circularly arranged at a same interval around the center in the axial direction, and three rear cover coupling members may be provided between the cover-side seating parts.

A support may be disposed or provided inside of the rear cover, and three spring support parts that extends outward from positions which are circularly arranged at a same interval around the center in the axial direction may be disposed or provided on a circumference of the support to support a rear end of the first resonant spring and a front end of the second resonant spring.

A discharge cover providing at least one space in which the discharged refrigerant may be temporarily accommodated may be disposed or provided on the frame, the discharge cover may be fixed and mounted by the discharge cover coupling member coupled to the frame, and three discharge cover coupling members may be circularly arranged at the same interval around the center in the axial direction to pass through the discharge cover. A second support device or support having a plate spring shape, which connects the discharge cover to the shell cover, may be disposed or provided on the discharge cover. The second support device may be fixed to and mounted on an inner surface of the shell by three second support device coupling members which may be circularly arranged at a same interval around the center in the axial direction.

A spring coupling part or portion that protrudes inward and to which the second support device coupling member may be coupled to mount the second support device thereon may be disposed or provided on the inner surface of the shell, and three spring coupling parts may be circularly arranged at a same interval around the center in the axial direction.

A terminal insertion part or portion into which a terminal part or portion that supplies power to the motor assembly may be inserted may be disposed or provided in the frame. Three terminal insertion parts or portions may be circularly arranged at a same interval around the center in the axial direction.

Embodiments disclosed herein provide a linear compressor that may include a shell having a cylindrical shape; a frame which is provided in the shell and on which a cylinder that accommodates a piston that compresses a refrigerant may be mounted; a discharge cover which may be mounted on one side of the frame and in which the compressed refrigerant may be temporarily accommodated; a motor assembly mounted on the frame and including a motor that provides power to the piston and a stator cover that supports the motor; a plurality of resonant springs seated on the stator cover and supporting the piston to allow the piston to perform a resonant motion; and a rear cover coupled to the stator cover to fix the resonant springs. Each of the frame, the discharge cover, the stator cover, and the rear cover may include a coupling member for the coupling at three points, and the three points may be circularly arranged at a same interval around the center in the axial direction.

Embodiments disclosed herein also provide a linear compressor that may include a shell having a cylindrical shape; a shell cover that covers both opened ends of the shell; a frame which is provided in the shell and on which a cylinder that accommodates a piston that compresses a refrigerant may be mounted; a motor assembly mounted on the frame and including a motor that provides power to the piston and a stator cover that supports the motor; a plurality of resonant springs seated on the stator cover and disposed at three points which may be circularly arranged around a center in an axial direction to support the piston so that a resonant motion of the piston may be performed; and a rear cover coupled to the stator cover to fix the resonant springs. The frame and the stator cover may be supported at three points by three cover coupling members. The cover coupling members that connects the stator cover to the frame may be arranged in a same first extension line as the resonant springs, and the cover coupling members that couple the stator cover to the rear cover at the three points may be disposed in a second extension line that rotates at a preset or predetermined angle from the first extension line.

A first plate spring that elastically supports the rear cover to the shell cover may be mounted on the rear cover, and the first plate spring may be supported on the shell cover at three points by three first support device coupling members. The first support device coupling members may be disposed or provided in the second extension line.

A second plate spring that elastically supports the discharge cover to the inside of the shell may be mounted on the discharge cover, and the second plate spring may be supported on the inside of the shell at three points by three second support device coupling members. The second support device coupling members may be disposed or provided in the first extension line.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a motor, a stator cover that supports the motor;

a plurality of resonant springs that include a plurality of first resonant springs and a plurality of second resonant springs, each first resonant spring is successively arranged along a same extension line as the second resonant springs, wherein first ends of the first resonant springs are supported by the stator cover and provided around a center of the stator cover in an axial direction;

a support provided between second ends of the first resonant springs and first ends of the second resonant springs of the plurality of resonant springs to support the first resonant springs and the second resonant springs; and a rear cover that supports the second ends of the second resonant springs, wherein the rear cover includes:

a cover body provided at the second ends of the second resonant springs such that the second resonant springs are provided subsequent to the support in the axial direction, the support is provided subsequent to the first resonant springs in the axial direction, the first resonant springs are provided subsequent to the stator cover in the axial direction, and the stator cover is provided subsequent to the motor in the axial direction, the axial direction being a direction extending from the stator cover to the rear cover;

a plurality of coupling legs that pass through spaces between the plurality of resonant springs at an edge of the cover body and extend to the stator cover, the plurality of coupling legs each having a length equal to or greater than a sum of a length of one of the first resonant springs and a length of a corresponding one of a respective second resonant spring in an installed position; and a plurality of leg coupling portions each bent outward from a respective extension end of each coupling leg and coupled to the stator cover, wherein an outer end of the leg coupling portion is provided inside of rather than at a radially outer end of the stator cover, wherein the support is coupled to a piston, to the second ends of the first resonant springs, and to the first ends of the second resonant springs, wherein the plurality of coupling legs cover an outer edge of the support to be disposed radially outside of the support in positions circumferentially between the plurality of first springs and positions circumferentially between the plurality of second springs, and wherein groups of the plurality of resonant springs and the plurality of coupling legs alternate in the circumferential direction to encircle the piston.

2. The linear compressor according to claim 1, wherein the rear cover includes a plurality of seats that extends outward from the cover body and supports the second ends of the second resonant springs.

3. The linear compressor according to claim 2, wherein the plurality of seats is arranged at three points having a same interval around the center of the stator cover in the circumferential direction.

4. The linear compressor according to claim 2, wherein at least a portion of each of the plurality of seats protrudes so as to be inserted into the second ends of the second resonant springs.

5. The linear compressor according to claim 1, wherein each of the plurality of coupling legs is formed to have a rounded shape.

6. The linear compressor according to claim 1, wherein a leg coupling member that passes through the leg coupling portion and is coupled to the stator cover is provided in the leg coupling portion.

7. The linear compressor according to claim 1, wherein the plurality of coupling legs are unitary with the rear cover, and each of the plurality of coupling legs extends to a bottom surface of the stator cover at which the first resonant spring is supported.

8. The linear compressor according to claim 1, wherein the stator cover includes:

a planar portion having a circular plate shape and on which the rear cover and the first resonant springs are mounted;

a rim that extends along a circumference of the planar portion in a mounting direction of the first resonant springs.

9. The linear compressor according to claim 8, wherein the rim includes a plurality of first rim portions and second rim portions alternating with the first rim portions, the second rim portions having a height that is shorter than a height of the first rim portions, wherein the first end of at least one of the first resonant springs is supported by the stator cover and provided at a circumferential position corresponding to a circumferential position of one of the first rim portions and provided radially inside of the first rim portion, the leg coupling portion is coupled to the stator cover at a circumferential position corresponding to a circumferential position of one of the second rim portions such that an end of each of the plurality of coupling legs is disposed radially inside of the second rim.

10. The linear compressor according to claim 8, further comprising a cover coupling member to couple the motor to the stator cover, wherein a center of the planar portion is open, a coupling hole is formed at an edge of the planar portion, and the cover coupling member is coupled to the coupling hole.

11. The linear compressor according to claim 10, wherein the coupling hole is defined at a position at which the plurality of resonant springs is mounted.

12. The linear compressor according to claim 10, wherein each group of resonant springs is a pair, and wherein the coupling hole is defined between pairs of resonant springs.

13. The linear compressor according to claim 10, wherein the cover coupling member passes through the motor and is coupled to a frame including a cylinder that defines a compression space for a refrigerant.

14. The linear compressor according to claim 13, wherein the cover coupling member is disposed in the same extension line as a resonant spring of the plurality of resonant springs.

15. The linear compressor according to claim 1, wherein the support includes:

a support body provided inside of rather than at the plurality of resonant springs; and a spring support that extends outward along a circumference of the support body.

16. The linear compressor according to claim 15, wherein the support body includes:

a support circumferential surface that defines a cylindrical shape; and a support front surface defined by a bending of an end of the support circumferential surface, which faces the motor, toward a central inside.

17. The linear compressor according to claim 16, wherein an opening is defined in a center of the support front surface, wherein a plurality of front holes is defined along a circumference of the opening, wherein a plurality of side holes is defined along a circumference of the support circumferential surface at regular intervals, wherein the motor includes a drive that reciprocates forward and backward, and wherein the support front surface is coupled to the drive.

18. The linear compressor according to claim 15, wherein a protrusion is formed on a first side surface of the spring support such that the first resonant spring or the second resonant spring is mounted thereon, and wherein a seating member coupled to the first resonant spring or the second resonant spring is provided on a second side surface of the spring support corresponding to the protrusion.

19. The linear compressor of claim 1, further including a support device coupled to the rear cover and including a plate spring spaced apart from the rear cover.

20. A linear compressor, comprising:

a motor, a stator cover that supports the motor, a plurality of resonant springs, each having a first resonant spring having a first end supported by the stator cover and provided around a center of the stator cover in an axial direction, and a second resonant spring successively arranged along a same extension line as the first resonant spring and having a second end;

a support provided between each first resonant spring and a corresponding second resonant spring of the plurality of resonant springs to support the first resonant spring and the second resonant spring; and a rear cover that supports the second end of each of the second resonant springs, wherein the rear cover includes:

a cover body provided subsequent to the second resonant spring in the axial direction such that the second resonant spring is provided subsequent to the support in the axial direction, the support is provided subsequent to the first resonant spring in the axial direction, the first resonant spring is provided subsequent to the stator cover in the axial direction, and the stator cover is provided subsequent to the motor in the axial direction, the axial direction being a direction extending from the stator cover to the rear cover; and a plurality of coupling legs that pass through spaces between the plurality of resonant springs at an edge of the cover body and extends to the stator cover, the plurality of coupling legs each having a length equal to or greater than a length of one of the plurality of resonant springs, wherein a distance from the center in the axial direction to outer surfaces of the plurality of coupling legs is shorter than a maximum distance from the center in the axial direction to the plurality of resonant springs, wherein the support is coupled to a piston, to a second end of the first resonant spring, and to a first end of the second resonant spring, wherein the plurality of coupling legs cover an outer edge of the support to be disposed radially outside of the support in positions circumferentially between the plurality of resonant springs, and wherein the groups of plurality of resonant springs and the plurality of coupling legs alternate in the circumferential direction to encircle the piston, wherein the support includes:

a support body provided inside of rather than at the plurality of resonant springs; and a spring support that extends outward along a circumference of the support body, wherein the support body includes:

a support circumferential surface that defines a cylindrical shape; and a support front surface defined by a bending of an end of the support circumferential surface, which faces the motor, toward a central inside, wherein an opening is defined in a center of the support front surface, wherein a plurality of front holes is defined along a circumference of the opening, wherein a plurality of side holes is defined along a circumference of the support circumferential surface at regular intervals, wherein the motor includes a drive that reciprocates forward and backward, wherein the support front surface is coupled to the drive, wherein the plurality of coupling legs are provided at an outer side of the support body, and wherein the spring support extends beyond a width of the plurality of coupling legs.

21. A linear compressor, comprising:

a motor, a stator cover that supports the motor;

a plurality of resonant springs, each having a first resonant spring having a first end supported by the stator cover and provided around a center of the stator cover in an axial direction, and a second resonant spring successively arranged along a same extension line as the first resonant spring;

a support provided between each first resonant spring and a corresponding second resonant spring of the plurality of resonant springs to support the first resonant spring and the second resonant spring; and a rear cover that supports the second resonant spring of each of the plurality of resonant springs, wherein the rear cover includes:

a cover body provided subsequent to the second resonant spring in the axial direction such that the second resonant spring is provided subsequent to the support in the axial direction, the support is provided subsequent to the first resonant spring in the axial direction, the first resonant spring is provided subsequent to the stator cover in the axial direction, and the stator cover is provided subsequent to the motor in the axial direction, the axial direction being a direction extending from the stator cover to the rear cover; and a plurality of coupling legs that pass through spaces between the plurality of resonant springs at an edge of the cover body and extends to the stator cover, the plurality of coupling legs each having a length equal to or greater than a length of each resonant spring, wherein a distance from the center in the axial direction to outer surfaces of the plurality of coupling legs is shorter than a maximum distance from the center in the axial direction to the plurality of resonant springs, wherein the support is coupled to a piston, to a second end of the first resonant spring, and to a first end of the second resonant spring, wherein the plurality of coupling legs cover an outer edge of the support to be disposed radially outside of the support in positions circumferentially between the plurality of resonant springs, and wherein the groups of plurality of resonant springs and the plurality of coupling legs alternate in the circumferential direction to encircle the piston, wherein the support includes:

a support body provided inside of rather than at the plurality of resonant springs; and a spring support that extends outward along a circumference of the support body, wherein a protrusion is formed on a first side surface of the spring support such that the first resonant spring or the second resonant spring is mounted thereon, wherein a seating member coupled to the first resonant spring or the second resonant spring is provided on a second side surface of the spring support corresponding to the protrusion, wherein the plurality of coupling legs are provided at an outer side of the support body, and wherein the spring support extends beyond a width of the plurality of coupling legs.

* * * * *